US006315648B1

(12) United States Patent
Neer

(10) Patent No.: US 6,315,648 B1
(45) Date of Patent: Nov. 13, 2001

(54) APPARATUS FOR PRESSURE TREATING A SURFACE

(76) Inventor: Dana L. Neer, 818 Eagle La., Apollo Beach, FL (US) 33572

( * ) Notice: Subject to any disclaimer, the term of this patent is extended or adjusted under 35 U.S.C. 154(b) by 0 days.

(21) Appl. No.: 09/268,602

(22) Filed: Mar. 15, 1999

Related U.S. Application Data

(60) Provisional application No. 60/077,957, filed on Mar. 13, 1998, and provisional application No. 60/111,744, filed on Dec. 10, 1998.

(51) Int. Cl.[7] ..... B24C 3/06
(52) U.S. Cl. ..... 451/92; 451/75
(58) Field of Search ..... 451/92, 87, 88, 451/75

(56) References Cited

U.S. PATENT DOCUMENTS

| | | | | |
|---|---|---|---|---|
| 3,916,568 | * | 11/1975 | Rose et al. | 451/87 |
| 4,045,915 | * | 9/1977 | Gilbert et al. | 451/87 |
| 4,095,378 | | 6/1978 | Urakami . | |
| 4,286,417 | | 9/1981 | Shelton . | |
| 4,545,156 | | 10/1985 | Hockett . | |
| 5,078,161 | | 1/1992 | Raghaven et al. . | |
| 5,309,683 | | 5/1994 | Hockett . | |
| 5,441,443 | | 8/1995 | Roberts . | |
| 5,456,412 | | 10/1995 | Agee . | |
| 5,489,234 | | 2/1996 | Hockett . | |
| 5,540,172 | | 7/1996 | Goldbach et al. . | |
| 5,628,271 | | 5/1997 | McGuire . | |
| 5,685,767 | | 11/1997 | Burds . | |
| 5,775,979 | | 7/1998 | Coke et al. . | |

FOREIGN PATENT DOCUMENTS

| | | | | |
|---|---|---|---|---|
| 4140978 | * | 6/1993 | (DE) | 451/75 |

* cited by examiner

*Primary Examiner*—Robert A. Rose
(74) *Attorney, Agent, or Firm*—Pendorf & Cutliff

(57) ABSTRACT

An improved high-capacity apparatus for rapidly pressure treating a large surface area, such as the hull of a cargo ship or a large storage tank, using high-pressure spray. The apparatus conforms to the surface to be treated and provides the treating power of multiple rotating nozzles. The apparatus preferably comprises a framework comprised of one or more frame members; at least one rotary spray unit flexibly associated with each frame member, each rotary spray unit comprising at least one rotary spray arm having at least one nozzle directed away from the framework, a high pressure surface treatment medium supply conduit, a rotary union having an axis of rotation and connecting the high pressure medium supply conduit with the rotary spray arm; enclosure means for individually and/or collectively enclosing the rotary spray units against the surface being treated; rotary spray unit positioning means for individually positioning each of the respective rotary spray units relative to the surface being treated; primary framework positioning means for orienting the framework along the surface to be treated relative to secondary means positioning means and adapted for providing constant bias of the framework against the surface being treated; and secondary framework positioning means for supporting and moving the primary framework positioning means relative to the surface to be treated.

25 Claims, 67 Drawing Sheets

FIG. 6
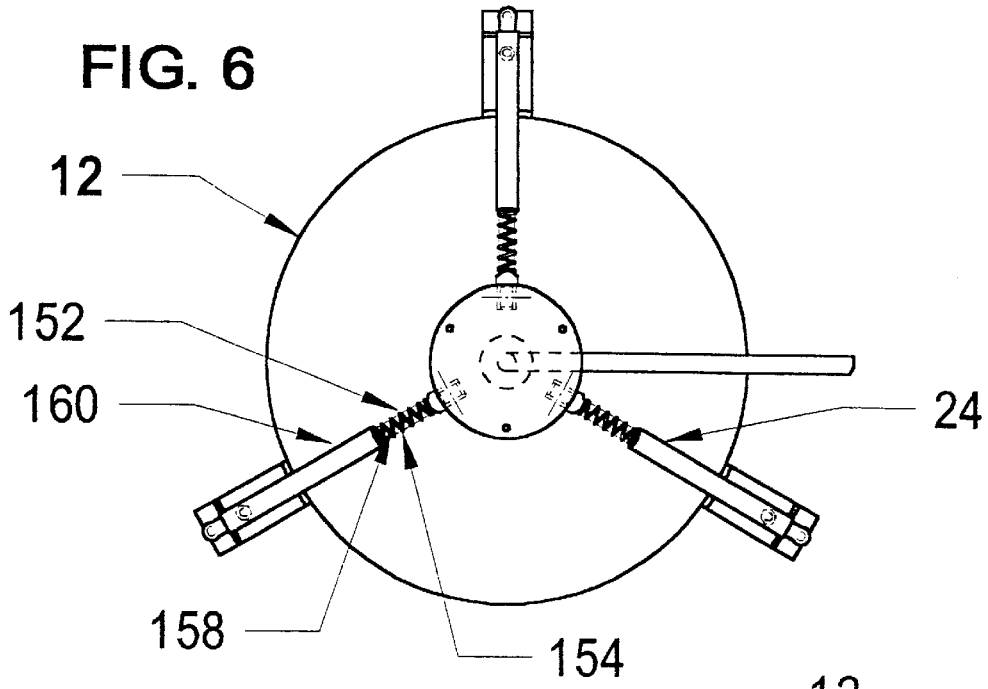
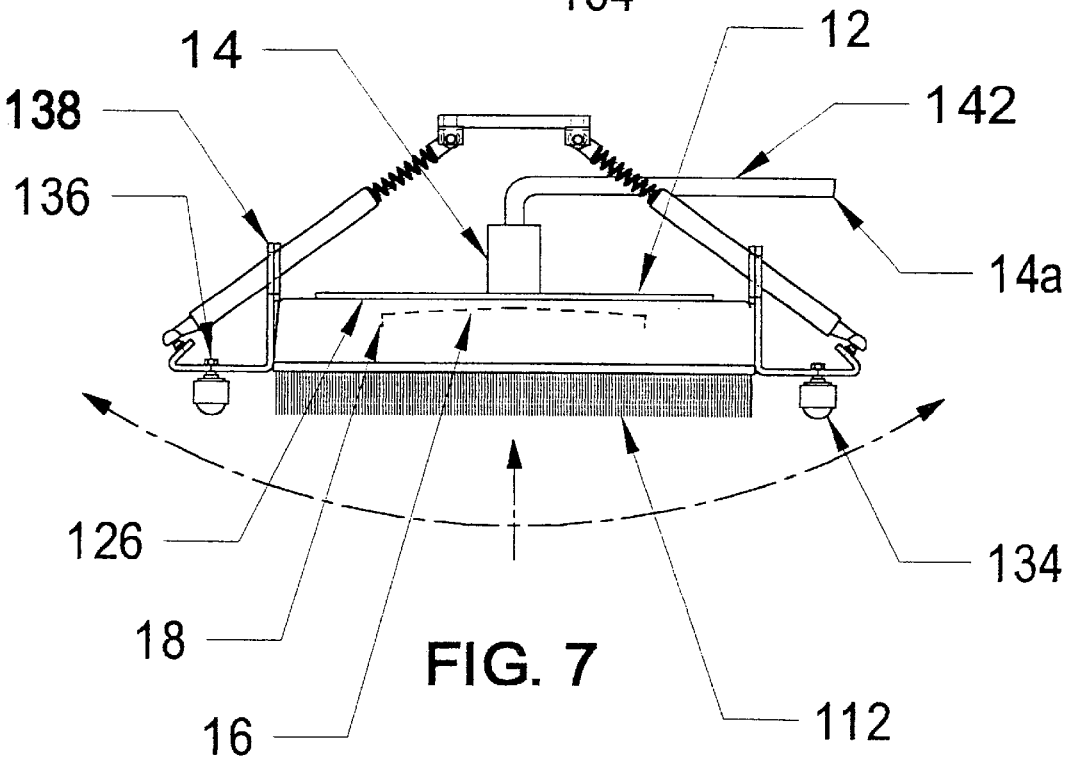
FIG. 7

298
297
285
F-F 298
285
299
300
D-D

E-E

285
E
E
F
D
D
294
293
295
296
F
297
292
297
297

H-H

G-G

APPARATUS FOR PRESSURE TREATING A SURFACE

CROSS REFERENCE TO RELATED APPLICATIONS

This application is a continuation application of Provisional Application Ser. No. 60/077,957 filed Mar. 13, 1998 and Provisional Application Ser. No. 60/111,744 filed Dec. 10, 1998. The entire disclosure of the previous application is incorporated herein by reference.

BACKGROUND OF THE INVENTION

1. Field of Invention

The present invention relates to an improved high-capacity apparatus for rapidly pressure treating a large surface area, such as the hull of a cargo ship or a large storage tank, using high-pressure spray. The apparatus conforms to the surface to be treated and provides the treating power of multiple rotating or oscillating nozzles, or rotating brushes. Conformity is important in that optimal treatment requires spray nozzles to be spaced a predetermined distance from the surface being treated. Further, conformity allows for an improved seal around the treatment apparatus for collecting and recycling fluids, volatile emissions or abrasives used and for capturing any material removed from the surface during treatment. Multiple rotating nozzle units increase the area of coverage per pass of the apparatus, thus reducing the amount of time required to treat a large surface. The invention further relates to means for positioning the apparatus against a non-horizontal surface and moving the apparatus along the surface for continuous surface preparation.

2. Discussion of the Related Art

Cargo ships travel long distances through salt water. Over time the outer surface of the ship hull becomes covered with marine growth, which increases drag and reduces the operating efficiency of the ship. The corrosive action of salt water causes the hull to corrode, which can lead to metal fatigue and hull damage. It is thus necessary to periodically clean, prepare (e.g., etch), and repaint the hull of the ship. This requires lifting the hull from the water in a dry dock facility.

Dry dock work is both equipment and labor intensive. Hull surface cleaning and preparation prior to painting must be accomplished to a high level of quality, and must pass inspection by the ship's master. If a hull fails to pass inspection, it must be re-treated. The expense of re-treatment can cause the contractor to loose any profit he may have made on the contract.

Obviously, while the ship is in dry dock it is out of commission and not operating for profit. The longer the ship is in dry dock, the greater the economic cost to the ship owner. There is thus a need to clean and prepare a hull as quickly as possible. Equipment available today is not capable of rapidly treating large surface areas, particularly surfaces that are curved and/or non-horizontal.

Additional significant problems with hull preparation relate to concerns over pollution by material removed from the ship hull during the pressure treating. This material may be entrained in liquids or abrasives used in pressure treating the hull, or may be airborne particulate or volatile chemical matter. Environmental laws mandate strict measures for collecting this waste and then disposing of the collected waste. Many shipyards today are not capable of meeting these requirements.

Further yet, noise evolved by equipment used in high-pressure treatment can represent a risk to the health of the operator and other dock workers.

Other examples of structures that have large surface areas that need cleaning include buildings, elevated water tanks and storage tanks. Specifically, storage tanks of the type used for storing crude oil, chemicals and other large quantities of liquid or solid material. Storage tank cleaning is very much like cleaning the hull of a cargo ship. The owner of the storage tank must follow similar regulations with regard to the containment of the hazardous waste byproducts created during the cleaning process, i.e. paint, rust, sludge etc.

Presently, surface-treating jobs can take several days to several weeks. Most surface blasting machines (sand blasting, ball or shot peening, etc.) and abrasive cleaners in use today are designed to remove all coatings and rust down to bare metal. In most cases, such excessive cleaning is not necessary. The preparation of a ship hull for painting merely requires that surface materials are removed down to a good layer of paint or epoxy to which the new layer of primer or paint can bond. There is thus a need for a method for preparing a surface which is faster and which does not remove excessive amounts of material.

The pollution problem created when cleaning cargo ship hulls and storage tanks is so widespread that many governments (foreign, federal and state) regulations are requiring total containment of the structure during the cleaning process, e.g., by providing a framework around the structure and then draping canvas or shrink-wrapping plastic over the structure. This may take days or weeks to rig. Once the ship hull or storage tank is cover cleaning is done under the containment material. Even where the structure has been covered, there is no guaranteed against air-borne particulate and gaseous leakage and liquid runoff during the cleaning operation. Due to the large surface area, canvas or plastic are easily damaged or removed by the wind. Once the containment covering is blown off by the wind, it may takes several days to re-contain the ship or storage tank.

Yet another hazard associated with attempting to contain evolved hazardous materials stems from the accumulation and concentration of hazardous or flammable materials inside the containment zone. When cleaning or painting ship hulls or storage tanks using conventional apparatus, air-borne fine particulate material and evolved gasses accumulate within the containment material, usually in the upper areas. Most of these evolved materials are hazardous to-humans and/or highly flammable, and any type of igniter (e.g., arcs and sparks from electrical machinery, dropped molten metal from welding operations, etc.) coming in contact with the upper layer of the containment material can cause an explosion or fire. Further, in some cases other services must be performed by dockyard workers at the same time that the ship hull is being cleaned, that is, these personnel must work under the containment material. Personnel near the cleaning operation may wear protective garments and particulate filtration breathing gear. Workers inside the ship, in most cases, would not be wearing protective gear. Thus, as the concentration of hazardous or flammable materials increases, the risks to the safety of the personnel working inside the containment area increase. Finally, it has been found in practice that containment material does not prevent the waste materials from running off the ship and entering the ground or water around the shipyard.

Presently no apparatus is available which is capable of cleaning and preparing a large non-horizontal and non-planar surface areas in a short period of time, to the high standards required to pass the scrutiny of a marine inspection, without serious noise emissions, and without violating EPA standards. Even though violation of legally mandated containment standards can bring fines and jail time, violation continues to be the practice rather than the exception, since no equipment is presently available which can meet the environmental standards in a cost-effective manner.

Various specialized devices have been developed for surface treating metal surfaces. "Vactrax", available from TMR Associates Inc., cleans surfaces to bare metal using 40,000 PSI water pressure at 6 GPM, has a cleaning width of 8 to 8.5 inches. The device uses 4 to 10 inches of mercury vacuum to suction adhere to the side of a ship, and can recover and capture waste. Such a device is not suitable for preparing ship hulls prior to repainting for four reasons. First, due to the very narrow cleaning width, it would take a very long period of time to surface treat a large hull. Second, the device is designed to completely remove paint from steel. Most ships merely require cleaning and preparation of surfaces, and do not require complete removal of paint. Third, as much as 225 horsepower may be required to maintain the vacuum required to suction adhere the device to a vertical surface. Such a machine is costly to operate and maintain. This is a waste of power. And fourth, any interruption in vacuum or any break in the seal between the device and the surface can cause the device to break free and fall—a significant danger, considering the weight of such a device.

"Hydro-Crawler" available from Jet Edge®, a Division of TC/American Monorail, Inc., uses powerful permanent magnetic tracks to secure to any steel surface such as a ship hull. It cleans a path up to 19 inches wide at 40,000 PSI, and thus completely removes any coating from steel. In addition to being slow, such a magnetic track vehicle is difficult to turn and maneuver.

"U-Robot System Polishing Robot—Type: UM" and "Abrasives Blasting Robot—Type: UA" available from Urakami Research & Development Co., Ltd. use vacuum to suction adhere and to vacuum clean, and use polishing cloths or abrasives. Depending upon model, the vacuum pump motor must be operated at 22 to 90 Kw. The unit cleans only one swath and travels at a speed of only 6 to 9 meters per minute. This system removes all paint to the bare metal, which is not necessary.

"Aquablast®-Plus" available from Hammelmann Corp. uses ultrahigh pressure water jets at flow rates of up to 33 L/min and pressures up to 2,500 bar to remove paint coatings and rust from the hull. It cleans and vacuums, and suffers from the above listed defects.

"The Robotic Climber™" available from Bartlett Services, Inc. of Plymouth, Mass., applies up to 36,000 PSI hydropressure to remove coatings from flat metal surfaces, and uses a powerful vacuum system to adhere to surfaces and to recover stripped waste. The device is only capable of treating surfaces at a rate of between 150 and 1,000 sq.ft. per hr.

"The Blast-Droyd" is available from Burds L. L. C. and is covered by U.S. Pat. No. 5,685,767 (Burds) teaches a sandblasting system including two principal components: a trolley which is located on the flat upper surface of the object to be sandblasted and a blasting machine with an oscillating blast nozzle that is carried by the trolley. The blast machine is suspended from hoist cables, whose ends are carried by the trolley. The blast machine includes a hoist drum for gathering or releasing the cable to raise or lower the blast machine along the vertical surface. For cleaning horizontal surfaces, the blast machine is carried by the trolley itself and oriented so as to direct the sand blast in a downward direction. The device is thus designed for cleaning only horizontal or perfectly vertical surfaces. The blast machine carries a mechanism for oscillating the blasting nozzle and the hoist drum within a housing to protect the moving parts from the harsh operating environment.

A review of patent literature shows that various other attempts have been made to address aspects of these problems. U.S. Pat. No. 5,628,271 (McGuire) teaches a method and apparatus using ultra-high pressure water jet to remove coatings, paint, deposits, and organic and inorganic materials from the hull of a ship. The apparatus uses a steered magnet vehicle supported by the adhesive force only of a permanent magnet to the surface to be treated. The apparatus cleans the surface of a ship hull at a rate of about 150 to about 400 square feet per hour with water at 60,000 psi using five to fifty gallons per minute. This rate of treatment is too slow to be considered for treating the large surface area of a hull of a cargo ship in a dry dock. Further, pumps for supplying fluids at such high pressures are expensive. There is also a risk of detachment if the tracks run over a non-ferrous or rusty area.

U.S. Pat. No. 5,489,234 (Hockett) and U.S. Pat. No. 5,309,683 (Hockett) both teach an apparatus which projects a cleaning material such as sand, water or the like from a nozzle to impact upon a surface to be treated, such as the hull of a ship. A fluid seal means provides a seal between a housing and the surface being treated. A vacuum source is connected to the housing for withdrawing the impacted cleaning material and surface material removed from the surface. The apparatus may be suitable for treating small areas of a ship hull, but is not suitable for treating a large hull in a short period of time while a ship is in dry dock. Further, the apparatus is rather complex, and the means for controlling the placement and movement of the apparatus is complex. Rams are used to adjust the distance between the nozzles of the treatment apparatus and the surface to be treated. Air cylinders extend the rams for adjusting the housing relative to the nozzle for varying the distance between the nozzles and the surface. A computer is preferably used to control the movement of the rams, which further increases cost and complexity of the system. Also, these rams have to make contact with the surface to sense and adjust distance. There are advantages to not contacting the surface to be treated.

U.S. Pat. No. 5,441,443 (Roberts) teaches an apparatus for blast cleaning surfaces at from 45 degrees upward to 45 degrees downward from vertical. This apparatus includes a housing, a blast assembly, a motor for rotatably driving the blast assembly, and a hopper. Different hoppers are required for surfaces of different angles. As the inclination of the curved surface changes, hoppers must be exchanged in order for the apparatus to work properly. There is thus a need for an apparatus that can work on any curved surfaces at any inclination, thus eliminating the need for the exchange of components.

U.S. Pat. No. 5,775,979 (Coke et al) teaches an enclosed abrasive blasting apparatus for a ship hull or other working surface, comprising a movable and adjustable boom, and an enclosed containment cabin for the operator and the abrasive tool mounted on the boom. The containment cabin has a top, sides, back and bottom, an adjustable angle open front, and a gum rubber seal for placing against the working surface. The outlet nozzle for the abrasive blasting system is positioned within the containment cabin, and the operator directs the nozzle against the working surface. A waste collection system creates a negative pressure in the containment cabin, which seals the cabin against the working surface and directs waste particles to a sealed collection container below the cabin. Such an apparatus would not be able to clean the large surface area of a cargo ship hull in a short period of time.

U.S. Pat. No. 5,540,172 (Goldbach and Salzer) teaches the use of an apparatus for performing external surface work on the underside of a ship hull. Towers are placed around a ship in dry dock, a shroud is used to create an enclosed workspace between the towers and the ship, and an air processing system ventilates air in the space. For abrasively blast cleaning the bottom of a ship hull, an upwardly facing closed cycle abrasive wheel is mounted on moderately articulable rails of a mobile carrier. The abrasive wheel has a compliant seal projecting forwards around its frontal perimeter. A control panel is provided to extend and retract rail end support jacks of the carrier frame for locally conforming the vertical positioning of rail ends to the bottom of the ship. This device can only be used for treating the bottom surface of the ship, and is not fully contained.

U.S. Pat. No. 4,545,156 (Hockett) and U.S. Pat. No. 4,139,979 (Hockett) teach a universal abrasive cleaning apparatus. A plurality of nozzles are connected to the distal end of a series of arms. Abrasive and fluid are conveyed through the arms to nozzles. A microcomputer receives rotational position information from sensor means and directs the stream of abrasive and fluid emitted from the nozzles to trace a particular geometric pattern thereby cleaning the area of the work surface. While this apparatus may be suitable for cleaning complex areas, it is not suitable for cleaning a large surface area such as an entire ship hull.

When high pressure water is jetted from a single nozzle, washing or stripping occurs only linearly as the nozzle is moved, and thus the operating efficiency is low. Operating efficiency is improved by associating the nozzle with a rotary spray arm which rotates rapidly in a rotational direction opposite from the impingement angle as a result of reactionary and ground effects of fluid escaping under pressure from the spray nozzle. As the spray device is moved over the surface, a broad cleaning pattern is described by the combination of the rotating rotary spray arm and the linearly moving apparatus. U.S. Pat. No. 5,456,412 (Agee) provides a pressure cleaning device approximately the size of a small lawnmower. The device is suitable for cleaning driveways, but is not suitable for cleaning non-horizontal surfaces, or for cleaning large surface areas in short periods of time, or for stripping paint from metal surfaces.

U.S. Pat. No. 5,078,161 (Raghavan) teaches an apparatus to remove rubber from airplane tires from an airport runway surface. The apparatus uses a rotary manifold to discharge water jets under high pressure (at least 20,000 psi, with a preferred range of 35,000 psi to 55,000 psi). A hydraulic motor is used to rapidly rotate the manifold so that the jets travel at high speed relative to the surface (e.g., ninety to one hundred miles per hour). As a result of this short dwell time, high water jet pressures can be used without damaging the surface. The device employs a shaft and seal assembly specially designed to operate at these high speeds and pressures. The device is limited to treating horizontal surfaces, and over a relatively narrow path width.

Treating a surface such as a ship hull is much more complex than treating a horizontal surface such as an airport runway. A ship hull is not planar, thus the device must be able to conform to convex and concave surfaces. Gravity can not be used to bias the apparatus against the ship hull, thus an artificial system must be created to keep the apparatus a fixed distance from the surface being treated. The apparatus must be capable of covering a large surface area in a short period of time. When cleaning a ship hull time is of the essence to reduce dry dock costs. When cleaning a storage tank it is important to reduce the man hours needed to clean the tank. The apparatus must be capable of treating the surface with high quality and high reliability, so that the treated surface passes inspection and need not be retreated. The apparatus must be economical to construct and operate, and must have a long operation life between repairs. Finally, the apparatus must be capable of being operated by persons of ordinary skill.

SUMMARY OF THE INVENTION

In view of the foregoing disadvantages inherent in known types of apparatus for pressure treating a surface using high pressure spray and rotary nozzles, it is an objective of the present invention to provide a high capacity, multi-rotary arm high pressure surface treating apparatus that can effectively be moved along and clean and substantially conform to curved and/or non-horizontal surfaces.

It is a further objective to provide an apparatus that can treat a surface of a ship hull with the quality required to prepare a hull prior to painting, and to do this over a large surface area in a relatively short period of time, enabling the ship to leave the dry dock in a short a period as possible.

It is a further objective to provide an apparatus that can treat the inner or outer surface of a storage tank with the quality required to thoroughly clean the tank of paint, rust, sludge or other material and prepare the surface of the tank prior to painting, and to do this over a large surface area in a relatively short period of time.

It is an additional objective of the present invention to extract, capture, and contain material removed from the treated surface and to recycle and clean any fluids or abrasives used in treating the surface. Such capturing and containing should be of such a degree that there is no need for additional containment of the hull or tank within a containment material.

These and other objectives of the present invention have been accomplished by providing a high pressure surface treating apparatus comprising:

- a framework comprised of one or more frame members, which in the case of multiple frame members are directly or indirectly hingedly connected to each other to form a flexible framework;
- at least one rotary spray unit flexibly associated with each frame member, each rotary spray unit comprising at least one rotary spray arm having at least one nozzle directed away from the framework, a high pressure surface treatment fluid (gas or liquid optionally further including a solid such as grit or shot) supply conduit, a rotary union having an axis of rotation and connecting the high pressure fluid supply conduit with the rotary spray arm;
- enclosure means for individually and/or collectively enclosing the rotary spray units against the surface being treated;
- rotary spray unit positioning means, preferably resilient, for individually positioning each of the respective rotary spray units relative to the surface being treated;
- primary framework positioning means for orienting the framework along the surface to be treated relative to secondary means positioning means and adapted for providing constant bias of the framework against the surface being treated; and
- secondary framework positioning means for supporting and moving the primary framework positioning means relative to the surface to be treated.

The high pressure surface treating apparatus preferably further includes a recycle return conduit, one end of which is in communication with the housing (which may surround each rotary spray unit individually or may surround the rotary spray units of the high pressure surface treatment apparatus collectively), the other end of which is connected to a vacuum source. This vacuum source evacuates the housing(s) at a rate greater than the rate at which the high pressure surface treatment fluid, such as high pressure water or high pressure air and grit, is introduced into the housing. Alternatively, gravity could be used to drain the enclosure housing.

The return conduit or vacuum source are preferably also associated with means for separating material removed from the surface being treated, such as anti-fouling paint or rust, from the pressure treating fluid. This permits the high pressure treatment fluid to be recycled and reused. This is particularly important in the case that recycle fluid or air is to be directed through the high pressure rotary unions.

The apparatus preferably also comprises a source of fluid under high pressure in communication with the supply conduit.

At least one spray nozzle of each rotary spray unit is preferably directed at an angle offset from the rotational axis of the rotary union, such that the rotary spray arm rotates rapidly in a rotational direction opposite from the impingement angle as a result of reactionary and ground effects of fluid escaping under pressure from the spray nozzle. Alternatively, turbine, impeller, or propeller means may be incorporated in the rotary junction unit so that motion is imparted to the rotary arm by fluid passing through the rotary junction unit. Further yet, hydraulic, pneumatic or electric motor means may be used to power the rotation of the rotary spray unit.

The present invention preferably further comprises an adjustable structure, such as a boom or a suspension rigging, to carry or hang and position the apparatus, and optionally also an operator, and to keep the apparatus positioned near the surface during treatment.

BRIEF DESCRIPTION OF THE DRAWINGS

The present invention has the above as well as other objects, features and advantages which will become more clearly apparent in connection with the following detailed description of a preferred embodiment, taken in conjunction with the appended drawings in which:

FIG. 6 is a top plan view of one embodiment of self-enclosed rotary spray unit depicting resilient rotary spray unit positioning means as spring tension arms.

FIG. 7 is a side view of the embodiment of FIG. 6.

DETAILED DESCRIPTION OF THE INVENTION

The high pressure surface treating apparatus of the present invention in its most basic form comprises:

- a framework comprised of one or more frame members, which in the case of multiple frame members are directly or indirectly hingedly connected to each other to form a flexible framework;
- at least one rotary spray unit flexibly associated with each frame member, each rotary spray unit comprising at least one rotary spray arm having at least one nozzle directed away from the framework, a high pressure surface treatment fluid (gas or liquid) supply conduit, a rotary union having an axis of rotation and connecting the high pressure fluid supply conduit with the rotary spray arm;
- enclosure means for individually and/or collectively enclosing the rotary spray units against the surface being treated;
- rotary spray unit positioning means, preferably resilient, for individually positioning each of the respective rotary spray units relative to the surface being treated;
- primary framework positioning means for orienting the framework along the surface to be treated relative to secondary means positioning means and adapted for providing constant bias of the framework against the surface being treated; and
- secondary framework positioning means for supporting and moving the primary framework positioning means relative to the surface to be treated.

These components are individually configured and correlated with respect to each other so as to attain the desired objective.

The present invention provides an apparatus and a process for high-speed treatment of a large surface area, and particularly including curved and/or non-horizontal surfaces such as the hull of a large ship or the surface of large storage tanks. The apparatus is capable of capturing the surface treatment medium and removed surface materials, so that there is no need to place towers or other containment means around a ship in dry dock, to provide a shroud to create an enclosed workspace between the towers and the ship, and to ventilate and filter the air in the workspace by an air processing system.

Figure 1:
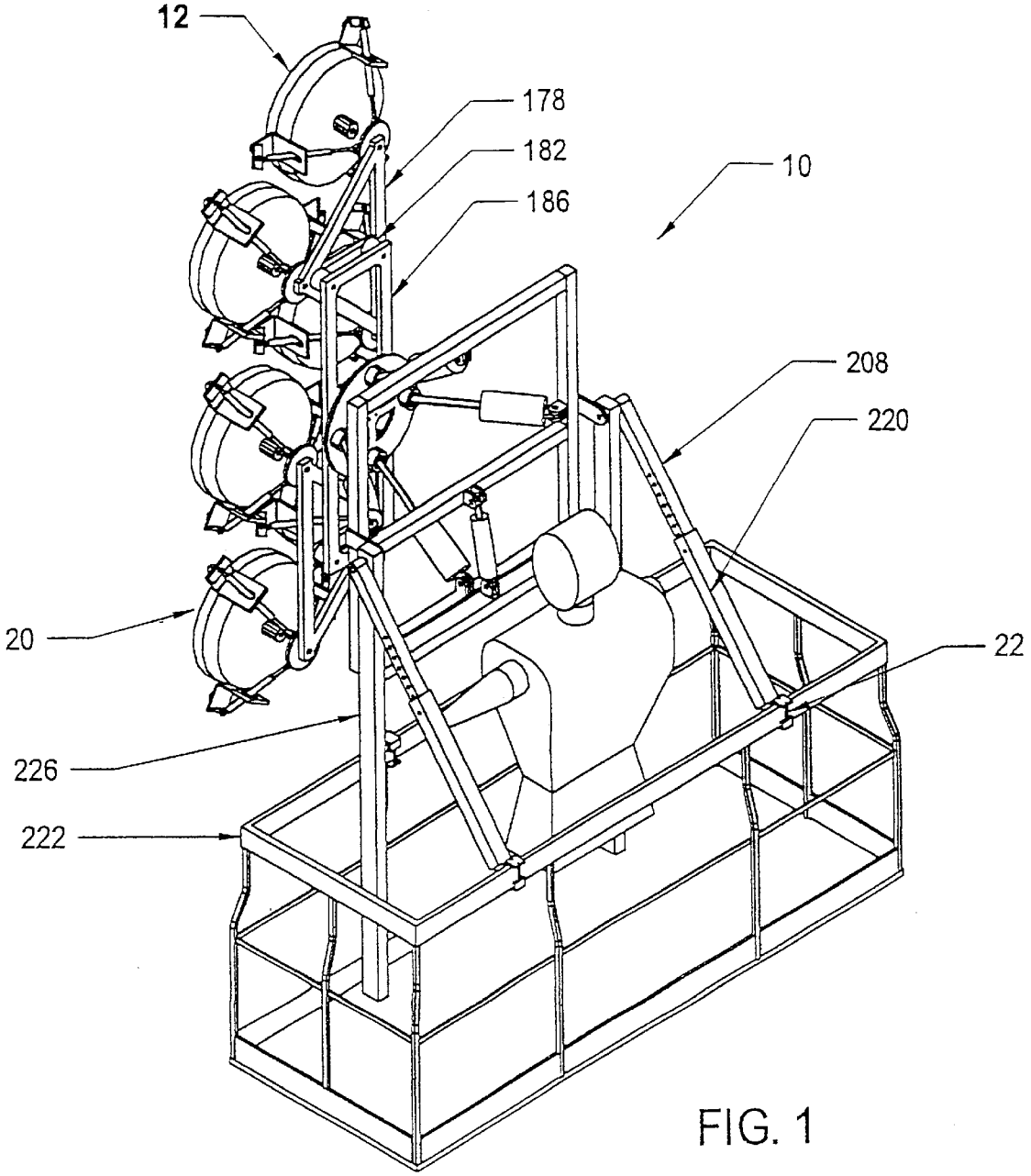
FIG. 1 is an elevated perspective illustration of an apparatus for pressure treating a surface constructed in accordance with the principles of the present invention.
Figure 1A:
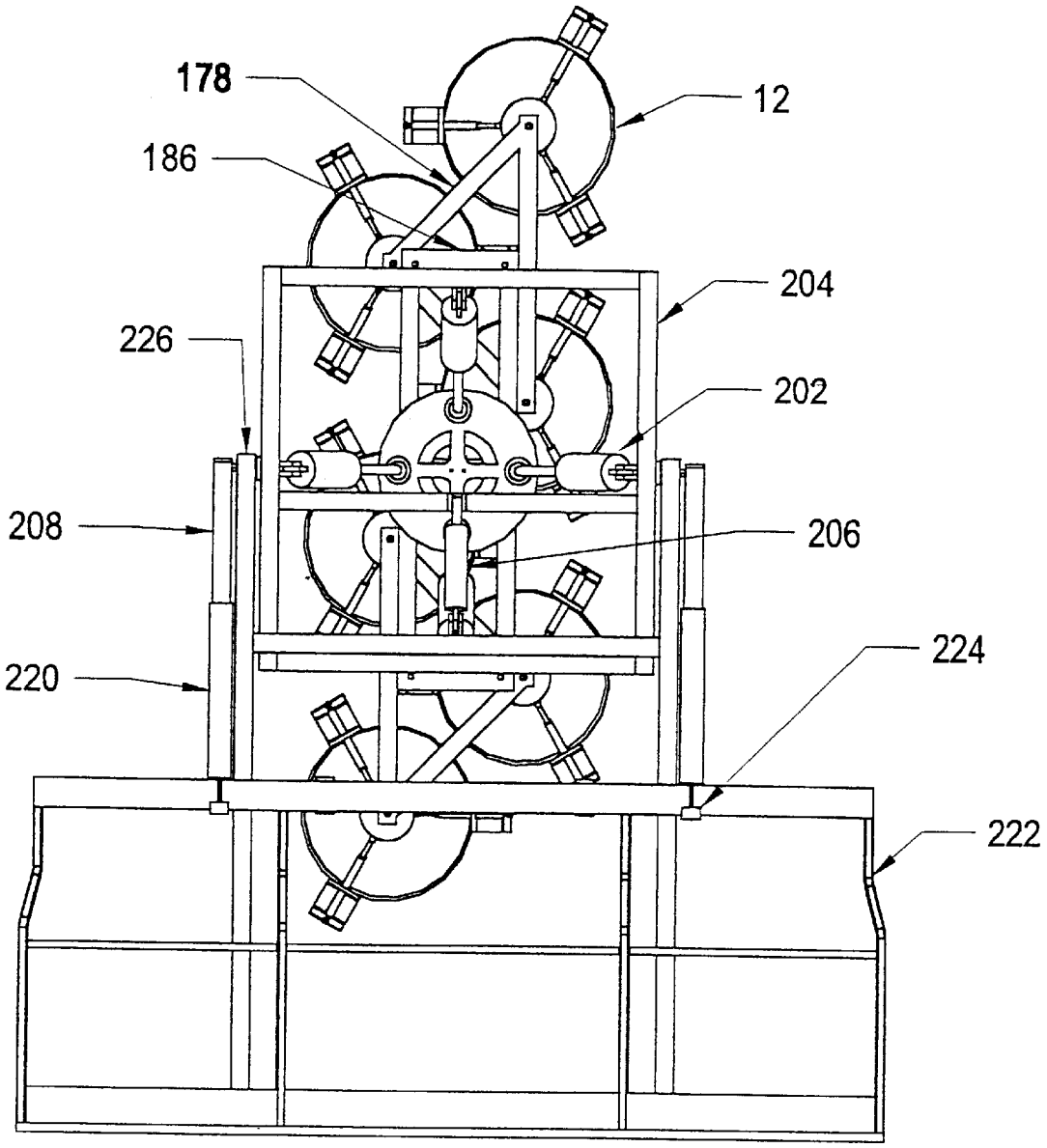
FIG. 1A is a rear view of the apparatus for pressure treating a surface.
Figure 70:
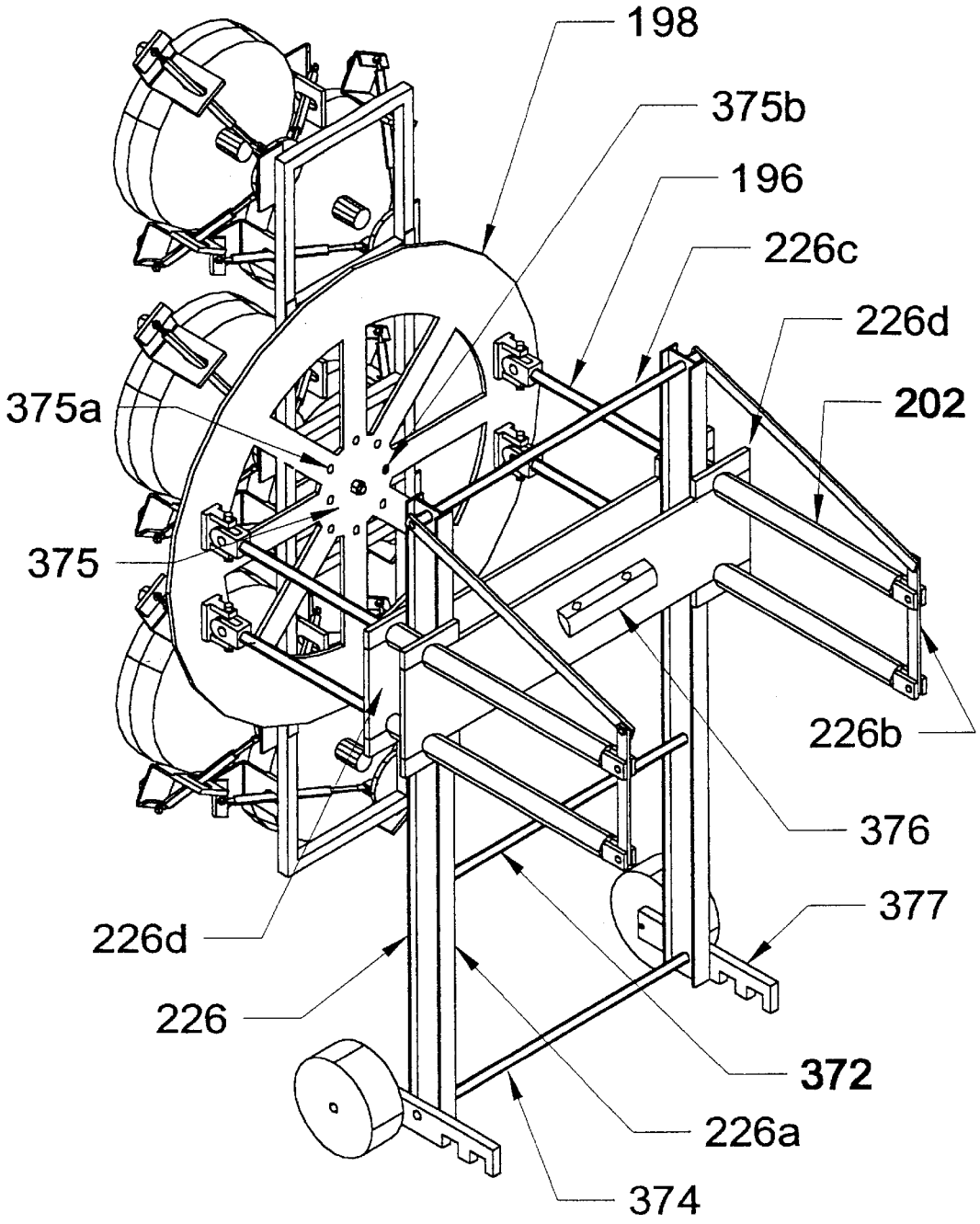
FIG. 70 is a view of another embodiment of the primary framework positioning means of the present invention.
Figure 70A:
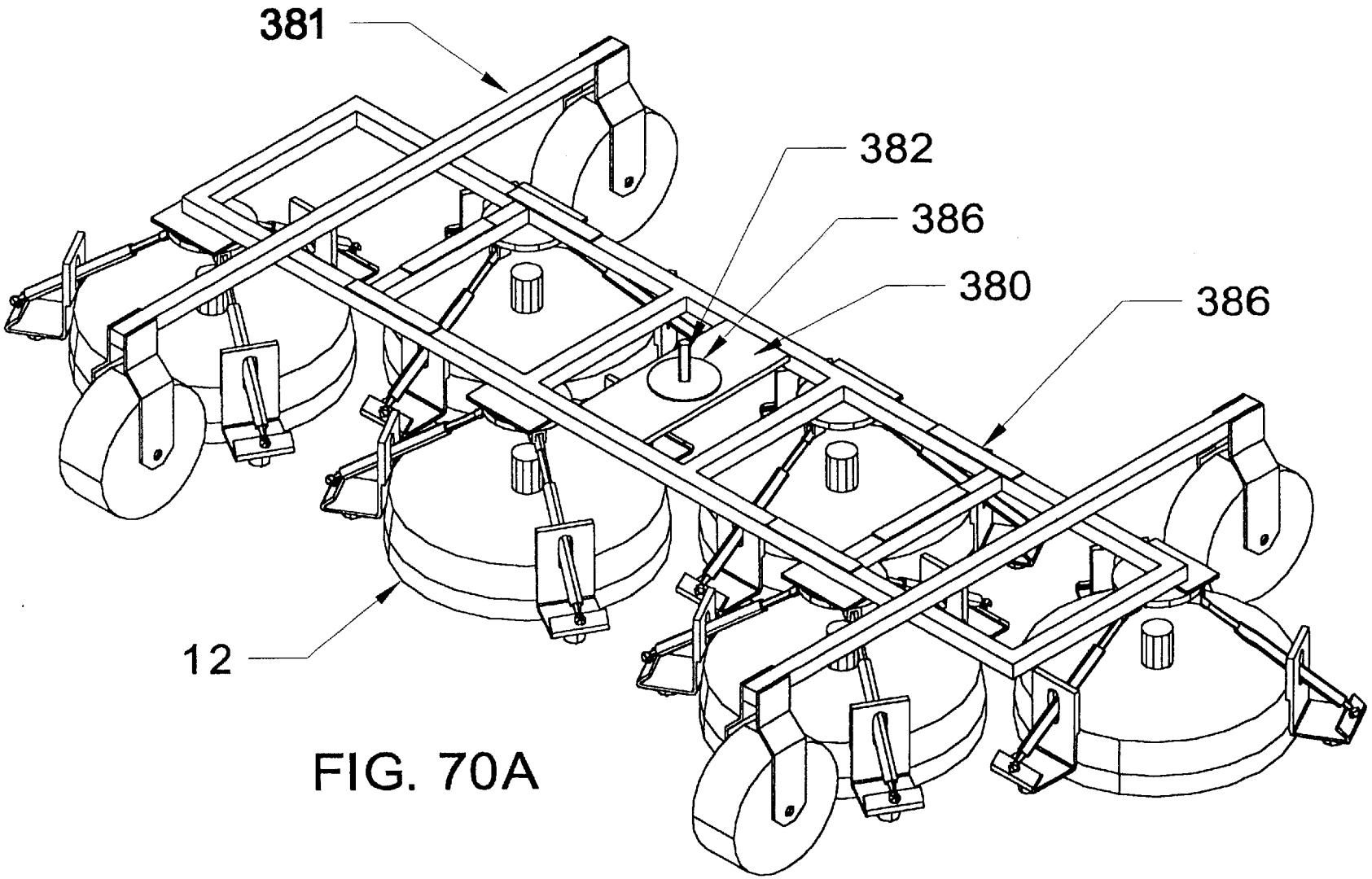
FIG. 70A is an isomeric perspective view of the plurality of rotary spray units in communication with a single rectangular frame of the framework, with the rectangular frame supported by an outrigger (optional hinges not shown).
Figure 70B:
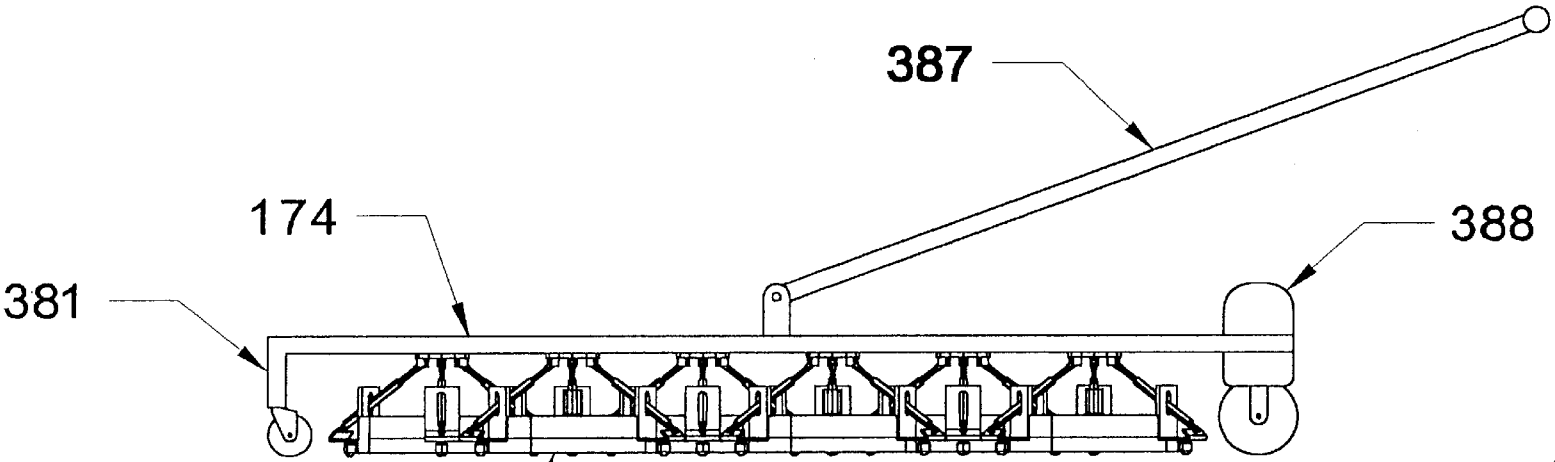
FIG. 70B is a side view of the plurality of rotary spray units connected to a remote secondary positioning means.

The concept underlying the present invention can be seen from a first embodiment of a surface treatment apparatus 10 of the invention shown in FIG. 1 is a high skills version, the fifth embodiment, shown in FIGS. 70–70B is a low skills version. FIGS. 1–1B, 2–3, 4, 29–32 and 70–70B depicts a high pressure surface treating apparatus including multiple rotary spray units. These apparatus have a simple mechanical design and are thus durable and light-weight.

The components of the surface treatment apparatus will be discussed in detail by reference to the figures.

Rotary Spray Units

Each rotary spray unit of the plurality of rotary spray units 12 making up the apparatus 10, as shown in FIGS. 1–19, 27–34, 68–69, 70A, 71 and 72 is comprised of at least one rotary spray arm 16 having at least one nozzle 18 directed away from the framework, a high pressure surface treatment fluid (gas or liquid) supply conduit 14A, a rotary union 14 having an axis of rotation and connecting the high pressure fluid supply conduit with the rotary spray arm, and means for resiliently connecting the rotary spray unit to the frame member. Rotary spray unit positioning means, preferably resilient, is used for positioning/spacing respective rotary spray units relative to the surface being treated, and may be incorporated in part in a containment housing. Each rotary spray unit may be provided with one containment housing, or a single large containment housing may be provided covering all rotary spray units, or both types of containment housing may be provided. Each of these components will be described below in detail.

Rotary Unions

Figure 26:
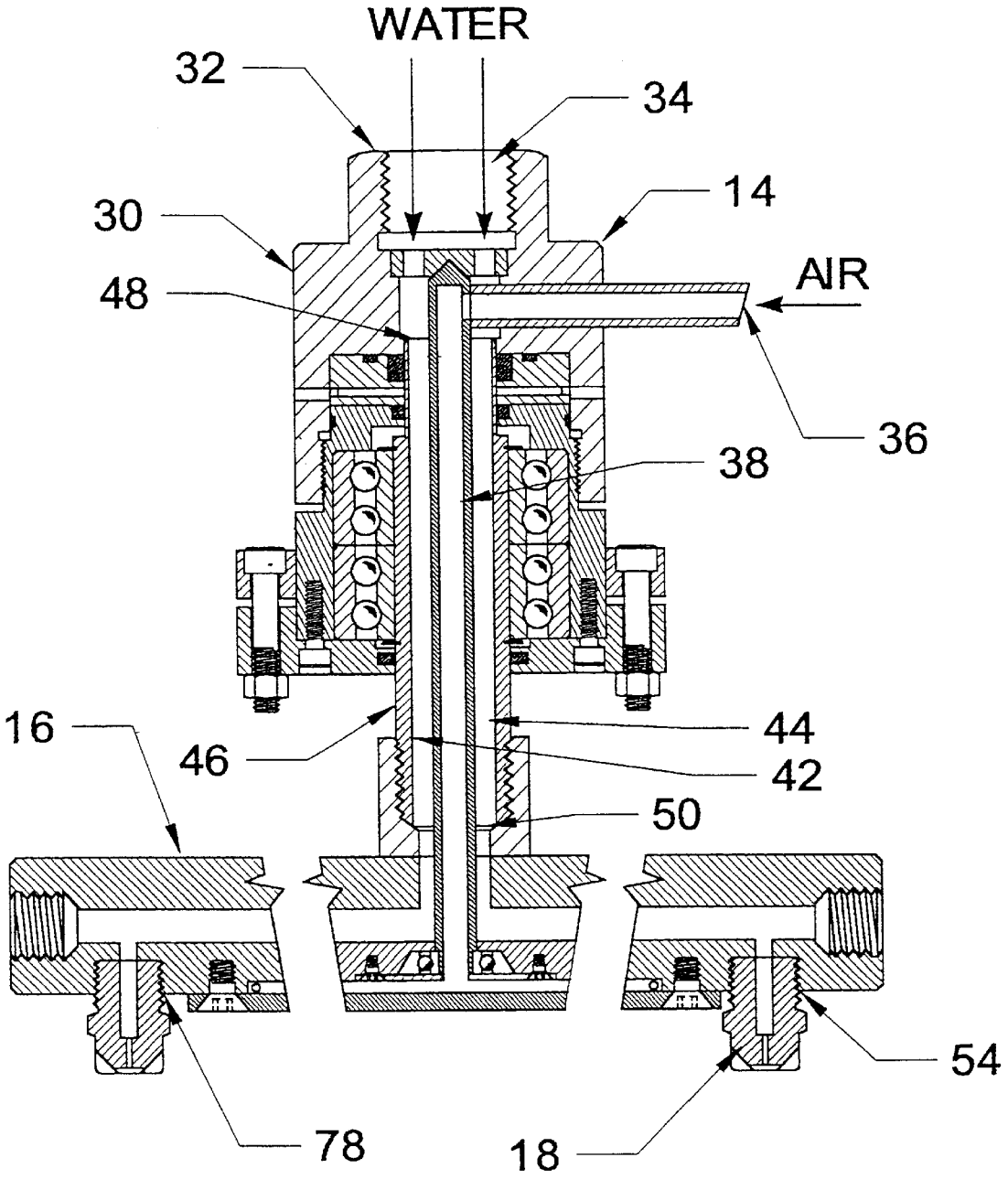
FIG. 26 is a cross-sectional view of the rotary union of the present invention coupled with the rotor arm.

Rotary unions 14, often referred to as swivel joints, are used in applications when necessary to couple the stationary outlet of fluid sources (i.e., water main, hoses, etc.) to rotating sprayer devices (e.g., rotating spray nozzles or sprayer arms). One such rotary union is shown in FIG. 26. These rotary unions are used, for example, in devices for delivering sprays of fluid such as water, often with detergents or additives, onto work surface to be treated, as in driveway or sidewalk cleaning operations or automobile washing operations. These rotary unions are well known in the industry and need not be described in great detail herein.

As examples of rotary unions which can be used in, or which can be adapted for use in, the present invention, reference may be made to U.S. Pat. No. 5,501,396 which teaches a method of sealing water flowing through a central bore of a rotary union, U.S. Pat. No. 5,456,413 which teaches a rotary water blast nozzle that includes an inner body member and a mandrel that supports a spray head having an internal bushing that rotates on the mandrel; U.S. Pat. No. 4,296,952 which teaches a simple rotary joint that utilizes a single anti-friction bearing with a self-aligning or floating seal; and U.S. Pat. No. 4,817,995 which teaches a rotary union that includes a seal assembly having rotating and non-rotating seal members and a compression spring maintaining them in sealing engagement.

The rotary union may have means incorporated therein to impart motion to the rotor arm. See, for example, U.S. Pat. No. 5,104,044 which teaches a hydroactuatable spinner comprising a turbine assembly to impart rotation to a spray rotor of pressures of 500–1000 p.s.i. The turbine uses impelling fluid pressure. U.S. Pat. No. 5,269,345 also teaches a device for transferring a pressure medium from a stationary first component into a second component, which is rotatably driven within the first component. The teachings of these patents are incorporated herein by reference.

In FIG. 26 an example of one rotary union that may be used with the present invention is shown in detail. The rotary union is shown to have a fixed casing 30 that has an upper end 32 with a fluid receiving opening 34. Included in this particular rotary union is an air passage 36. It is to be understood that the rotary union depicted in FIG. 26 is merely an example of one type of rotary union that can be used within the rotary spray units of the present invention. The rotary union has a cylindrical rotor 38 with an inner wall 42 that defines a fluid passage 44 and an outer wall 46. The fluid passage has an upper opening 4 for receiving the fluid and a lower opening 50 for emitting fluid. The outer wall adjacent the lower opening of the rotor is threaded for coupling with a rotor arm 16. Air emission is preferably used to impart rotation to the rotary arm. This way the rotational speed can be controlled by adjusting air pressure independently of the water pressure used for cleaning.

Figure 26A:
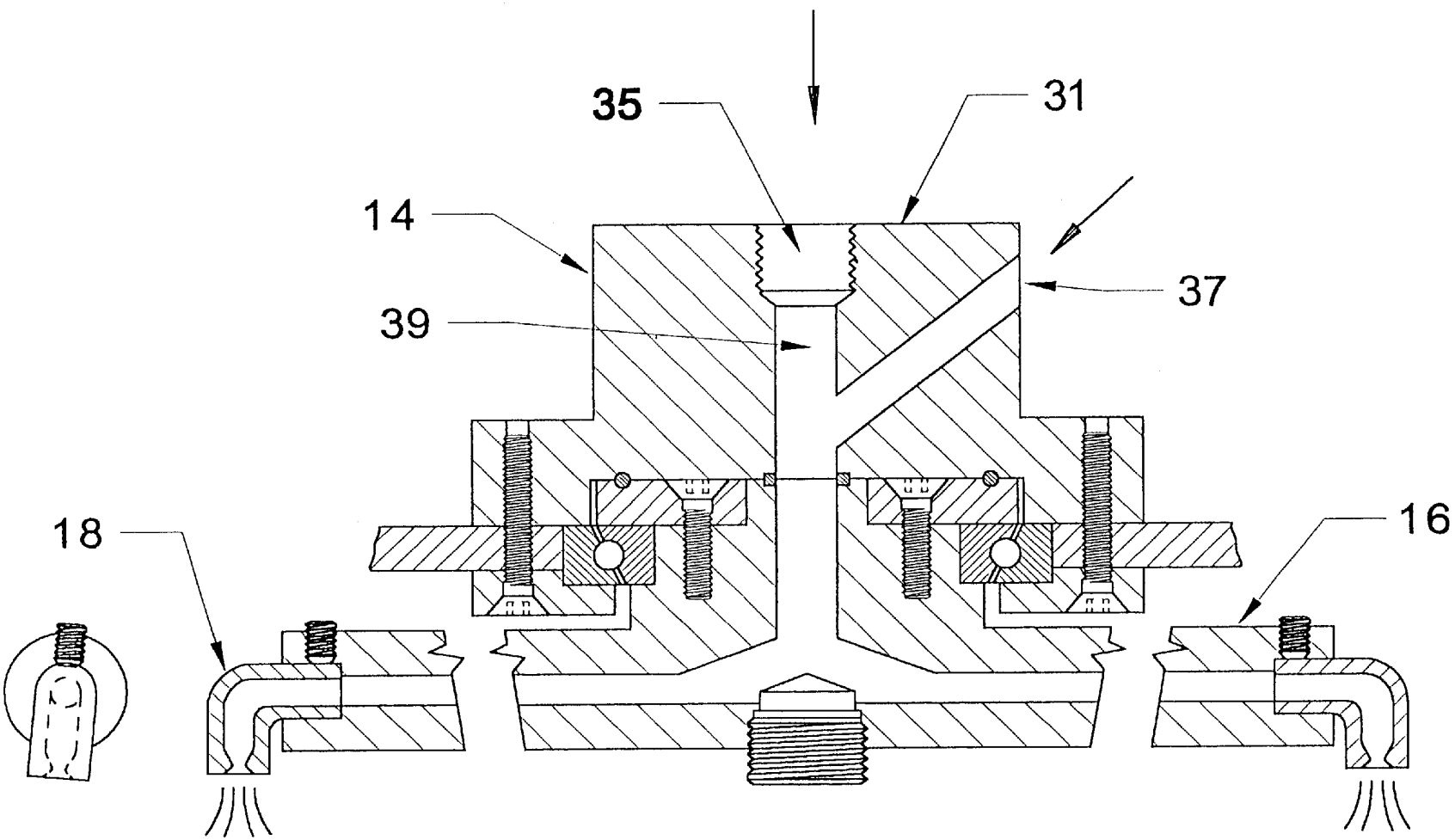
FIG. 26A is a cross-sectional view of a second embodiment of a rotary union in communication with a second embodiment of a rotary arm for use with abrasive media.

In FIG. 26A, a second embodiment of a rotary union 14 is in communication with a rotor arm. The second embodiment has a fixed casing with an upper end 31 with a fluid receiving opening 35. An air/sand passage 37 is provided and extends at an angle downwardly into a fluid passage 39. This rotary union draws air in using a Venturi effect. The pressure fluid flows by the air passage at such speed that an air and sand mixture is pulled into the air passage 37. The treating mixture has a decreased pressure as it exits into the rotor arm and out through the nozzles. The size of the nozzle opening determines the rate at which the treating mixture is releases.

Other rotary union embodiments can be used in the rotary spray units 12. Those unions are shown in FIGS. 44, 45, 52, 54, 56 and 65. These rotary unions contain impeller blades that change the direction of flow of the water and impart a rotary motion to the rotor arms. A discussion on these other rotary union embodiments is contained in the section on alternative surface treating means.

Rotor Arm

Figure 24:
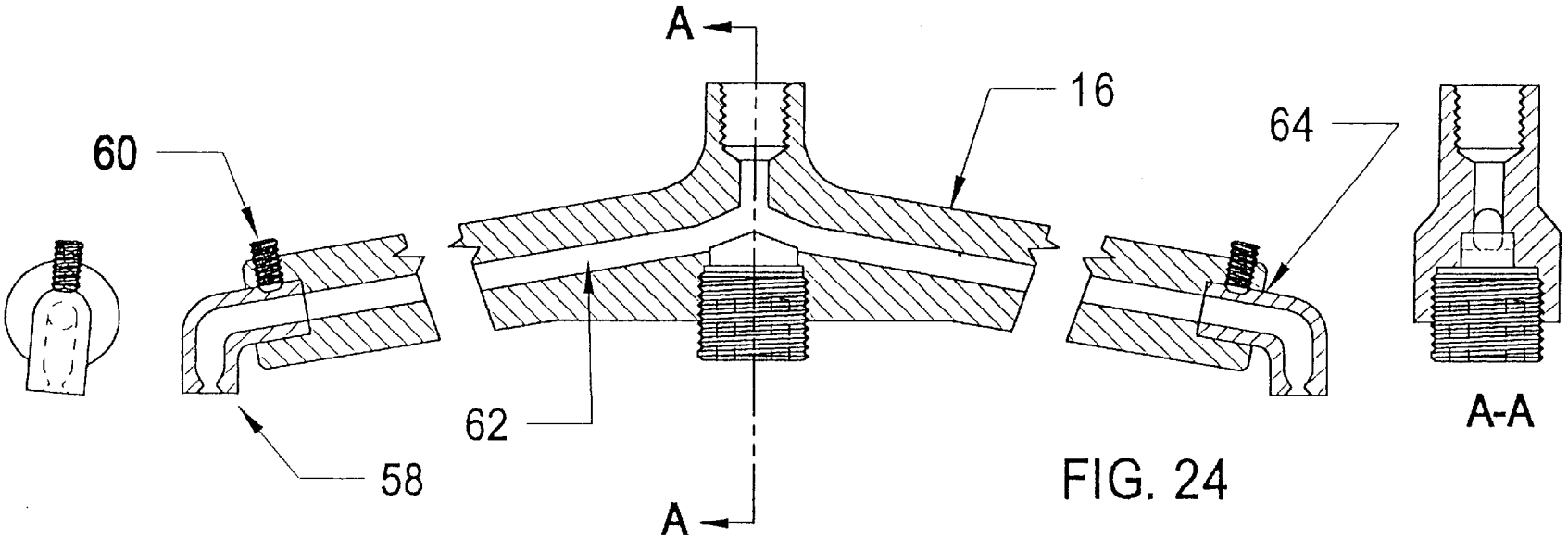
FIG. 24 is a longitudinal cross-sectional view of the rotor arm of the present invention with a further alternative nozzle adjustment means. For abrasive mixture, replaceable wear parts and abrasive resistance liner.
Figure 25:
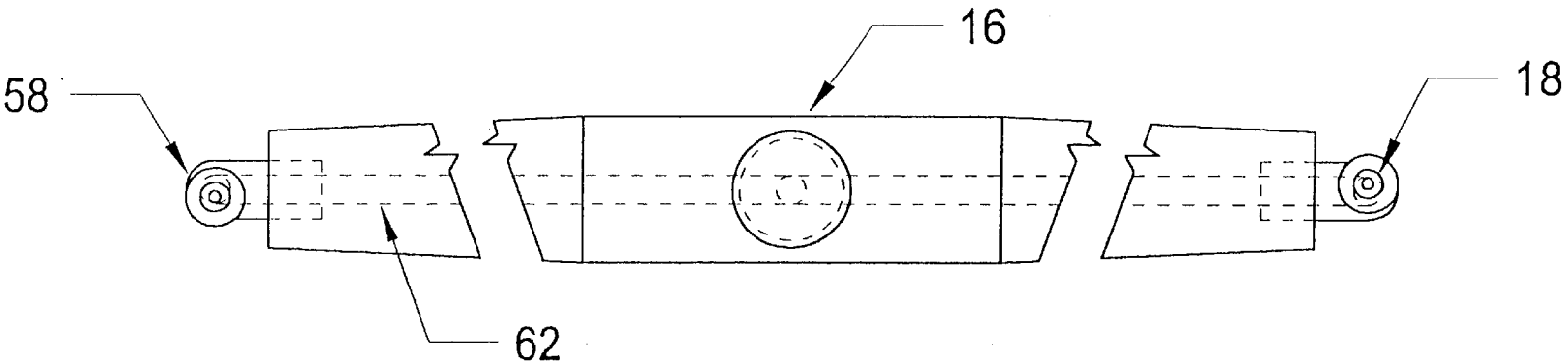
FIG. 25 is a bottom view of the rotor arm and the nozzle of FIG. 24.

Rotor arms simply radially distance spray nozzles from the rotary union, as conventional. FIGS. 24 and 25 show one form of a rotor arm 16 used with the rotary spray units of the present invention. At least one, but preferably two or more, spray arms extend laterally from the rotary union. The spray arms serve as a conduit for communication of high pressure fluid from the rotary union to the spray nozzles. In the preferred embodiment of the present invention rotor arms are used since (a) the circular path described by the rotating nozzles is a function of the length of the rotor arms, and (b) spray nozzles must be aimed directly at the surface being treated, and if the spray nozzles are far from the axis of rotation of the rotary union, rotor arms are needed to connect the nozzles and rotary union.

Figures 21, 22, 23:
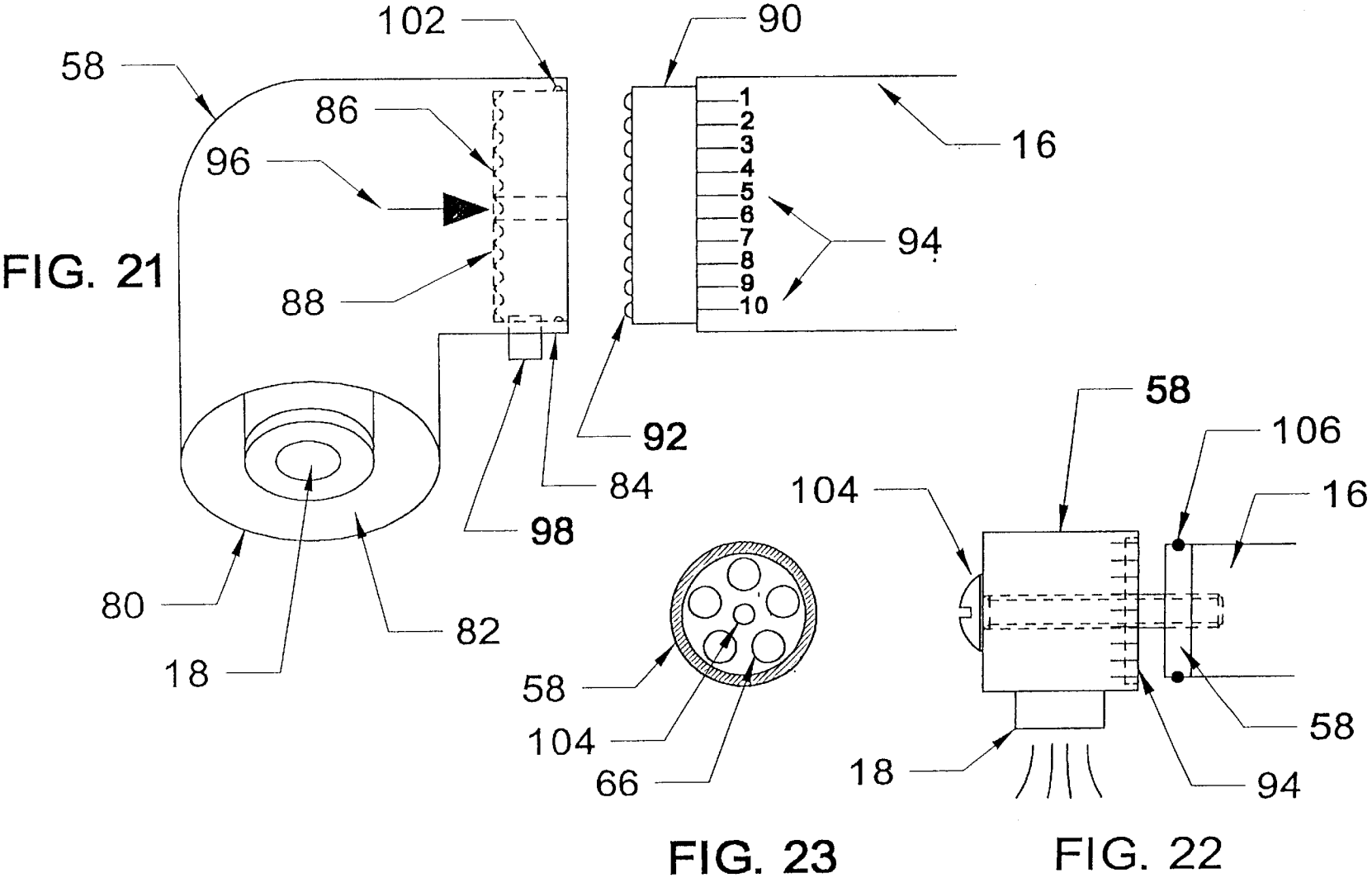
FIG. 21 is an exploded view of a first nozzle adjustment means showing a positionable nozzle and a rotary arm.
FIG. 22 is an exploded view of a second nozzle adjustment means showing a rotatable nozzle and a rotary arm.
FIG. 23 is an end view of the rotating arm of FIG. 20. showing the threaded center hole for receiving the screw.

The rotor arms can be provided with distal end pipe threads 56, as depicted in FIG. 26 for receiving a nozzle 18 with exterior threading, as preferred for abrasive wear replacement and/or flow adjustment. FIG. 24 shows a rotor arm that has a nozzle arm 58 held within with a set screw 60. The rotor arms of FIGS. 24–26 each have a single channel 62 for receiving the high pressure fluid from the rotary union. In most instances the single channel defines an end opening 64 that provides a single path for fluid to flow into the nozzle end for release of the fluid. FIG. 23 shows the end of a rotor arm as having a plurality of openings 66. Actually, the central opening is a threaded hole for receiving the screw which holds on the adjustable nozzle. In FIG. 23, the single channel of the rotor arm directs the high pressure fluid to be released through the plurality of fluid release openings.

Figure 27:
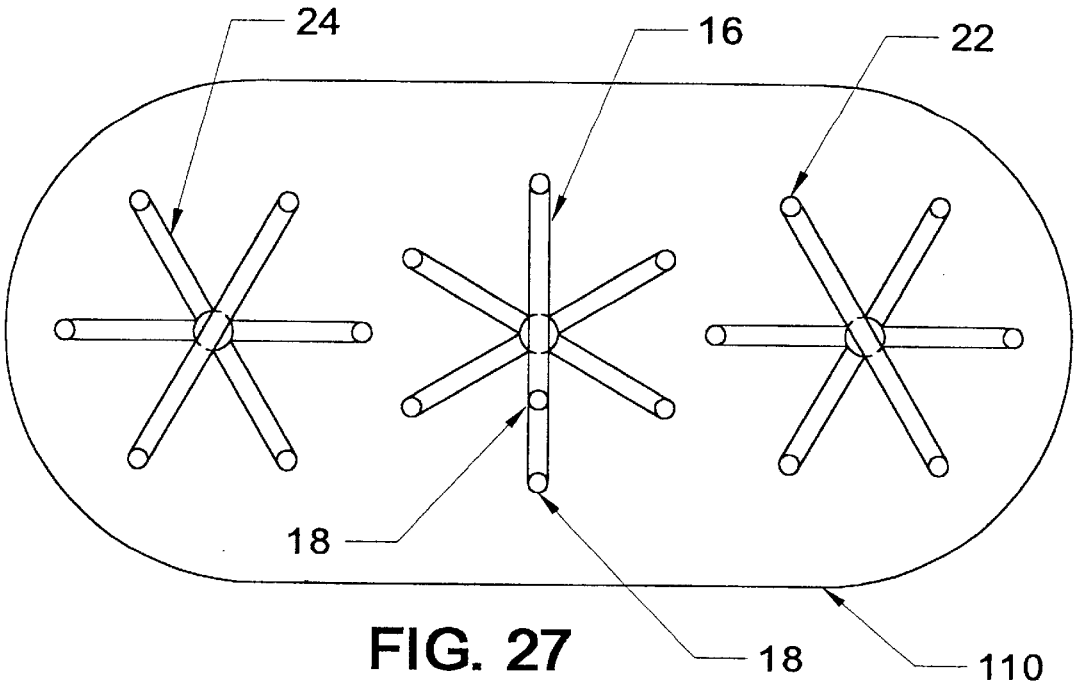
FIG. 27 is a bottom view of a surface treating apparatus 3 rotary spray units surrounded by a housing.
Figure 28:
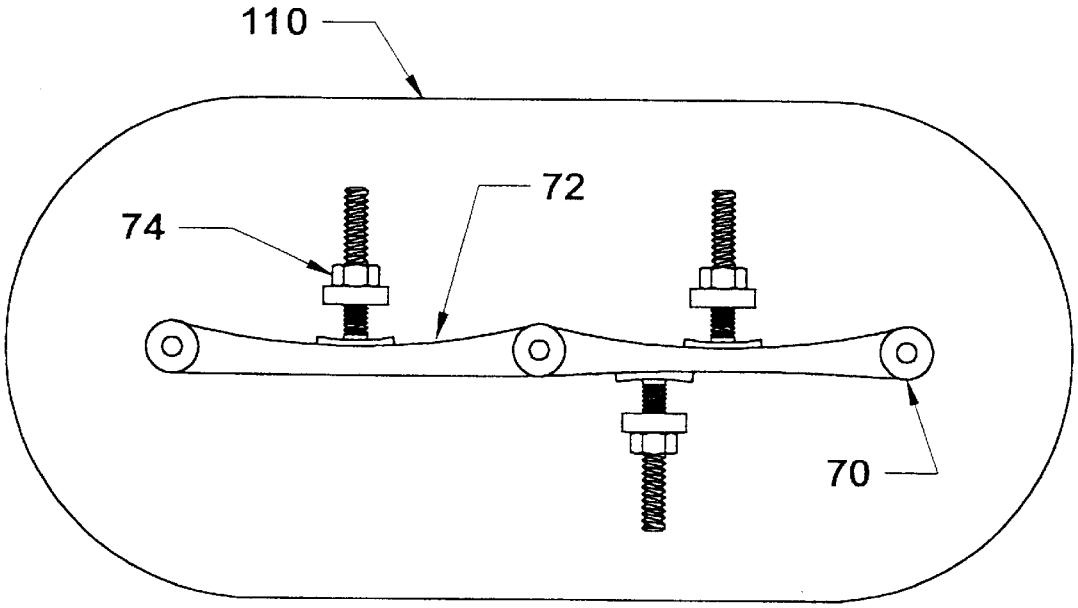
FIG. 28 is a top view of the surface treating apparatus of FIG. 27 with rotary spray units removed, showing belt driven timing mechanism controlling the movement of the rotary spray units of FIG. 27.

FIG. 27 shows rotor arms 16 of which the paths of rotational travel overlap, for use in one communal housing. The rotation of the rotor arms requires synchronization to prevent collision of the rotor arm tips during rotation. A rotating head that has sprocket members 70 is used to synchronize rotation, which are controlled by a chain 72 or similar rotation support device. FIG. 28 depicts the means for controlling the synchronized movement. The chain or rotation support device is held in communication with the sprocket members by a tightener 74. The tigteners are useful to increase tension and the chain or rotation support devices upon wearing. The longer rotor arms are less expensive versions of the present invention that allow for fewer rotator arms. Also, the longer arms allow for the addition of a greater number of nozzles in communication with the rotor arm, as shown in FIGS. 60–64.

Preferably the combination rotary union and nozzle are used to cause the rotor arm to rotate within the housing. The rotary spray arm is caused to rotate and to achieve rotational cleaning in a rotational direction opposite from the water jet impingement angle.

Nozzle

Nozzle 18 design is well known in the industry, and any of the commercially used nozzles may be employed in the present invention.

However, in the case of using a mixture of solid and fluid abrasives, it is preferred that the nozzle be designed to be highly resistant to abrasives. Further, the nozzle design will allow it to be placed in communication with the rotor arm though any known coupling means currently in use. The nozzle may be designed with threaded interiors 78, for direct coupling with the rotor arm as shown in FIG. 26. The nozzle may slide into the end opening, defined by the rotor arm channel, and held in position by a set screw. The nozzle may be prefabricated to include a nozzle arm 58 for coupling with the rotor arm, as depicted in FIGS. 21 and 22.

The nozzle may be connected to the rotor arm so as to be aimed directly at the surface to be treated. Alternatively, the nozzle may be oriented at a slight angle in relation to the rotational axis of the rotary union, such that the rotary spray arm rotates rapidly in a rotational direction opposite from the impingement angle as a result of reactionary and ground effects of fluid escaping under pressure from the spray nozzle. In the preferred embodiment of the present invention the angle of the nozzle may be controlled by the user.

FIGS. 21 and 22 depict nozzles where the user may control the angles of material projection. The nozzles of FIGS. 21 and 22 are imbedded within a nozzle arm. In FIG. 21 the nozzle arm is "J" shaped. At a first end 80 the nozzle projects outwardly from the end face 82. At the second end 84 the nozzle arm has a female receiver 86 with female ratchet members 88 within. This nozzle designed is for use with a rotor arm that has a male receiver 90 and male ratchet members 92 projecting outward. The female ratchet members of the nozzle arm can rotatably engage the male ratchet members of the rotor arm. Etched on the exterior wall of the rotor arm, adjacent the male ratchet members, is a series of hash marks 94 with corresponding numbers. Etched on the exterior wall of the nozzle arm, adjacent the second end, is a marking 96 for use in aligning the male and female ratchet members when setting the nozzle angle. The numeric etchings assist the user in calculating the RPM of the nozzle. This will assist the user in establishing the best fluid pressure to do the cleaning or painting of the surface. The nozzle arm is locked within the rotor arm by a set screw 98 and a retaining ring 102.

In FIG. 22, the nozzle arm has more of a "T" shape with the nozzle forming the leg of the "T". This is merely a different embodiment for performing the same function of FIG. 21. With this design the end of the rotor arm is coupled to the nozzle arm with a screw 104 that extends through the nozzle arm and into the rotor arm. An "O" ring 106 prevents leakage. The screw is unscrewed from the rotor arm for adjustment of the nozzle arm to preset the angle of the nozzle prior to fluid release. The etched hash marks and corresponding numbers are on the nozzle arm.

Figure 79:
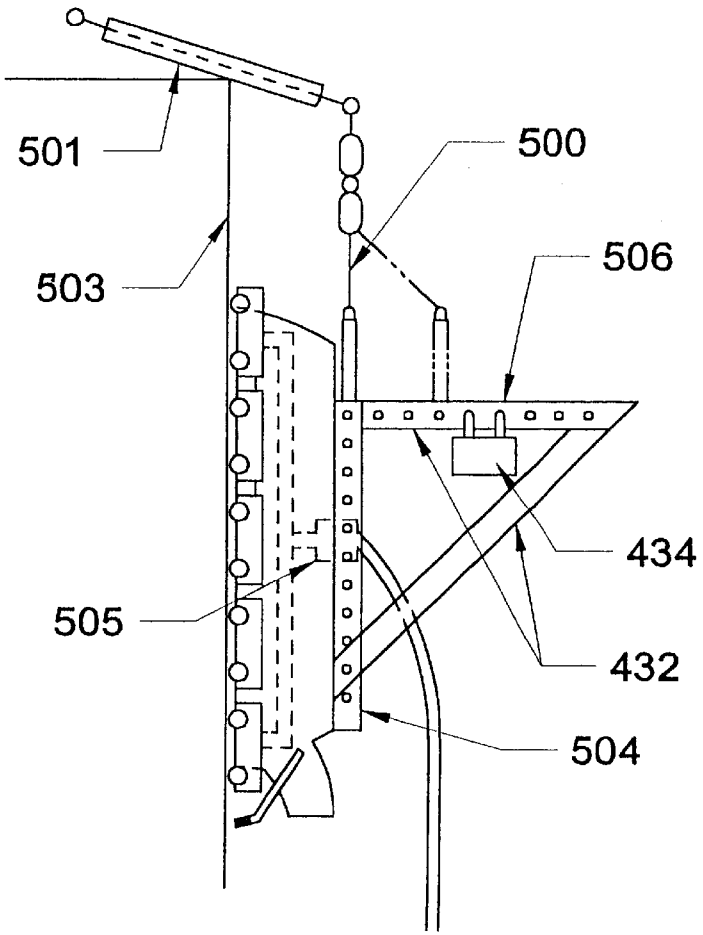
FIG. 79 is a side view of FIG. 78.
Figure 78:
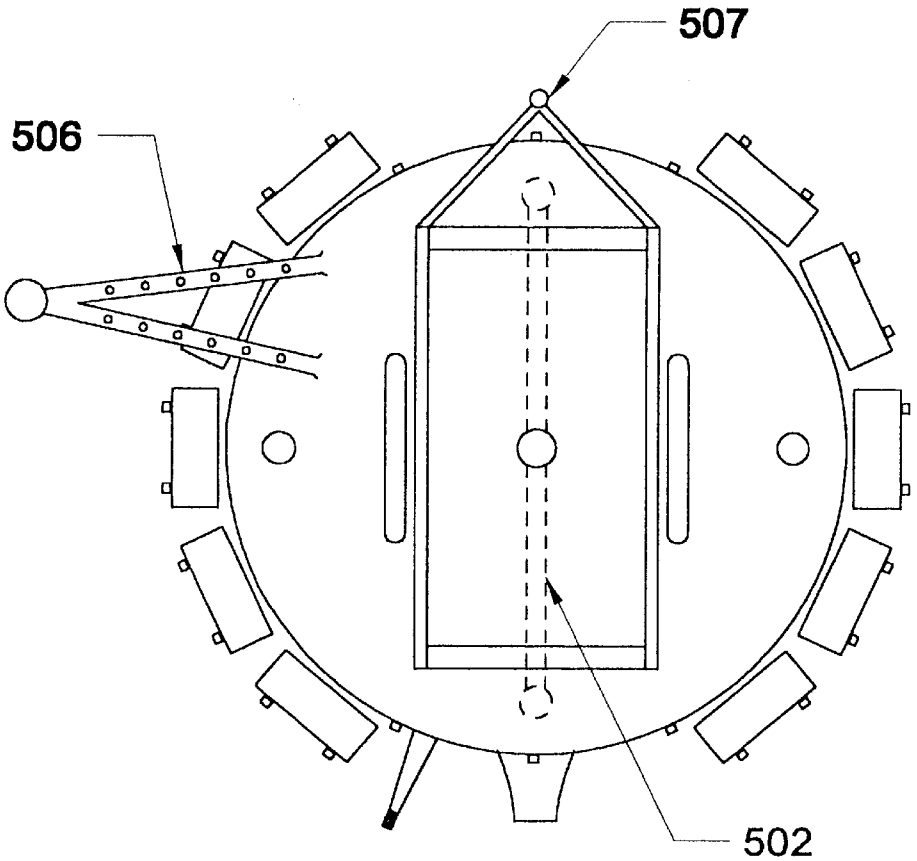
FIG. 78 is a top view of an individual rotary spray unit suspended from a cable and supported by a frame structure, with enclosure housing and drainage conduit, and with cable leverage, magnetic and/or outrigger stabilization means.

Furthermore, in FIGS. 78 and 79 an individual (single) rotating nozzle system 502 for cleaning a ship hull 503, buildings, storage tanks, etc. is shown. The frame 504 to which the rotary union 505 is attached is suspended by means of a frame structure 432. Also, the frame structure includes receptacles for positioning weights 434 for the purpose of providing a cantilever biasing system, which enables or assists in the rotary spray units to be positioned against the surface being cleaned. A counterweight 434 is added with whatever weight is necessary for biasing the rotary units against the structure, or magnets, cables, outrigger wheels, etc., are used for biasing and providing stability, and these are adjusted as necessary by inserting pins through bore-holes 506 in elements of the frame structures. A cable 500 or steel frame that is attached to a metal lifting ring 507 supports the entire frame structure. Any number of means suspends the entire device from a roof or deck. The device is suspended with the ability to be raised and lowered by a variety of means such as a rope grab device. For example, an operator may pull the device around the circumference of the tank on the ground by moving rope.

Alternatively, turbine, impeller, or propeller means may be incorporated in the rotary junction unit so that motion is imparted to the rotary arm by fluid passing through the rotary junction unit. Further yet, hydraulic, pneumatic or electric motor means may be used to power the rotation of the rotary spray unit. Any parts (ball bearings, seals, etc.) not shown in FIGS. 44–46, 49, 52, 54, 56 and 66 can be found in FIGS. 26 and 65.

Housing

The high pressure surface treating apparatus of the present invention preferably comprises at least one housing 110 which surrounds all rotary spray units 12 and defines one collective enclosed work space. Alternatively, the high pressure surface treating apparatus may comprise a plurality of separate 20 and a communal housing 110 associated with each rotary spray unit. FIGS. 1–20 and 27–34 depict the various housings associated with the rotary spray units. The purpose of the housing is to prevent environmental release of materials removed from the surface being treated, such as rust or anti-fouling paint, which may contain toxins. Thus, the housing is that part of the high pressure surface treating apparatus added to the apparatus to result in the defining and maintaining of an enclosed space between the apparatus and surface being treated. Vacuum systems as well as water or sand treatment and purification systems are known and can easily be connected to the housing of the surface treating unit of the present invention.

The term "housing" as used herein means the parts which are added to the apparatus to define an enclosed space between the high pressure surface treating apparatus and the surface being treated, i.e., all parts other than the framework or backboard panels to which the rotary spray units are connected, which may themselves form part of the enclosure. Thus, the space in which the rotary union is confined may be defined in part by the backboard panel and in part by a skirt which may be provided around each individual rotary spray unit or which may be provided around the periphery of the framework or hinged panels. In such a case, the term "housing" as used herein means the skirt, the additional element, which must be provided to provide an enclosed space between the framework or backboard panels and the surface being treated.

The skirt part can be made of various materials, including metal strips, sheets of fiber reinforced flexible rubber, or elastomeric filaments forming a brush, and depending upon the skirt, can include seals. A seal 112 could be overlapping, flexible rubber sheets, or wire or fiberglass filaments, or an inflated rubber bladder. FIGS. 4, 7, 31 and 32 depict a few of the seals that may be used. Further yet, the seal system could be comprised of one or multiple inflatable tubes, such as a truck inner tube. The inflated tube provides for a good seal, and the hydraulic fluids provide for good lubrication of the seal as it passes over the surface being treated.

Figure 16:
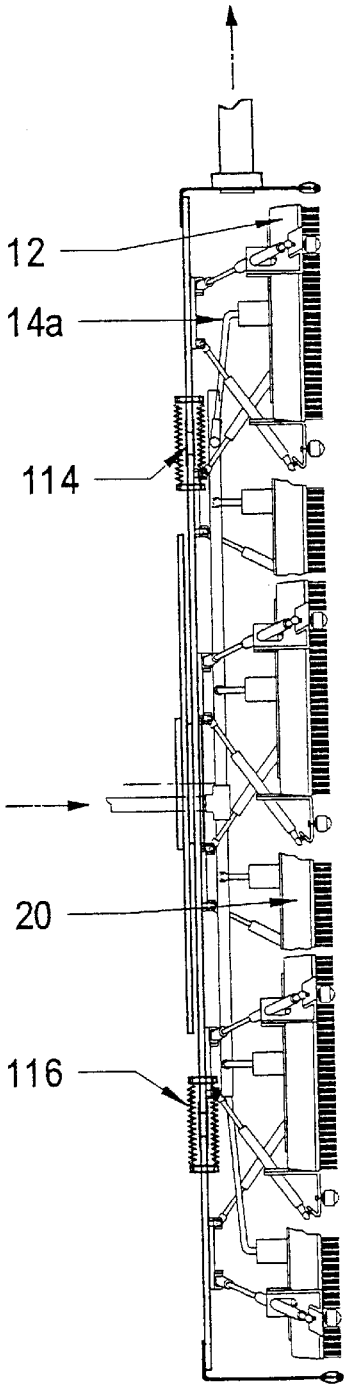
FIG. 16 is a side view of FIG. 15 showing that each rotary spray unit has a housing and the treatment fluid supply hose.
Figure 17:
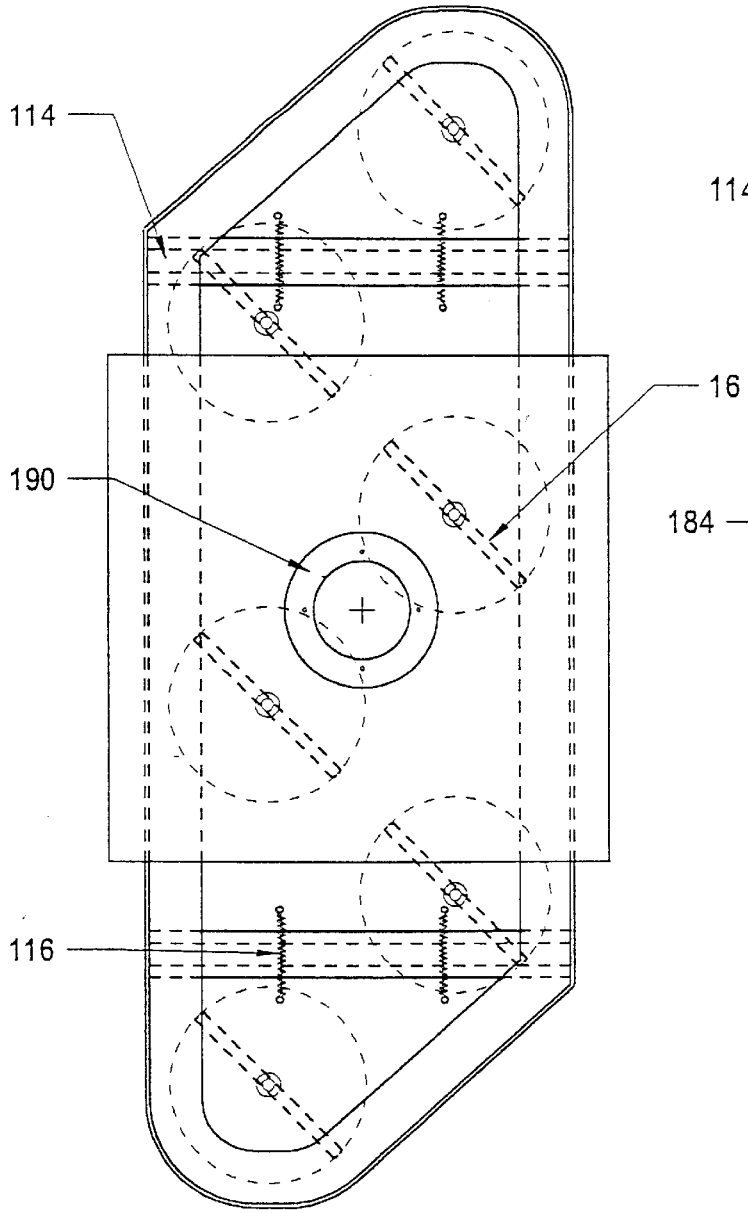
FIG. 17 is a top view of a primary housing coupled with a backbone plate.

As best illustrated in FIGS. 15–18 and 31–32 the individual housing/primary housing that is associated with the rotary spray unit may come in two general designs. This individual housing may be called gang housing because it is designed to shroud a plurality of rotary spray units 12. The plurality of spray units housed within the gang housing may have separate housing 20 or have the gang housing as the only housing. FIG. 17 shows gang housing as the only housing. In one design of the individual housing the upper member of the individual housing is hinged 114 and has springs 116, as shown in FIGS. 15–18. The hinged portion and the springs allow the individual housing to response with a flexing action to changes in the surface as the rotary spray units move along the surface being treated.

Figure 19:
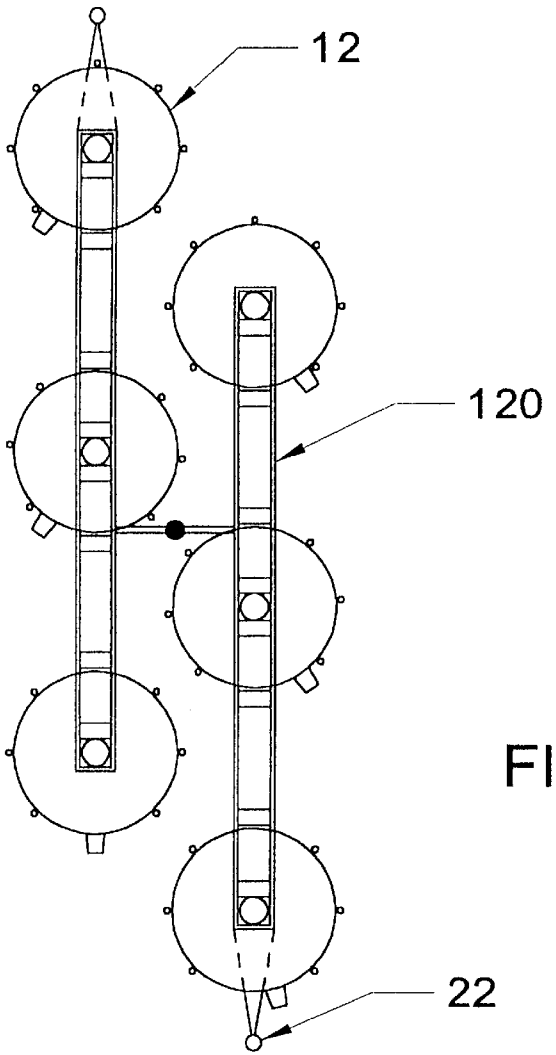
FIG. 19 is a top sectional view of a pair of elongated flexible support members for supporting in series a plurality of rotary spray unit housing about a backbone and showing that one end of each of the elongated flexible support members has a positioning means.

In FIG. 19 the primary housing has an additional pair of elongated flexible support members 120 for supporting a plurality of rotary spray units. These elongated support members extend linearly and are in parallel planes. Each elongated support member has a series of individual rotary spray units 12 with separate housing 20 aligned along a linear path. The alignment of the pair of elongated flexible supports is staggered so to allow the rotary spray units, of each flexible support member, to be spaced in an alternating manner. Further, each support member has at least one secondary positioning means 22.

Figure 31:
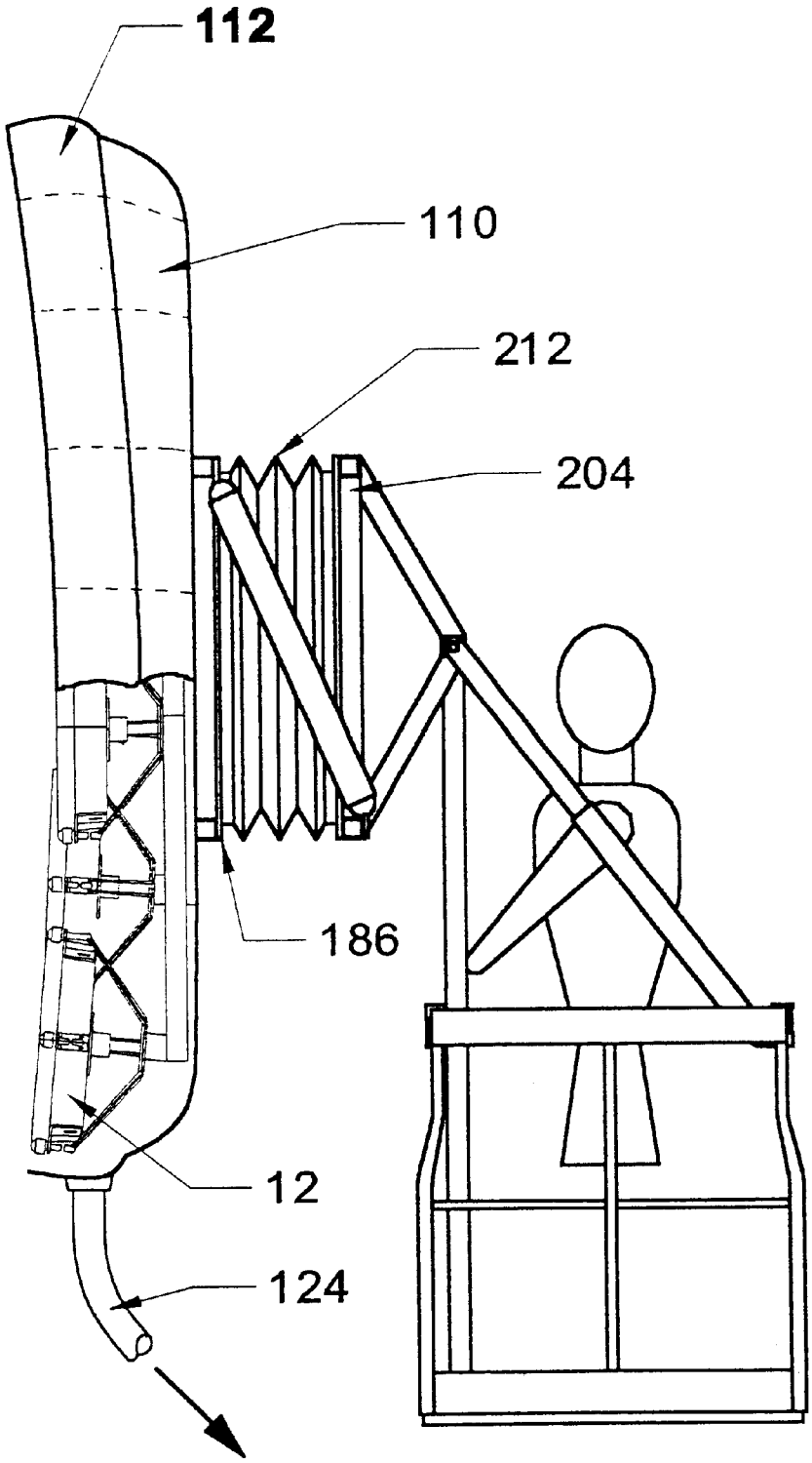
FIG. 31 is a side view of an alternative embodiment of the apparatus for pressure treating a surface constructed with multiple self-contained rotary spray units, a primary housing enclosing the multiple rotary spray units, and a bladder for flexibly positioning of the framework, supported on a work platform.
Figure 32:
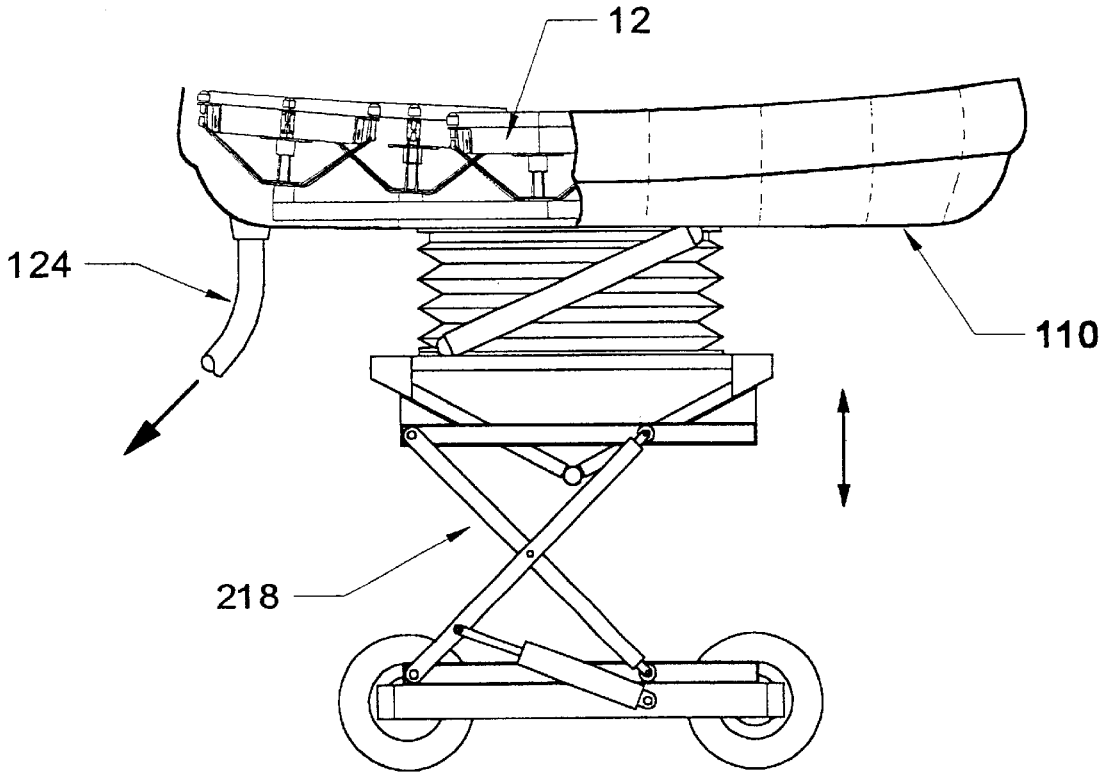
FIG. 32 is side view of the embodiment of FIG. 30 but mounted on a trolley with lift means for cleaning the under-side of a structure and with the bladder in communication with the hoist.

In a second design of the individual housing the frame member is non-flexing, as shown in FIGS. 31 and 32. In each design of the individual housing there is a conduit 124 for suctioning off environmentally hazardous material resulting from the treatment of the surface by the rotary spray units. Further, the individual housings that have hinged upper members include varying secondary positioning means 22 and secondary resilient rotary spray unit positioning means 24.

Figure 76:
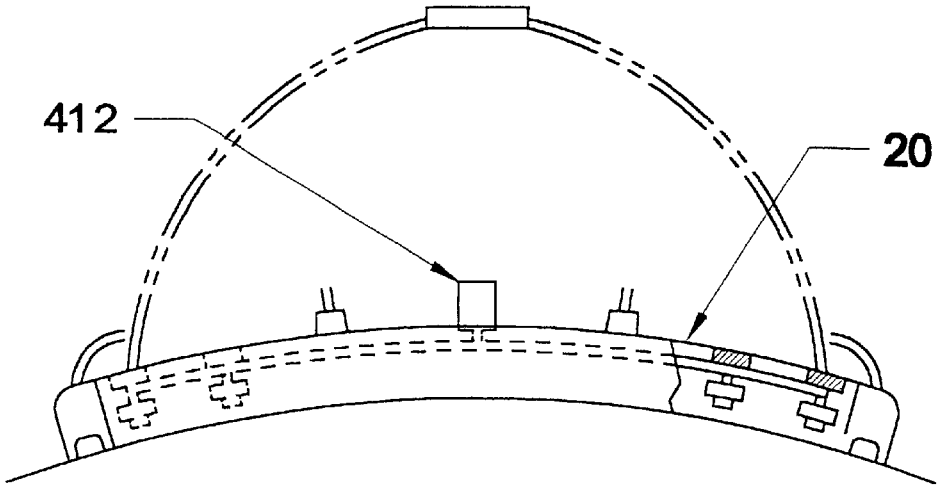
FIG. 76 is a side view of the "rubber leach" housing embodiment of the present invention.

A third design of the housing, as depicted in FIG. 76, could be in any diameter, even as wide as 20 feet, and is preferably supported against collapse by an internal helical spring. This housing would embody a rotary spray unit structure that could be maneuvered over the surface by means previously described in other embodiments, or by means of a servo drive system, or any other appropriating method. The housing is made of a flexible rubber or other acceptable material with a properly sized high pressure swivel bearing 412 and attached to that swivel would be high pressure hoses that would permit the flexing of the rotating hoses as opposed to the previous embodiments that used a rigid metal rotor arm 16. This would be required as housing 20 flexes in a multitude of configurations to conform to the shape of an uneven surface such as the hull of a ship or a storage tank. This embodiment is provided with two vacuums—one establishing an inner vacuum and one establishing an outer vacuum, and replaceable wear pads.

Figure 5:
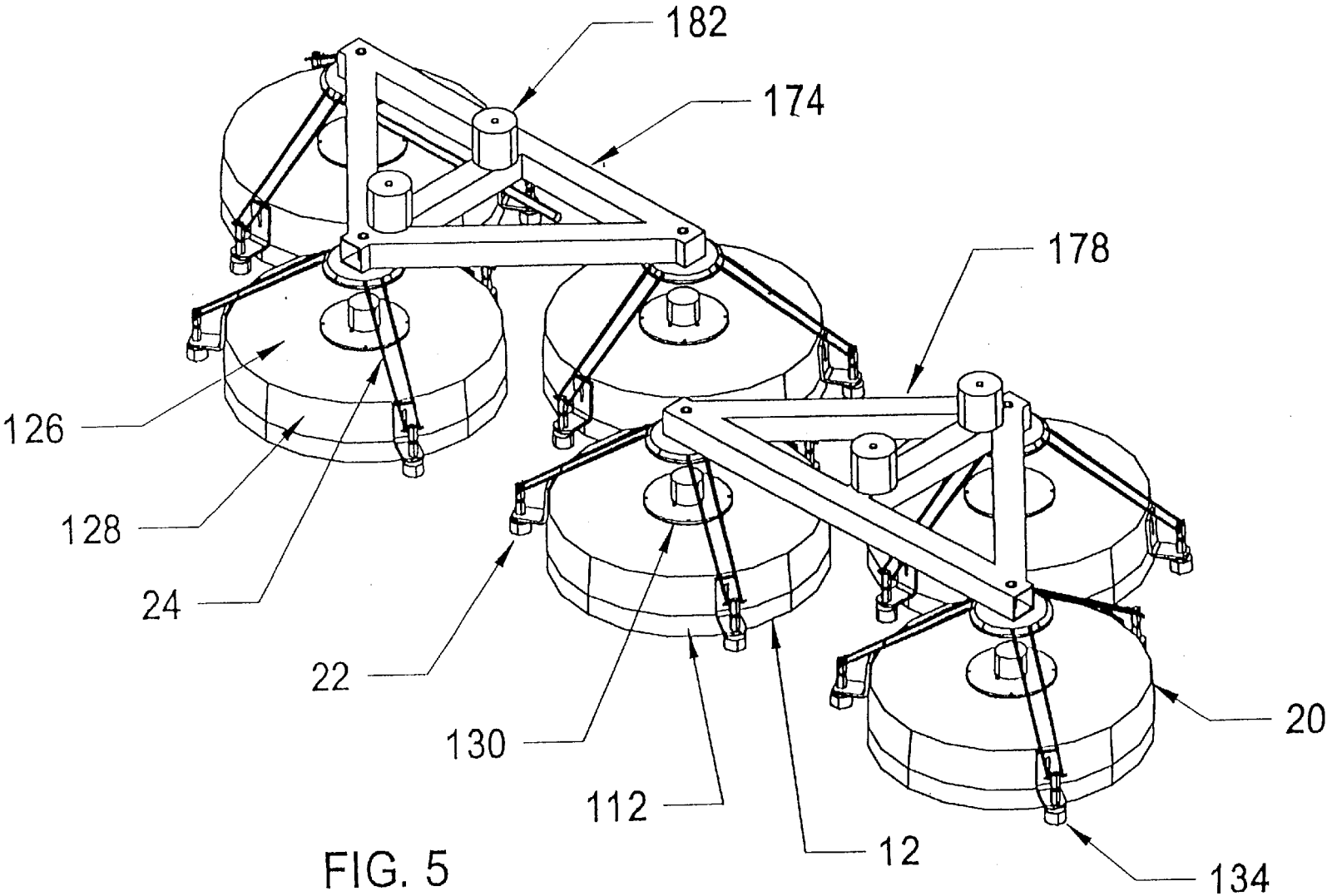
FIG. 5 illustrates two sets of three rotary spray units in communication with two frame members.

The individual housing associated with each rotary spray unit comes in one general design with varying means for positioning the housing and rotary spray device the optimal distance from the surface either attached or incorporated therein. The individual housing has an upper (outer) face 126 with a peripheral sidewall 128 as shown in FIG. 5. The rotor union may be mounted directly to the upper face or a mounting plate 130 attached to the upper face. In most designs of the present invention the secondary positioning means is mounted to the peripheral sidewall. In all forms of the present invention the secondary resilient means is coupled with a positioning means mount for translation of movement to the framework. The separate housing shrouds, the rotor arm and nozzle are shown in FIGS. 7,9,11,17 and 18. The interior wall of the separate housing is designed to be highly resistant to abrasive material either being used as the surface treatment or material being removed from the surface of the object whose surface is being treated. Preferably, the abrasion resistant coatings or materials used in the housing will include silicon carbide or re-coatable rubber.

Rotary Spray Unit Positioning Means

For optimal surface treatment effectiveness it is necessary to maintain the spray jets of the rotary spray units in a precisely spaced relationship to the surface being treated, even as the high pressure surface treating apparatus passes over curved surfaces or discontinuities. This can be accomplished by using mechanical feedback a rotary spray unit positioning means surface sensor 22. The rotary spray unit positioning means surface sensor serves as (a) sensing means for sensing changes in relative position of the surface being treated, (b) feedback means for communicating this positional information to the rotary spray unit, and (c) means for resiliently connecting the rotary spray unit to the framework to permit the rotary spray unit to be positioned in accordance with the sensed changes in relative position. This feedback and positioning can be accomplished electronically or mechanically, but for simplicity, low cost, and reliability, mechanical positioning means are preferred.

Thus, in the case that each rotary spray unit is provided with a housing, the rotary spray unit positioning means can be integrated into or mounted on the housing, or can be a completely separate element from the housing.

The sensor 134, as shown in the FIGS. 7, 9, 11 and 12 of the present application, of the mechanical positioning means may be a caster, a sled, an abrasion resistant skid pad, or a magnet associated with wheels, or the like, in contact with the surface in proximity to the outer periphery of the spray pattern of the rotary spray nozzle. The sensor may have a rare earth magnet attached to assist in the retention of the positioning means, and indirectly the rotary spray units, against the surface to be treated. In the case of rare earth magnetic shrouded wheels, each magnet of the magnetic wheels is not in direct contact with the surface to be treated but just close enough so to allow the magnetic forces to be effective. This sensor is in direct or indirect mechanical communication with the rotary spray unit to urge repositioning of the rotary spray unit in response to the positional information communicated by the sensor. The sensor He in direct mechanical communication, in most designs, is mounted to the housing of the rotary spray unit with a positioning means mount 136 and mounting bracket 138. The sensor in direct or indirect mechanical communication with the rotary spray unit is usually in communication with the primary housing or primary housing flexible support members 120 of the type shown in FIG. 19. Also, a sensor may be placed in communication with the frame work to tell the air logic system of the primary resilient means how much the air/fluid pressure will need to change to keep the rotary spray units at a constant distance from the surface to be treated. "Air logic" is well known to those working in the machine art, as evidenced by U.S. Pat. Nos. 4,026,204; 4,098,288; 4,475,665; 4,867,617; 5,222,544; and 5,768,972, the disclosures of which are incorporated herein by reference. The same effect can be achieved hydraulically using hydraulic cylinders linked in a master/slave relationship, or by electronic means using electronic sensors and motorized positioning means. The air logic system is preferred in view of hydraulic system.

The repositioning of the rotary spray unit is thus accomplished in a simple, rugged and reliable manner, because the rotary spray unit positioning means resilient element 24 is connected at one end to the rotary spray unit (housing) and at the other end to the framework 178 and, when stressed, urges the housing and rotary unit against the surface being treated. The resilient biasing means 24 in the designs of the present invention is depicted for use when the individual housing 20 is in use. This depiction is not intended to be limiting. The resilient means can easily be used with rotary spray units of a primary/gang housing. As best illustrated in FIGS. 5–12, the resilient means is shown as having various forms. Four functional forms of the resilient means are the spring tension arms 142, "trampoline" spring mount 144, leaf springs 146 and carbon fiber semi-rigid arms 148. In three of the structures the resilient means 24 is in direct communication with the mechanical sensor.

Figure 8:
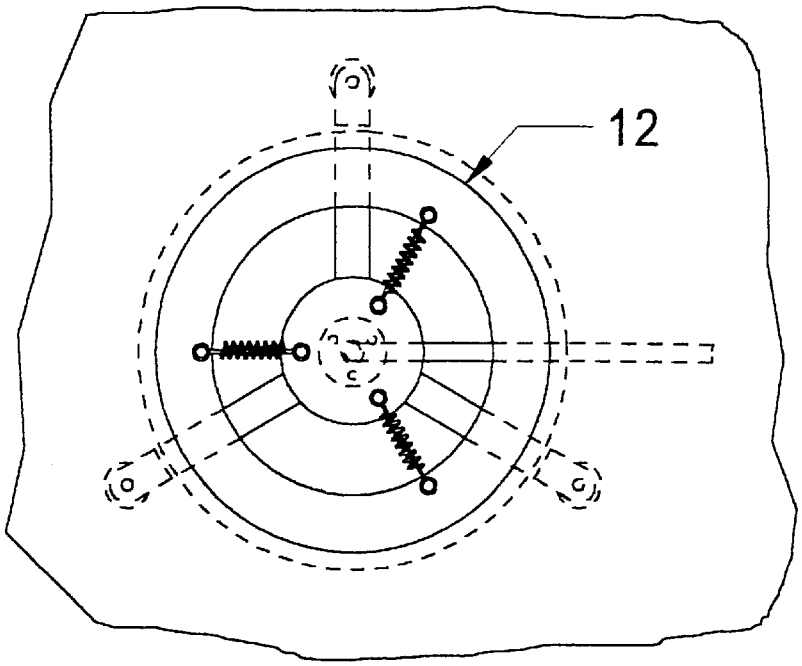
FIG. 8 is a top plan view of a second embodiment of the rotary spray units depicting resilient rotary spray unit positioning means as springs coupled with a mounting plate.
Figure 9:
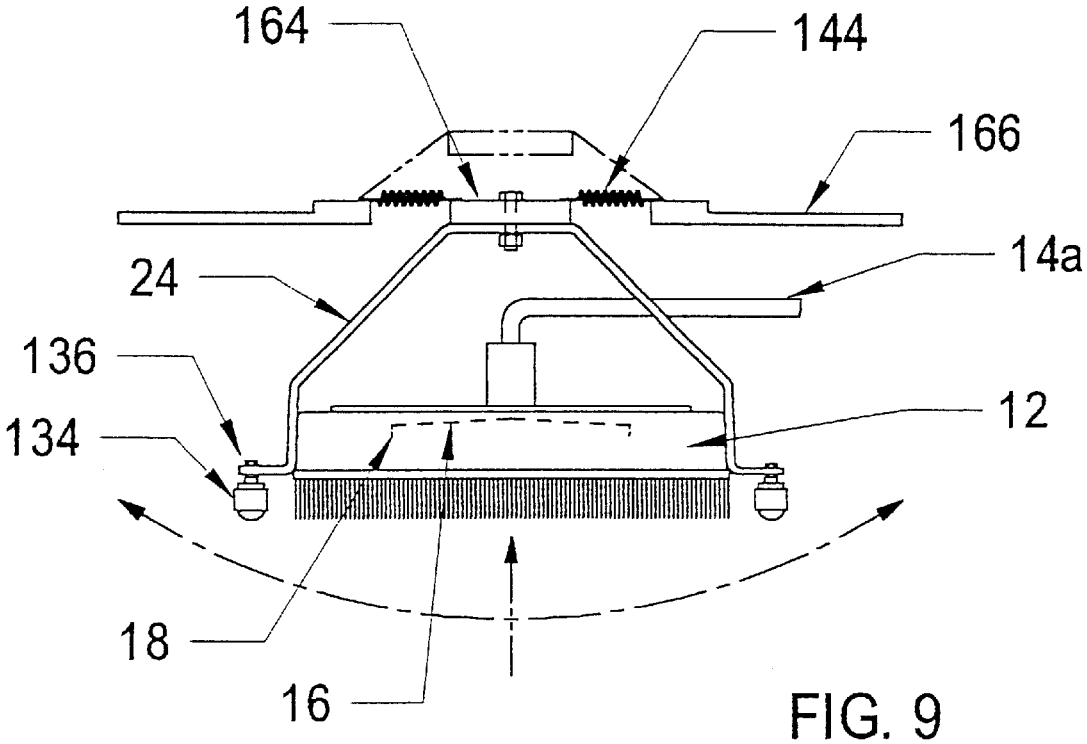
FIG. 9 is a side view of the second embodiment of FIG. 8.
Figure 10:
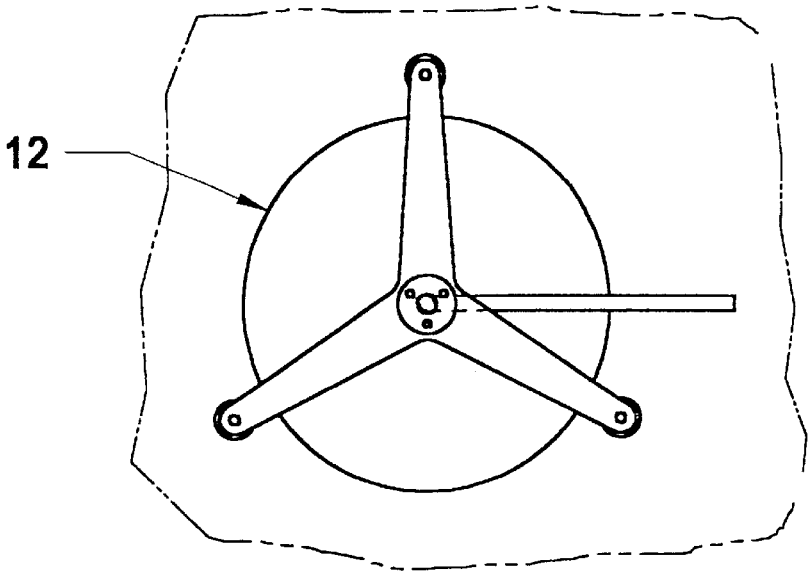
FIG. 10 is a top plan view of a third embodiment of the rotary spray units depicting the resilient rotary spray unit positioning means as a leaf spring.

The spring tension arms may be an assemblage of telescoping pipes with the piston-acting smaller pipe 152 located within a spring 154 that is in communication with the upper end 158 of the larger pipe 160, as shown in FIG. 6. Conventional shock absorbers with built in springs would function in like manner if used. As shown in FIGS. 8 and 9 pre-tensioned mounting springs 144 are provided between a mounting plate 164 and mounting brackets 166 of the framework, in the manner of a trampoline. The mounting springs will allow the rotary spray units to have more movement about the framework than the spring tension arms or leaf spring. The same "trampoline" spring arrangement can be used to simultaneously suspend multiple rotary spray units.

Figure 11:
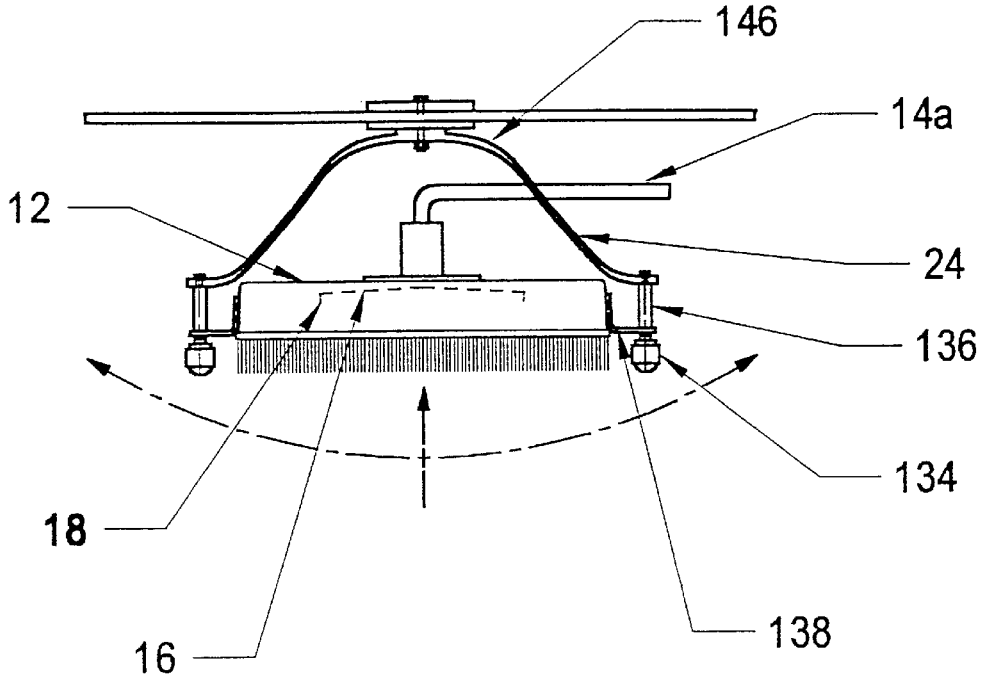
FIG. 11 is a side view of the third embodiment of FIG. 10.

Turning to the leaf spring of FIG. 11, is may be a conventional leaf spring, preferably having three or more arms, and preferably having all three arms made of a single laminated sheet of carbon fiber material. The semi-rigid arms of FIG. 12 may be formed by parallel pairs of carbon fiber rods, of the construction used in making fishing rods. The carbon fiber rods 170 are connected at one end to the framework or to a mounting plate 164 via mounting hardware 168, and at the other end to positioning means mount 136 of the sensor 134.

In operation, the position sensor shown in these figures contact-senses a rise in the surface (i.e., surface being approached by the high pressure surface treating apparatus), the sensor mechanically communicates this to the rotary spray unit. The rotary spray unit pivots in response to this communication, with the edge of the outer diameter of the spray pattern closest to the sensor pivoting away from the surface. As the position sensor is no longer deflected from normal and returns to a neutral position, this is communicated to the rotary spray unit, which is biased by the resilient means to immediately return also to the neutral position. In those instances where that the surface, being traveled over, moves away from the high pressure surface treating apparatus, the resilient connection means urges the sensor to follow the surface. As the sensor moves outward (away from the high pressure surface treating apparatus) it communicates the movement to the rotary spray unit which in turn follows the sensor and pivots with this leading edge outward.

The present invention is not particularly limited to any sensor, to any means for communication of sensor position to the rotary spray unit, or any resilient means for biasing the rotary spray unit to the neutral position. Electronic, hydraulic, and even pneumatic positioning means may be used. A number of examples of sensor, communication, and resilient position means and arrangements are provided in the figures and associated text.

Framework

The pluralities of rotary spray units of the present invention are supported by the framework 174. In some embodiments of the present invention the framework is comprised at least two frame members directly or indirectly hingedly or pivotally connected to each other. At least one rotary spray unit is resiliently connected to each frame member, either through the containment housing, through the positioning means, or by direct flexible and resilient mounting of the rotary union to the framework. As a result of the flexibility of the framework, considered in combination with the resilient connection of the rotary spray units with the framework, the rotary spray units are provided with a sufficient degree of independent relative movement to easily conform to changes in topography of the surface being treated.

Figure 13:
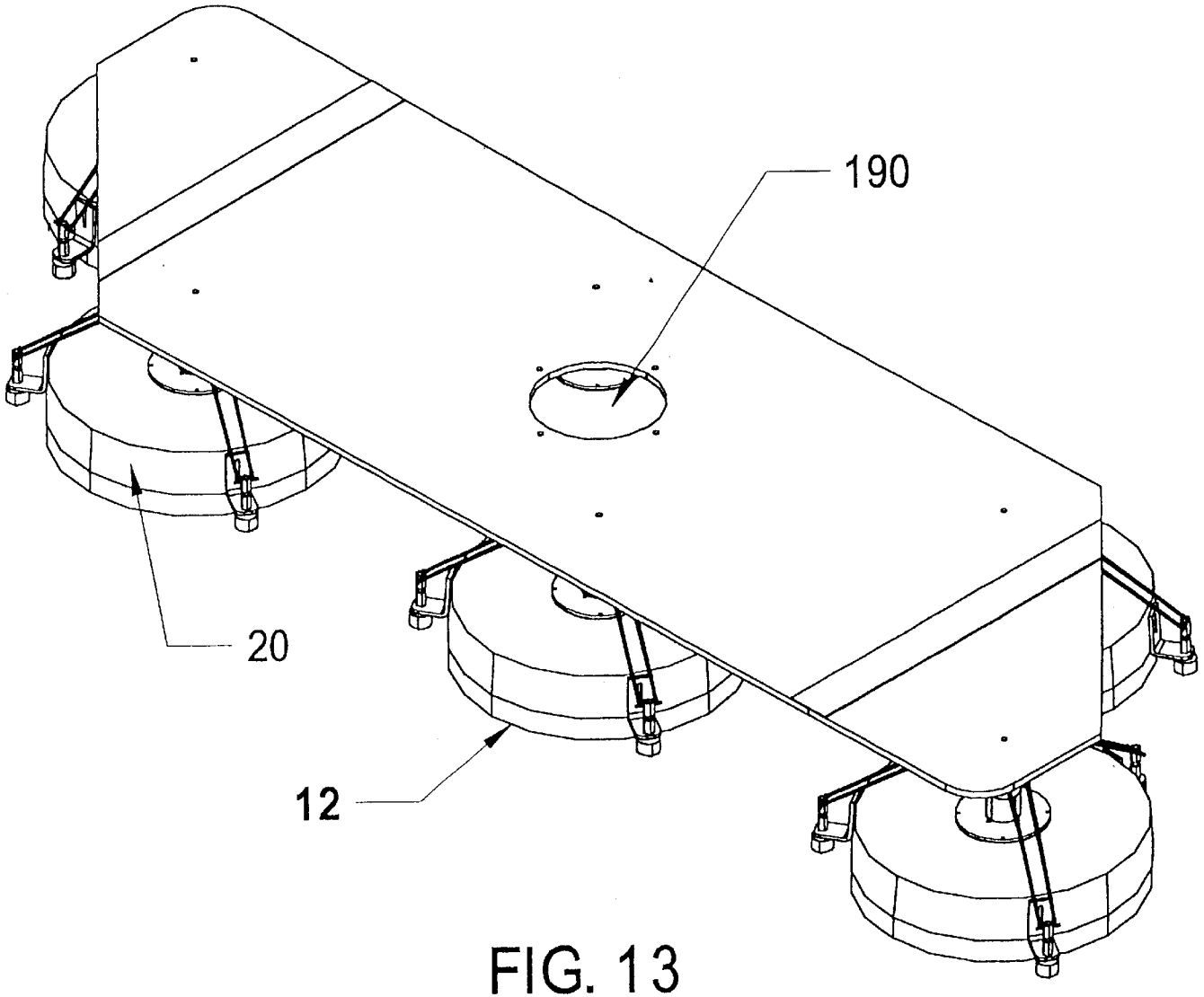
FIG. 13 is an isometric view of six rotary spray units in communication with a double-hinged planar framework.
Figure 14:
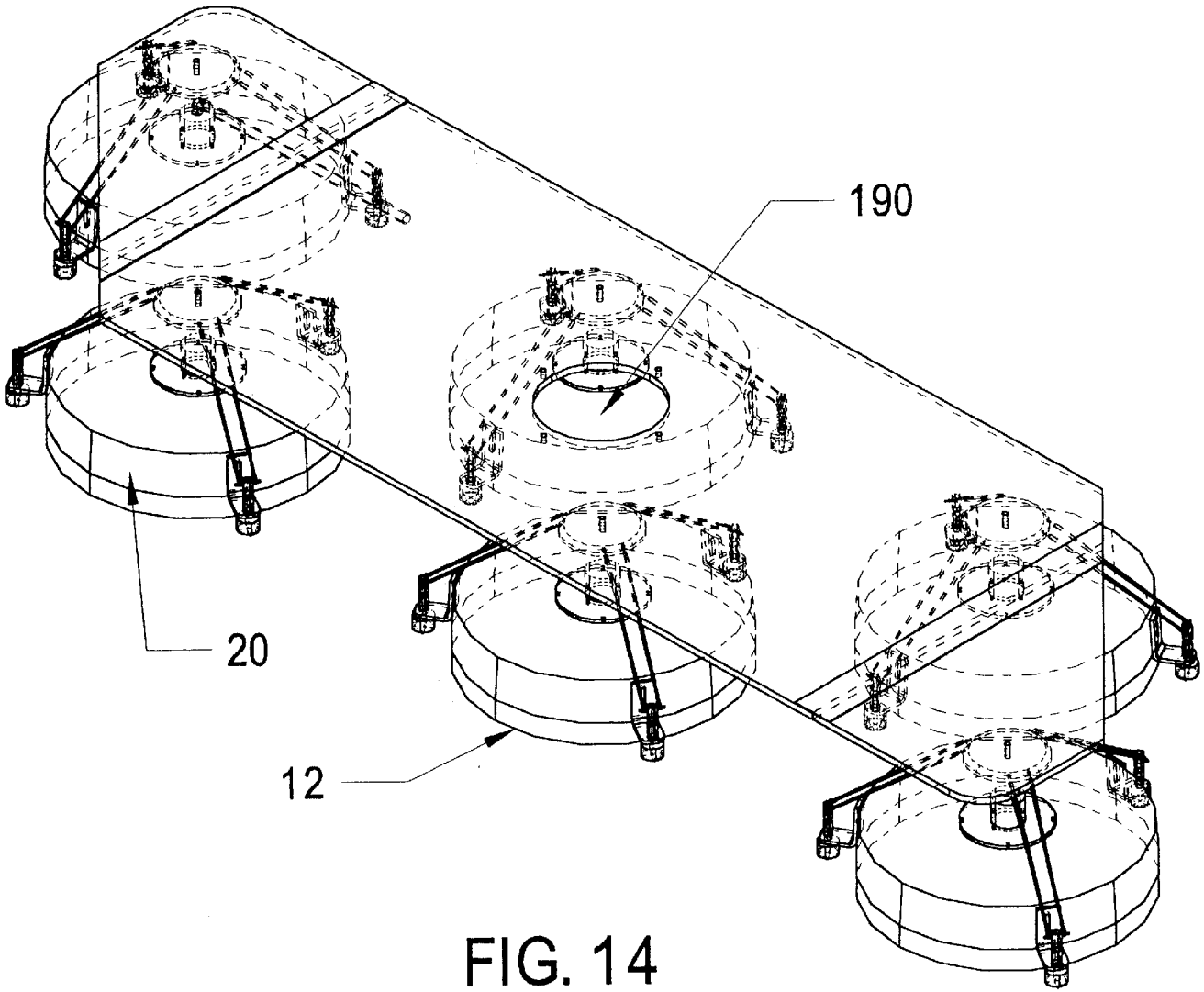
FIG. 14,is an enhanced view of FIG. 13 to show the mounting of the rotary spray units to the planar framework.
Figure 15:
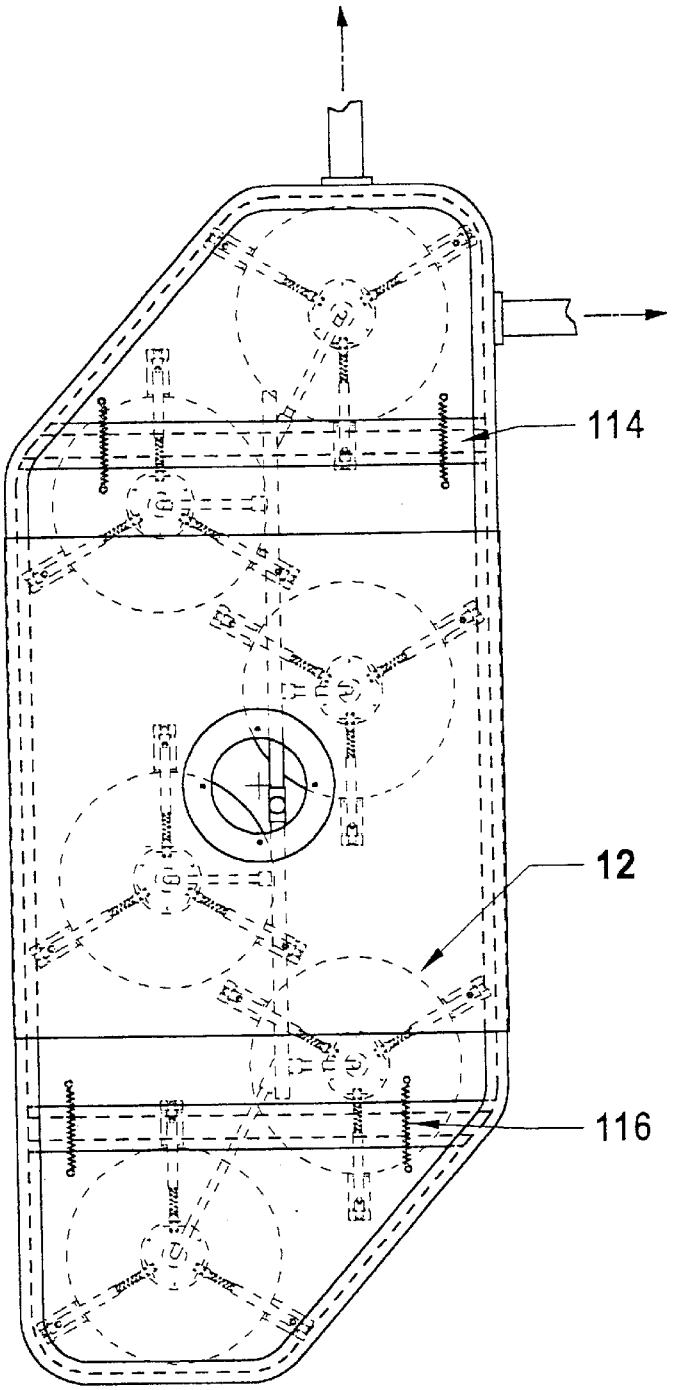
FIG. 15 is a top view of a primary housing surrounding a plurality of self-enclosed rotary spray units.
Figure 18:
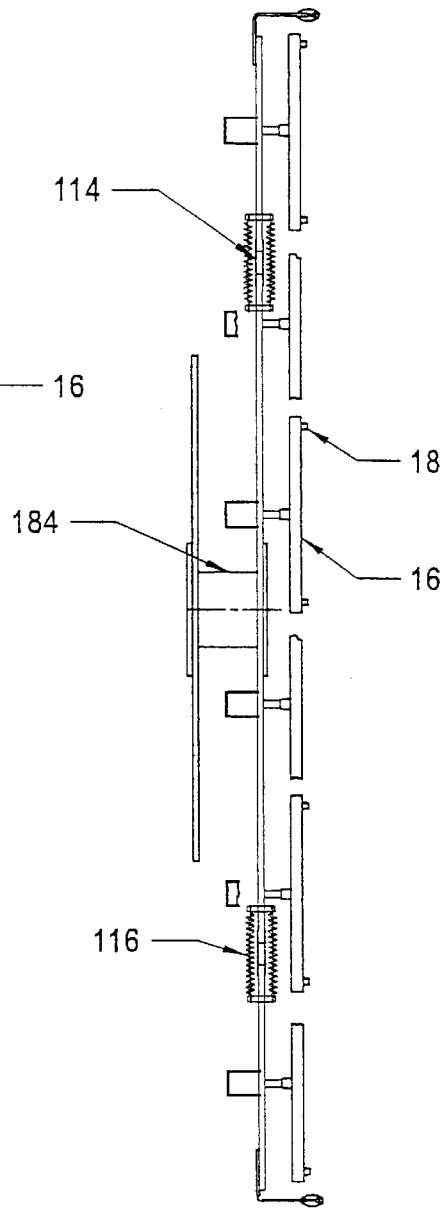
FIG. 18 is a side view of the embodiment of the primary housing of FIG. 17 showing the primary housing as the only housing for enclosing the rotary spray units.
Figure 20:
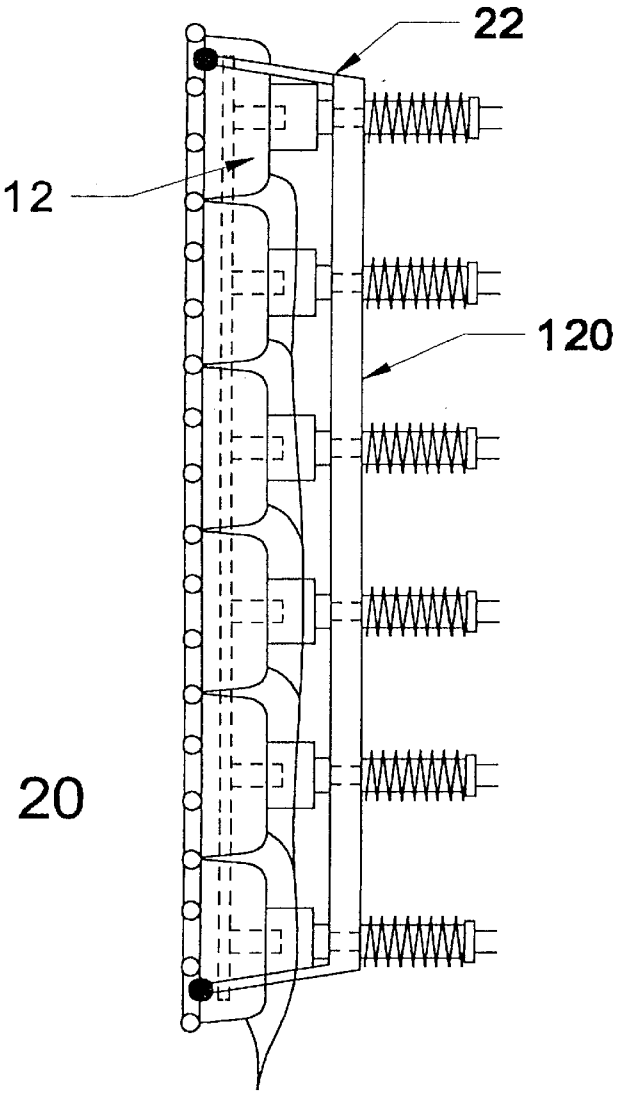
FIG. 20 is a side view of the apparatus of FIG. 19.

The term "hingedly connected" as used herein means that the frame members pivot about a common axis or a relatively parallel axis. Pivoting about a common axis can be accomplished by constructing the frame members as panels 176, as shown in FIGS. 4 and 13–14 or planar trusses 178 as shown in FIGS. 1–3 and 5, and connecting the frame members directly with each other along a common edge or border via a hinge or flexible member. Alternatively, the frame members can individually be connected via secondary swivel joints 182 or primary swivel joints 184 to a common rigid backbone 186, such that each frame member is free to individually pivot. In FIGS. 1 and 3–5, secondary swivel joints are shown placing the backbone in communication with the two frame members. In FIG. 18 a primary swivel joint is shown placing the backbone in communication with a panel frame member. Further, FIGS. 13, 14 and 17 have openings 190 that are capable of receiving a primary swivel joint to allow the primary swivel joint to be in direct communication with the panel to the exclusion of a back bone.

As a result of the pivotability of the rotary spray units and the hinged connection of the frame members, the rotary spray units are free to conform closely to a varying surface topography. The addition of the secondary or primary swivel joints enhances the mobility of the rotary spray units as they are transported across the surface being treated.

In the preferred embodiment of the present invention the framework 174 is a single structure, as shown in FIG. 70B. An outrigger pair 381 may further support the framework. Each outrigger includes an elongated bar that is sized to extend beyond either side of the rotary spray units. The elongated bar of the outrigger may be flexible or hinged with a spring to add more mobility to the rotary spray units as they traverse the surface to be treated, particularly concave and convex surfaces.

The framework of the preferred embodiment has a plate mount 380 with a mounting pin 382 projecting outwardly in a direction away from the rotary spray units 12. The mounting pin engages the bracket system to support the rotary spray units in various orientations with regards to the surface to be treated.

In each instance, whether the framework has two frame members or a single structure a second manifold 384 is attached. When a single structure is used a single manifold is attached to the plate mount near the rotary spray units. When two frame members are used the second manifold is attached to the rigid back bone 186. The second manifold controls the fluid flow or fluid/abrasive flow into each of the rotary spray units.

As seen in FIG. 70B, the framework may have a plurality of Teflon® pads 386 for reducing friction between the bracket system and the framework during operation of the rotary spray units.

Figure 77:
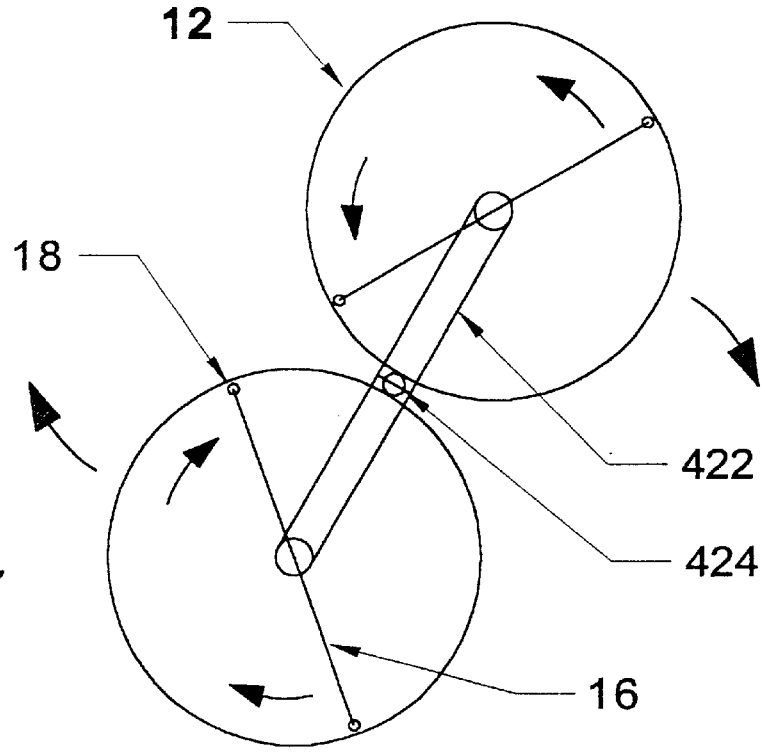
FIG. 77 is a schematic view of a pair of rotary spray units coupled by a pivot arm for simultaneous orbiting and rotating.

Finally, the plurality of rotary spray units may be coupled by rotating pivot arm 422 which is in turn mounted to the framework. The rotating pivot arm has a center pivot 424. The rotating pivot arm rotates a pair of rotary spray units 360 degrees. Preferably, while the rotating pivot arm turns, the rotor arms of each of the rotary spray units rotate continuously. One of the rotor arms preferably turns clockwise, while the other rotor arm turns counterclock wise as depicted in FIG. 77.

The framework can comprise two or three or more frame members, and may be formed of welded square metal beams, or sheets of metal, plastic, or carbon fiber, or any desired materials capable of withstanding the conditions of use.

Primary Framework Positioning Means

The present invention preferably further comprises a primary positioning means 196 for placement of the rotary spray units with housing(s) against the surface to be treated, and for making intermediate position adjustments intermediate the fine positioning adjustment of the rotary spray unit positioning means, and the rough positioning of the secondary framework positioning means discussed below. For surface treatment, the rotary spray units must be positioned on a framework relative to each other and this framework must be positioned and maintained against the surface to be treated. This can be accomplished by the combination of (a) means for rotational movement of the frame work for directional positioning of the rotary spray units against the surface to be treated, either vertically or horizontally, (b) a feedback means for communicating the general positional information to the framework, and (c) means for resiliently communicating with the framework to permit the rotary spray unit to be positioned in accordance with the sensed changes in relative position communicated by the feedback means of the secondary positioning means. The feedback and positioning is accomplished by the mechanical or electrical sensing devices discussed above in the section about the secondary positioning means.

Figure 1B:
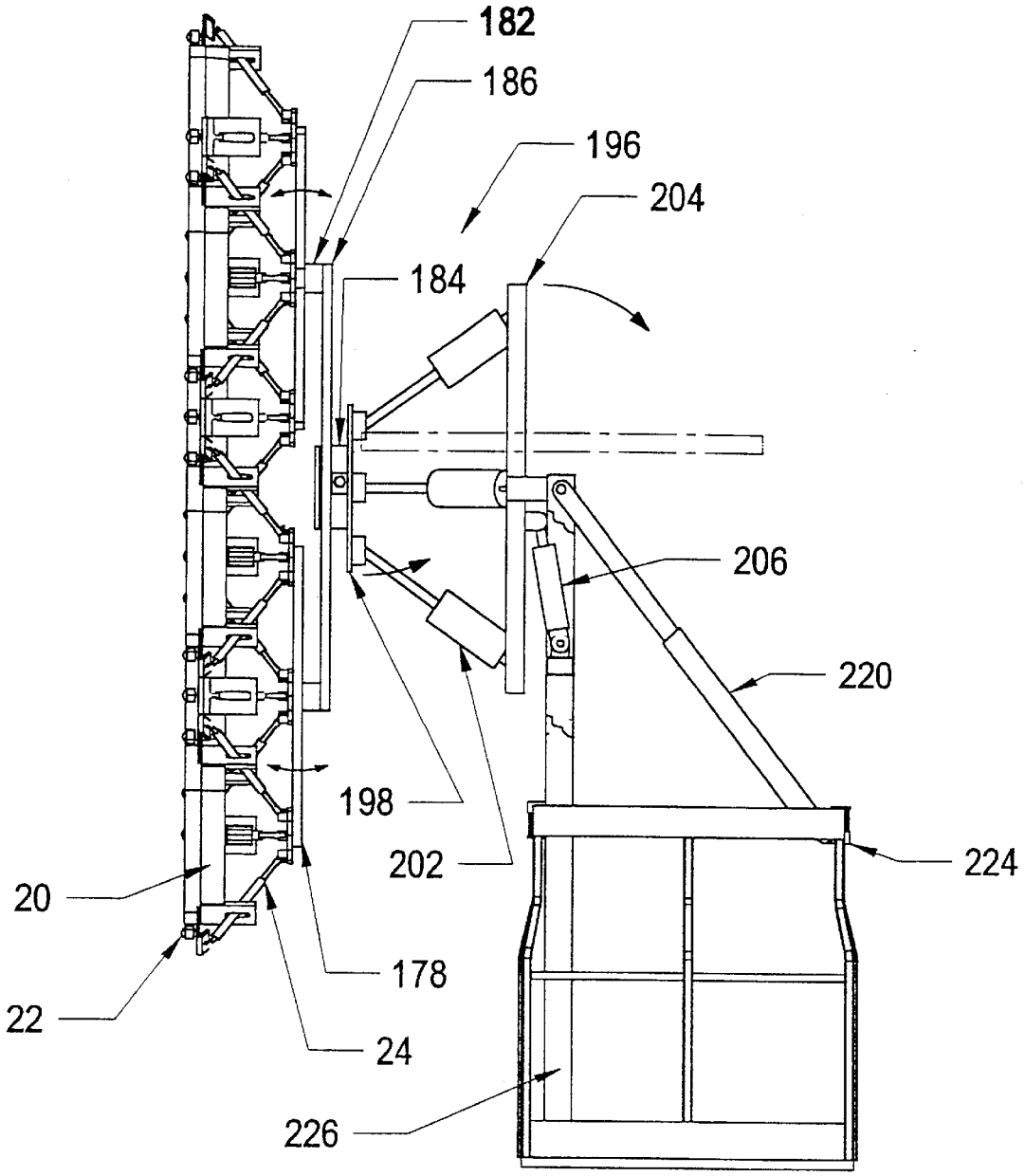
FIG. 1B is a side view of the apparatus of FIG. 1.

The primary framework positioning means 196, as seen in FIG. 1B, may be composed of a primary swivel joint 184 in communication with a bracket system 198, framework 186 connecting frame members 178, a plurality of resilient or positive controlled means 202 in communication with the bracket system and a brace 204, and a lift cylinder 206. The primary resilient means 202 is preferably air cylinders. The primary swivel joint is preferably coupled with the framework and the bracket member. The primary swivel joint may be operated by an air motor or similar mechanism, but since the framework is balanced it may be manually pivoted.

The primary positioning means does not have to have a swivel joint (see FIG. 70B) but can be attached to the framework with the mounting pin 382 and held in position with a locking pin. The pivot pin allows the framework to be manually elevated with respect to the bracket system to place the handle at an optimal elevation for the comfortable grasp of the operator.

In the embodiments using the primary swivel joint, the joint rotates the backbone or framework 90 degrees in a clockwise or counter-clockwise direction, for a total of 180 degrees. The use of the swivel joint allows the rotation of the rotary spray units to accommodate the hills and valleys of the surface to be treated.

In FIGS. 1–1B the bracket system that is attached to one end of the primary swivel unit has the plurality of primary resilient means attached. The plurality of resilient means are coupled between the bracket and brace to allow them to maintain pressure on the framework and ensure that the rotary spray units stay flush against the surface being treated. Each primary resilient means has a sensor within that tells the air pressure when to increase so as to increase the pressure against the framework. The brace is in communication with the lift cylinder and a support attachment system 208.

The sensor in each of the primary resilient means and lift cylinder may be part of an air logic system, wherein the amount of pressure in each cylinder is maintained at a pre-determined pressure, thereby holding the framework and rotary units against the framework by decreasing or increasing the pressure in the primary resilient means. Air logic systems are commercially available. As examples, reference may be made to Parker "B5" series air control valves which are single and double solenoid or single and double remote air pilot operated, and Parker "2MA" series non-lube air cylinders.

Figure 2:
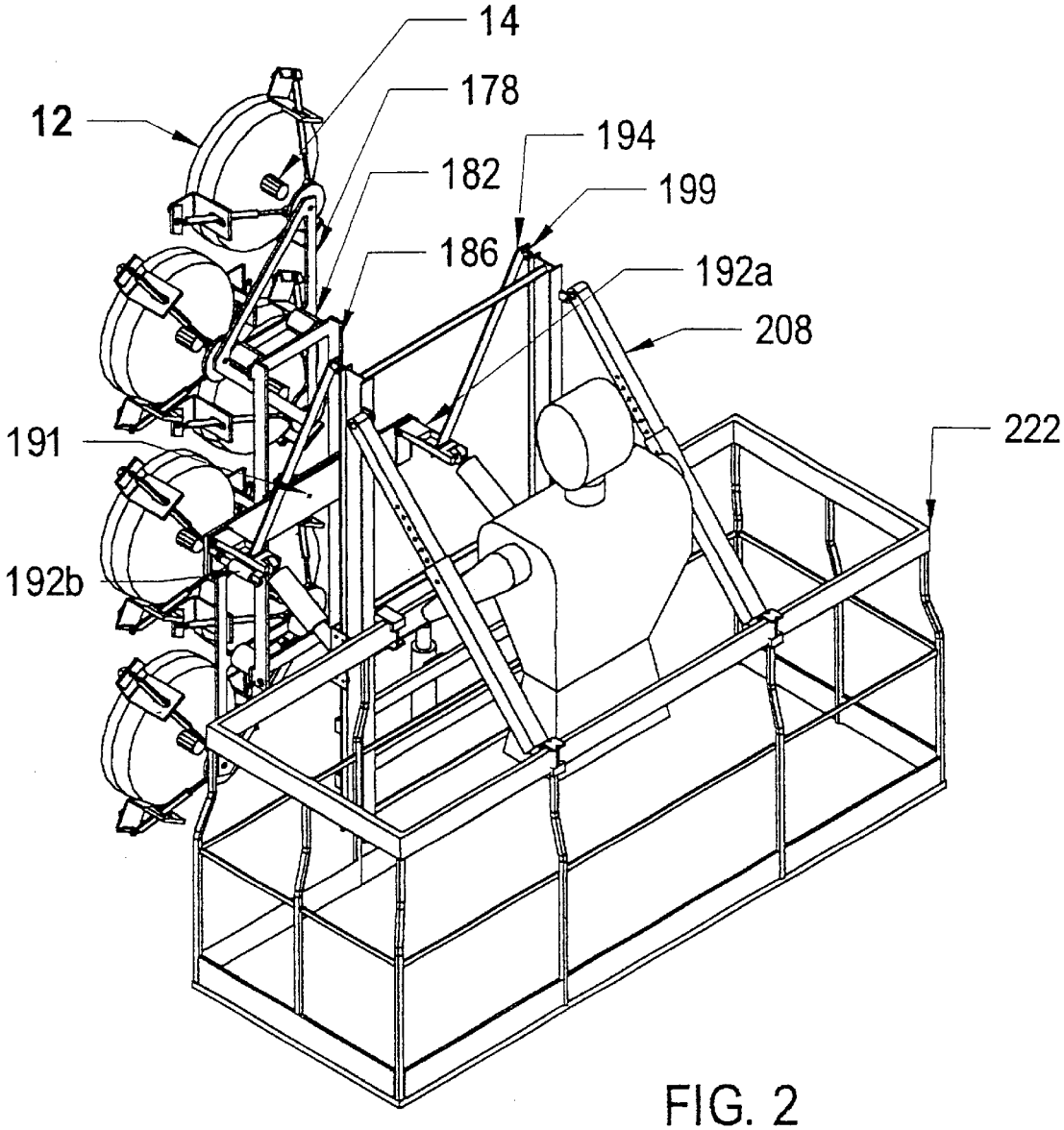
FIG. 2 is a perspective illustration of an apparatus for pressure treating a surface constructed with alternative primary framework positioning means.
Figure 2A:
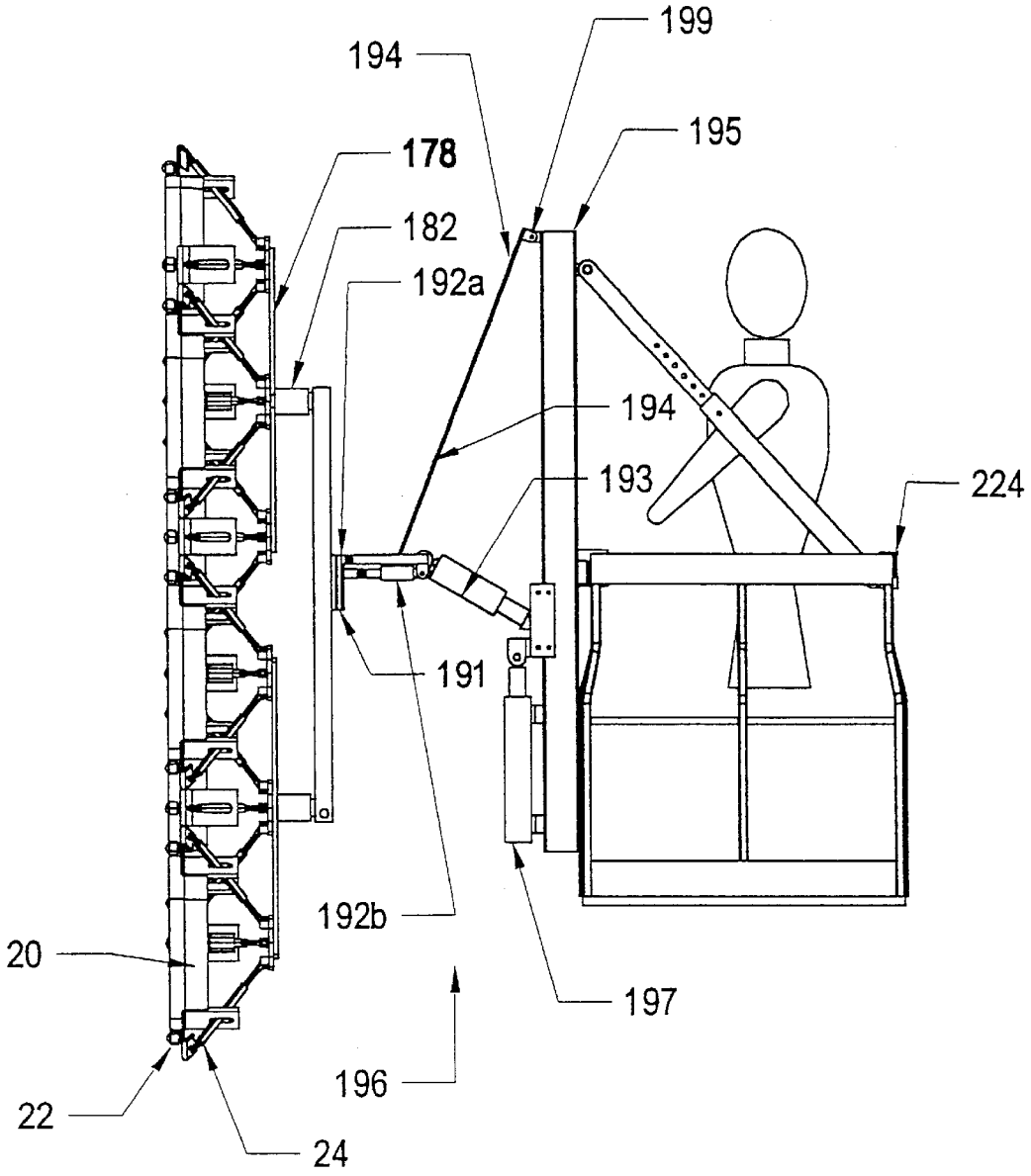
FIG. 2A is a side view of the embodiment of the invention of FIG. 2.

Further, a wide variety of primary framework positioning means may be designed. Four such embodiments are depicted in FIGS. 2–3, 31–32 and 70–70B. The second primary framework positioning means as depicted in FIGS. 2 and 2A is comprised of a rotary bearing 191, a head assembly 192, a pair of large positioning cylinders 193, a pair of elongated leaf springs 194, a pair of "I" beams 195 and a vertical lift cylinder 197. The rotary bearing is in communication with the rigid backbone 186. The rotary bearing is a pin that allows manual turning of the framework backbone for clockwise and counter clockwise movement.

The head assembly 192 is composed of a pair of "L" shaped support members 192*a* coupled with a pair of small positioning cylinders 192*b*. Each of the elongated leaf springs is coupled with a small positioning cylinder at one end and a pivot pin 199 at another end. Each pivot pin couples a leaf spring with one of the "I" beams. The head assembly allows the rotary spray units coupled with the framework to be rotated ninety degrees upward and downward about the pivot pins. This movement is preformed by the cooperation of the small positioning cylinder, the leaf spring and the large positioning cylinders. The "I" beam is coupled to support attachment system and the work platform.

Figure 3:
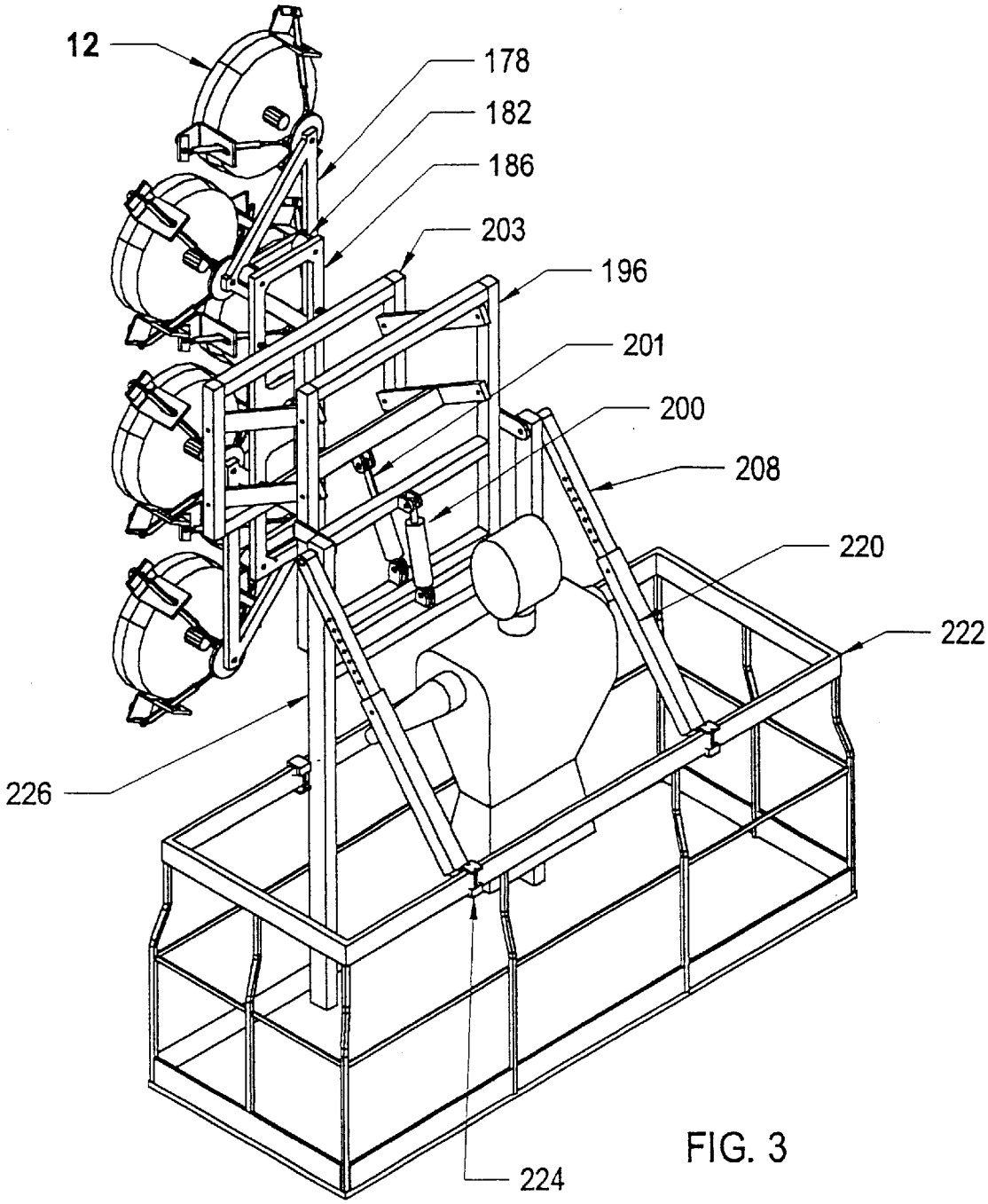
FIG. 3 is a is a perspective illustration of the apparatus with a third embodiment for the primary positioning means.
Figure 4:
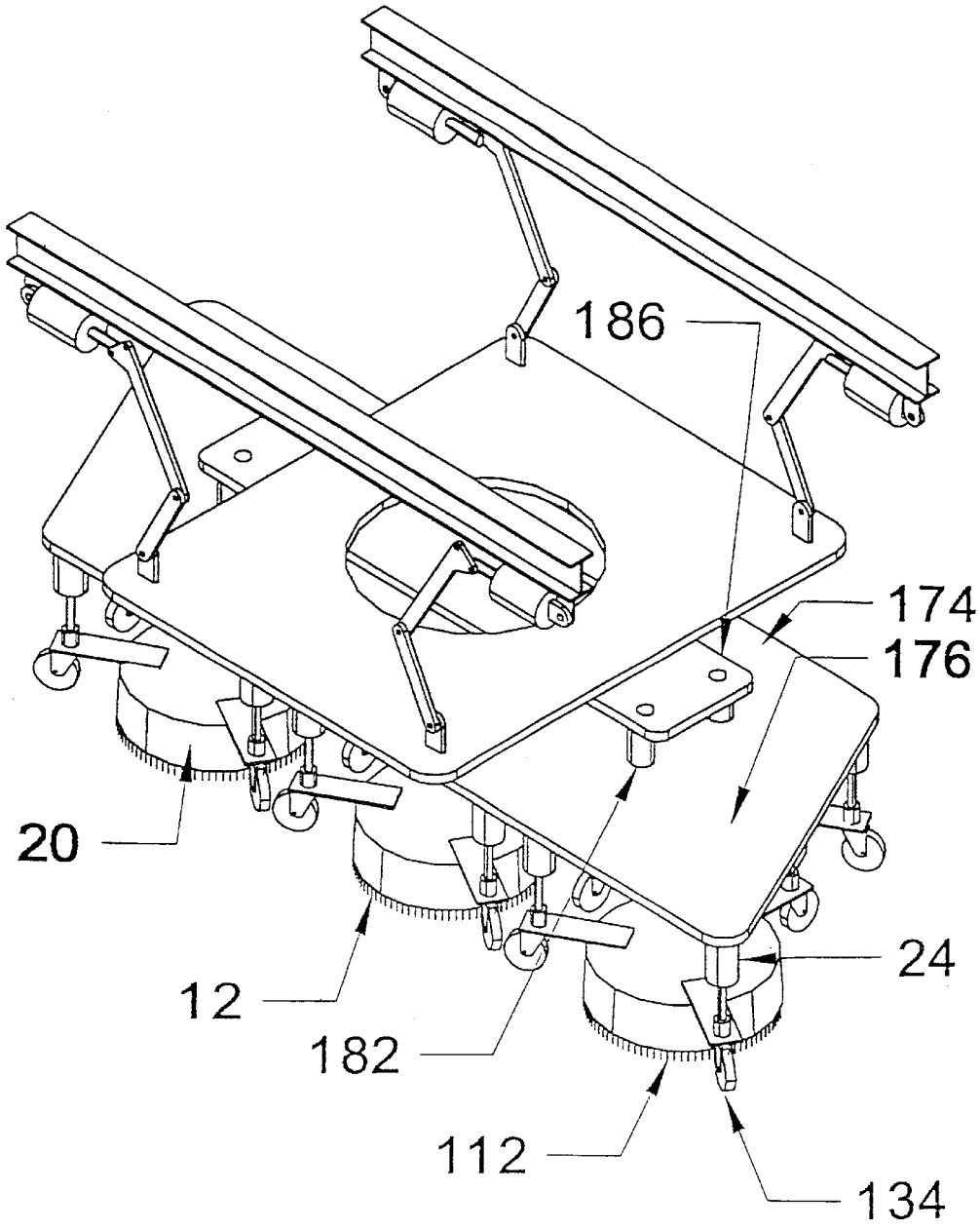
FIG. 4 is a top isometric view of another embodiment of the present invention.

The third primary framework positioning means 196, is illustrated in FIG. 3. In this embodiment the support attachment system is identical to the one in FIG. 1. The third primary positioning means is composed of a vertical lift cylinder 200 and a positioning cylinder 201. The vertical lift cylinder is coupled with the brace 204 and pivots about a horizontal arm between the two vertical mounting arms of the support attachment system. A secondary brace 203 is in communication with brace 204 via the positioning cylinder 201.

The fourth primary framework positioning means, as illustrated in FIGS. 31 and 32, is a bladder 212. The bladder is in communication with a backbone 186 and a brace 204. Also, a pair of resilient means are positioned adjacent the bladder and coupled to the backbone and brace. In FIG. 31 the brace is in communication with a support attachment system. In FIG. 32 the brace is in communication with a suspension system 218. The bladder is made of a rubberized or plasticized material with interwoven fibers for strength and durability.

The fifth primary framework positioning means, as illustrated in FIG. 70 is comprised of a bracket system 198 to which the framework is pivotably mounted, four air cylinders 202 of which the cylinders are fixed in relation to each other by planar support plates 226*d* and the piston rods or connecting rods are connected to the bracket system 198, vertical mounting arms 226, and a vertical brace 226*c*. The vertical mounting arms form a first vertical mounting arm pair 226*a* and a second vertical mounting arm pair 226*b*. In operation the fifth embodiment of the primary framework positioning means is composed of four air-logic air cylinders. The air cylinders of the primary framework positioning means allow the bracket system 198 to be moved towards and away from the surface being treated. The air cylinders of the primary framework positioning means are commonly called air logic systems and were previously explained. Each of these air cylinders, as shown in FIG. 70, is flexibly coupled to the bracket system at a first end with cylinder yokes. Each of the air cylinders passes through one of the first vertical mounting arm pairs and couples with one of the second vertical mounting arm pairs. To further support each of the primary resilient means, the pair of planar supports 226*d* are provided and are mounted to the first vertical mounting arm pair 226*a*.

Further, the first vertical mount arm pair includes two additional vertical mounting arm supports, a centrally positioned vertical mounting arm support 372 and a lower positioned vertical mounting arm support 374. These additional supports keep the vertical mounting arms from spreading apart at a lower position. To assist with attaching the fifth embodiment to the work platform, a lift connector 377 is attached to each of the first vertical mounting arm pairs. Each lift connector has a wheel to allow the primary positioning means to be rolled into the work platform for coupling the present invention to the work platform.

When the bracket system is coupled with the framework to which the rotary spray units 12 are connected, the primary resilient means is able to sense movement and adjust the position of the bracket system in response to the sense changes. By adjusting the bracket system by keeping constant air pressure in the air logic air cylinders, the rotary spray units retain their contact with the surface to be treated.

According to FIG. 70, one of the planar supports 226*b* has a first manifold 376 mounted on it. The first manifold has hoses that run into it from the fluid supply. The first manifold functions as a surge tank and contains the fluid for the second manifold.

The bracket system of the primary positioning system has a center member 375 that has a plurality of locking holes 375*a* for receiving the locking pin 375b that locks the framework to the bracket system. Each locking hole is positioned about 45 degrees apart.

Figure 37:
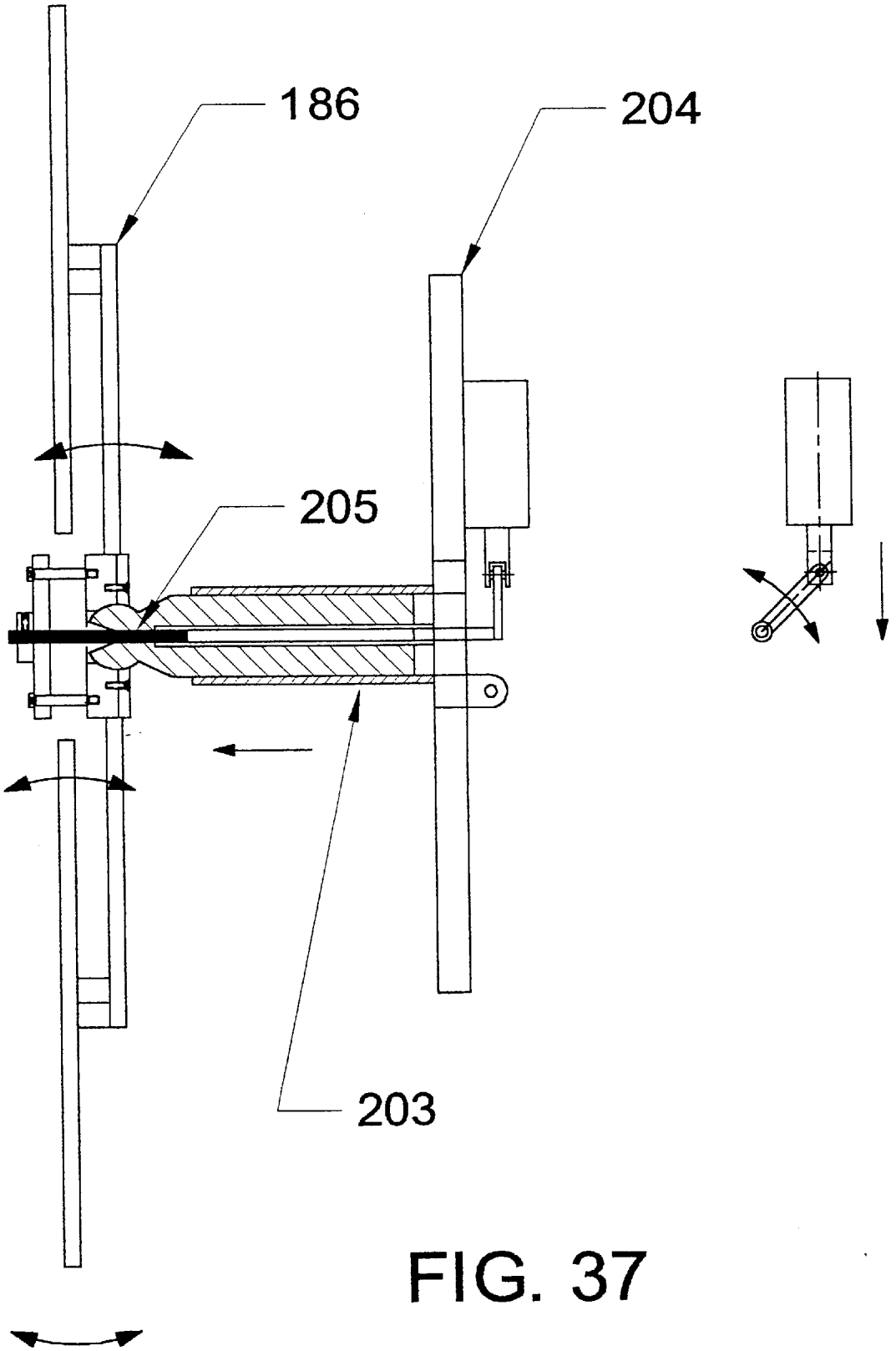
FIG. 37 is a cross-sectional view of a ram-actuated positioning means for a ball-joint mounted framework.

Finally, the primary swivel joint 184, as discussed above in the present invention is taught as a system operated by an air motor, or a rotary bearing that can be manually moved. It is to be understood that these primary swivel joints are not taught for the purpose of excluding other high pressure swivel joints. One such swivel joint is depicted in FIG. 37. In this figure the primary swivel joint is a ball joint 203 with a flexible cable 205 passing within. This primary swivel can tilt and rotate the rotary sprayer units ninety degrees clockwise and ninety degrees counter clockwise form the initial orientation.

Secondary Framework Positioning Means (Work Platform Positioning Means)

The brace in FIGS. 1–1B and 31 is in communication with a support attachment system 208. The support attachment system has a pair of arm braces 220. A first end of the pair of arm braces is coupled with the back of the work platform 222 by a pair of attachment clamps 224. A second end of the pair of arm braces is hingedly coupled with a pair of vertical mounting arms 226 and the brace 204 of the primary positioning means. In FIGS. 2–2*a* the pair of vertical mounting arms are replaced with a pair of "I" beams. In FIG. 70 the support attachment is replaced with a second vertical mounting arm 226*b*.

Further positioning means are well known to those working in this art. For example, U.S. Pat. No. 4,286,417 (Shelton) teaches a method and apparatus for moving a blasting machine along a surface to be treated while maintaining a desired disposition of the blasting machine relative to the surface being treated. A support structure having a moveable boom with a blasting machine on its distal end is positioned adjacent the surface for treatment. Means are provided on the blasting machine to sense the positions of the blasting machine relative to the surface for treatment as the boom is moved through a work path. Movements of the blasting machine away from the desired position are sensed and compensated to adjust the blasting machine toward the intended disposition substantially throughout the movement of the boom through the work path. This method of compensation takes into consideration only the separation of a planar apparatus from a planar surface. The method is not intended for spacing a conforming surface treatment apparatus to a convex or concave surface. Further, Shelton uses a complicated system of three sensors and associated signals, an electrical system, and a hydraulic system to properly position the treating device in relation to the surface to be treated. Such a system is complex, expensive and prone to breakdown. There is a need for a simpler apparatus and method, which can position a conforming apparatus to a convex surface.

Figure 12:
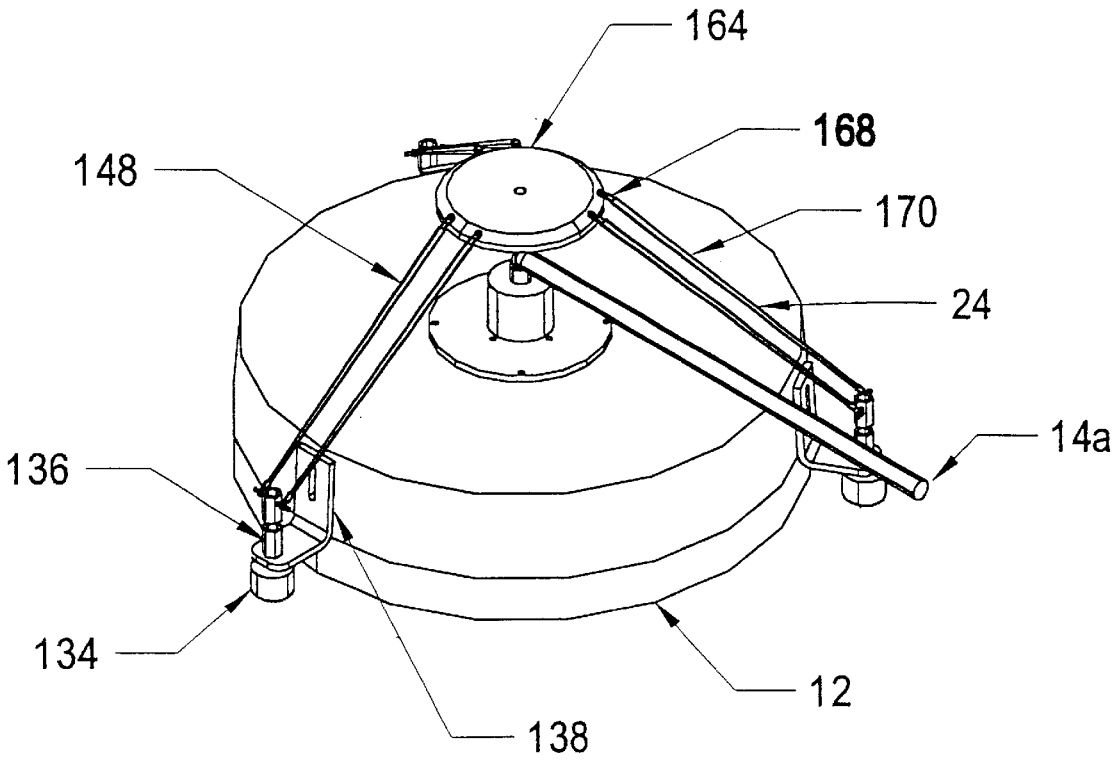
FIG. 12 is an enlarged view of a fourth embodiment of the resilient rotary spray unit positioning means as telescoping arms and to show the housing for the rotary union with the fluid treatment supply conduit projecting outward.
Figure 12A:
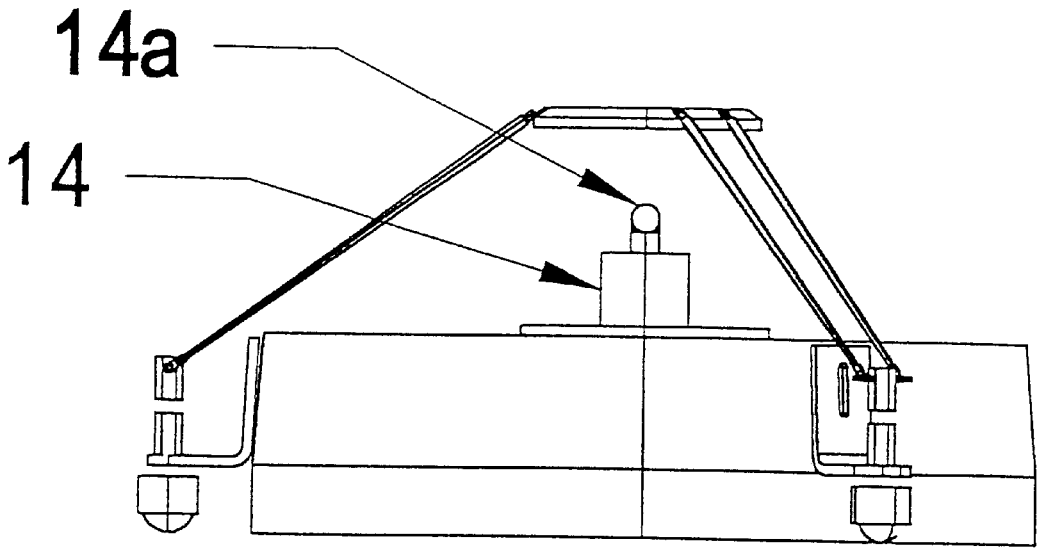
FIG. 12A is a side view of FIG. 12 showing the fluid line coming into the rotary union.

Further, U.S. Pat. No. 4,095,378 (Urakami) teaches a device capable of suction-adhering to a wall surface by pressure of an ambient fluid, and moving along the wall surface. The device uses caster wheels to maintain the housing properly spaced relative to the surface, and biasing cylinders to maintain the surface treatment device at a constant distance from the surface to be treated. The pressure receiver housing may be divided into two or more portions in order that the device will adhere closely to the wall surface and move therealong even when the wall surface has a small radius or curvature or is uneven. The housing segments can each be connected to the frame member through a universal joint such as a ball and socket, or the frame member of the device, as shown in FIGS. 12, 13 and 16, can be divided into three or more portions hinge-connected to each other. This device is designed to be held against a ship hull underwater by ambient pressure, and is not designed to be used above the water level.

Figure 38:
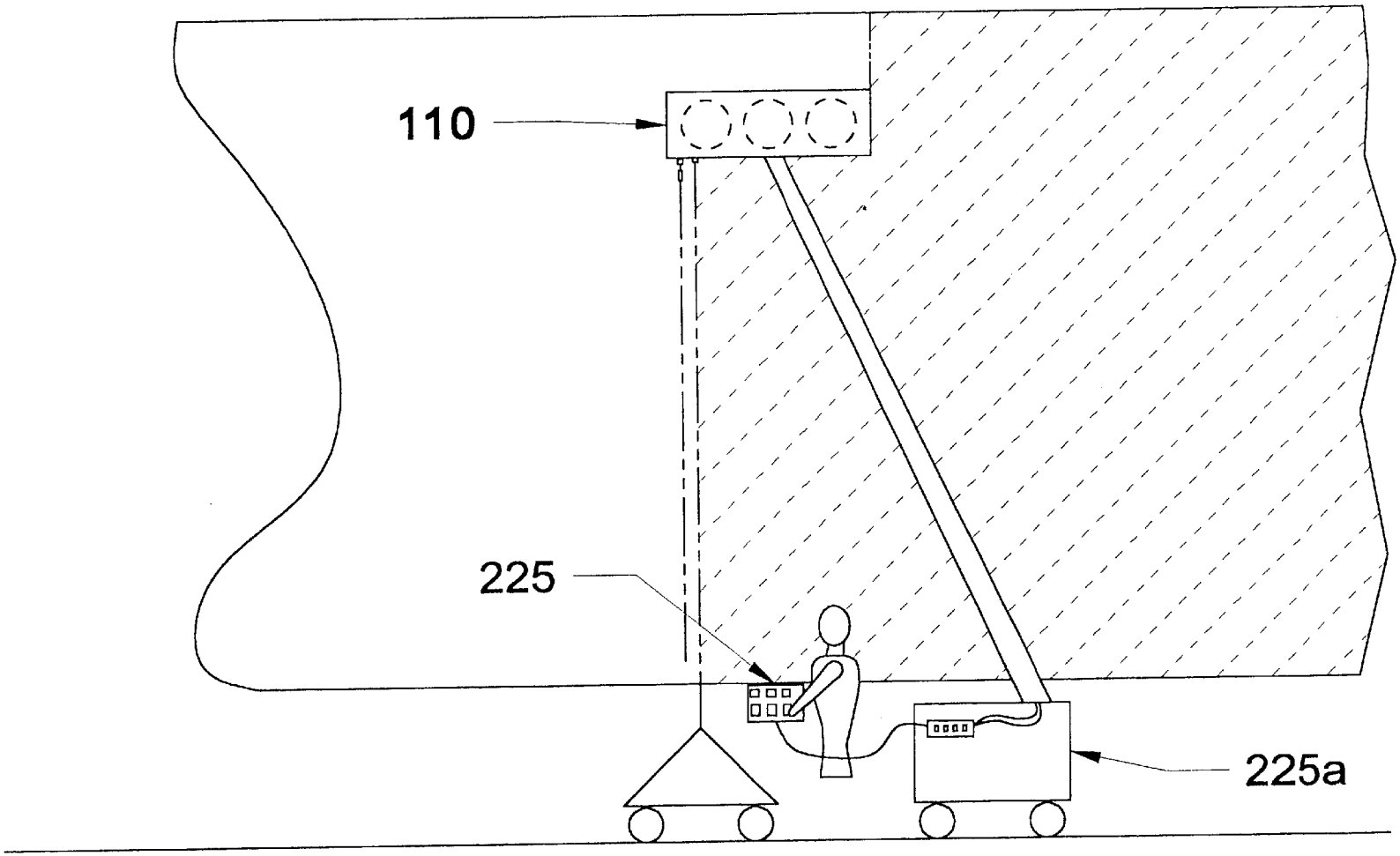
FIG. 38 shows the apparatus of FIG. 70 being positioned and moved by a boom and guided by a laser-guidance or marker optical reading or remote control means system in an operational orientation.

The surface treatment apparatus of the present invention is designed for surface treatment at all elevations of the object being treated by the use of the plurality of rotary spray units or a single rotary spray unit. Further, the surface treatment apparatus of present invention is designed to be operated from: a work platform 222, as shown in FIGS. 1–3, 33, and 34; a control box 225 in communication with a man lift or crane 225*a* that can be laser guided, as shown in FIG. 38; a guide cart 229, as seen in FIG. 41A with a support system vertical scaffold wherein the height can be manually or mechanically adjusted, as shown in FIG. 41; and a trolley or cable system that suspends the apparatus. Additional, support means used to move the present invention up or down along the side and under side about the surf ace being treated, can be a boom 404, a suspension rigging, or a vertical scaffolding 227 is included. The boom or a suspension rigging, may be coupled with a work platform to carry and position both the apparatus and an operator and to hold the apparatus to the surf ace during treatment. In FIGS. 38–41 the apparatus is controlled from the ground and supported in an elevated or lowered position about a boom or cart 229.

An example of suspension rigging that can he used with the apparatus of the present invention is taught in U.S. Pat. No. 4,921,070, which teaches a work cradle positionable for working along the vertical side of a large structure. The suspension rigging has a cradle with a platform adapted to be suspended from the structure. The teaching of this patent is incorporated herein by the reference.

Figure 39:
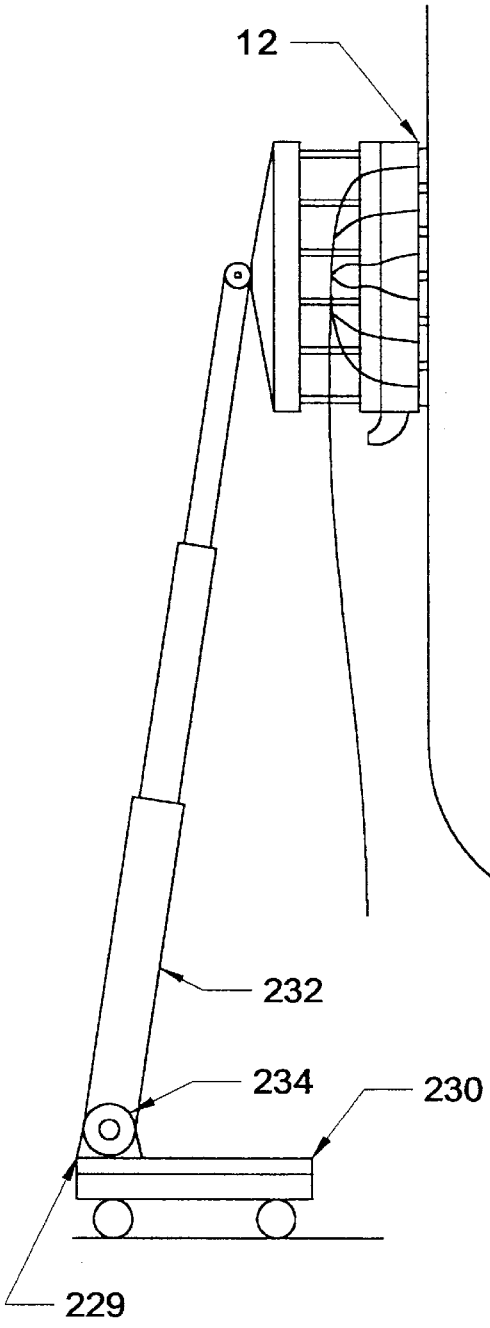
FIG. 39 is a side view of the rotary spray apparatus hoisted of FIG. 38 in operation cleaning the bottom of a ship and supported by a cart mounted on a track or automated drive means.
Figure 40:
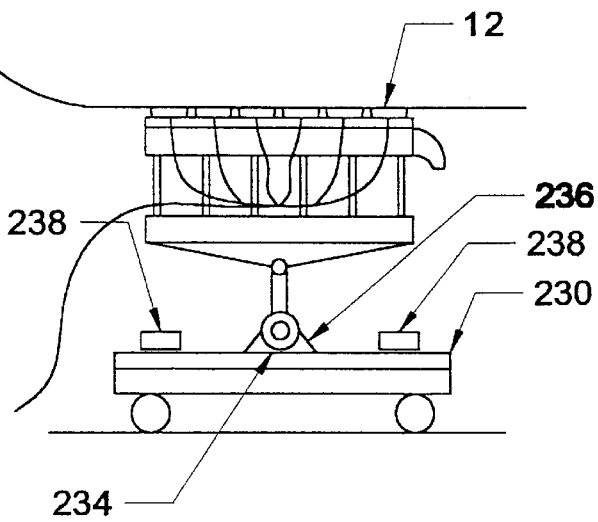
FIG. 40 is a side view of the apparatus of FIG. 39 supported by the cart mounted on the track.
Figure 41:
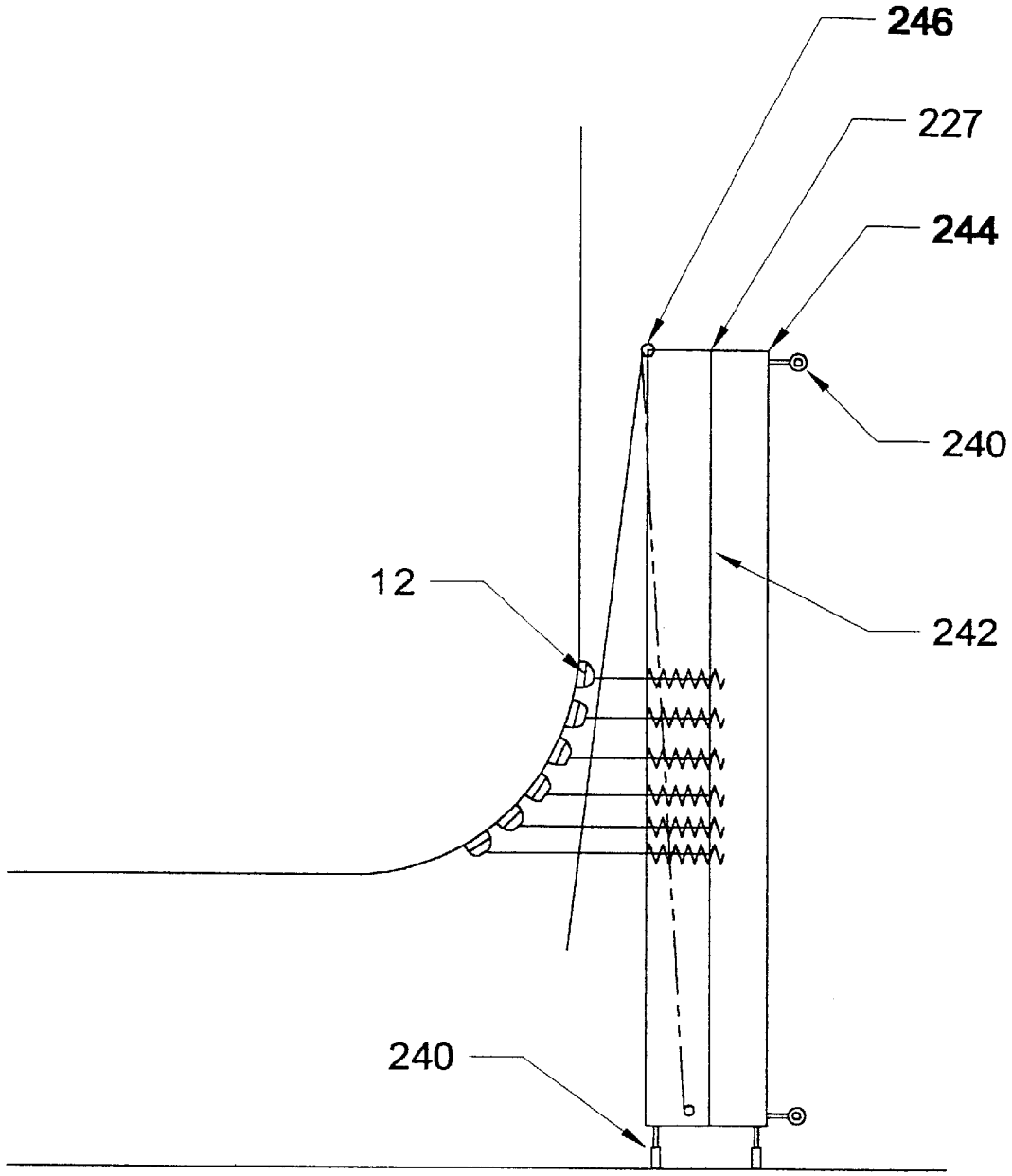
FIG. 41 is a side view of a vertical support system.
Figure 41A:
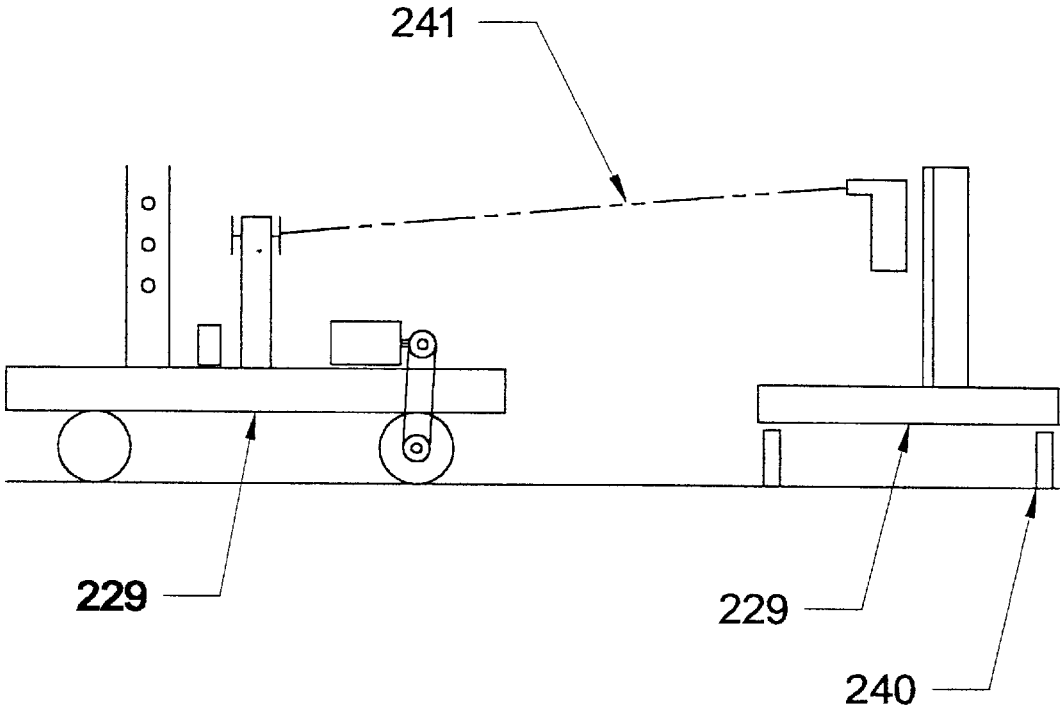
FIG. 41A is a view of a laser directed cart.

The cart of FIGS. 39 and 40 is maneuvered along a track 230. The arm 232 of the cart in FIG. 39 is telescoping and connected to the cart with a pivot joint assembly 234. In FIG. 40 the cart is the same as in FIG. 39. In FIG. 40 the cart is moved along the track or dock floor with a cable 236 coupled with a pair of drive systems 238.

In FIG. 41 the vertical scaffold 227 is used to clean surfaces ranging in heights of about 30 feet but may be more or less. The scaffold is supported by a plurality of wheels 240 and can be maneuvered manually or mechanically. The rotary spray units and frame work are mounted onto the scaffold with a horizontal cable 242 that has a snatch block or wench. The cable is attached to a support structure 244, which is raised and lowered as required by the wench. The cable is moved about through a system of pulleys 246 to raise and lower the rotary spray units and frame work.

Figure 74:
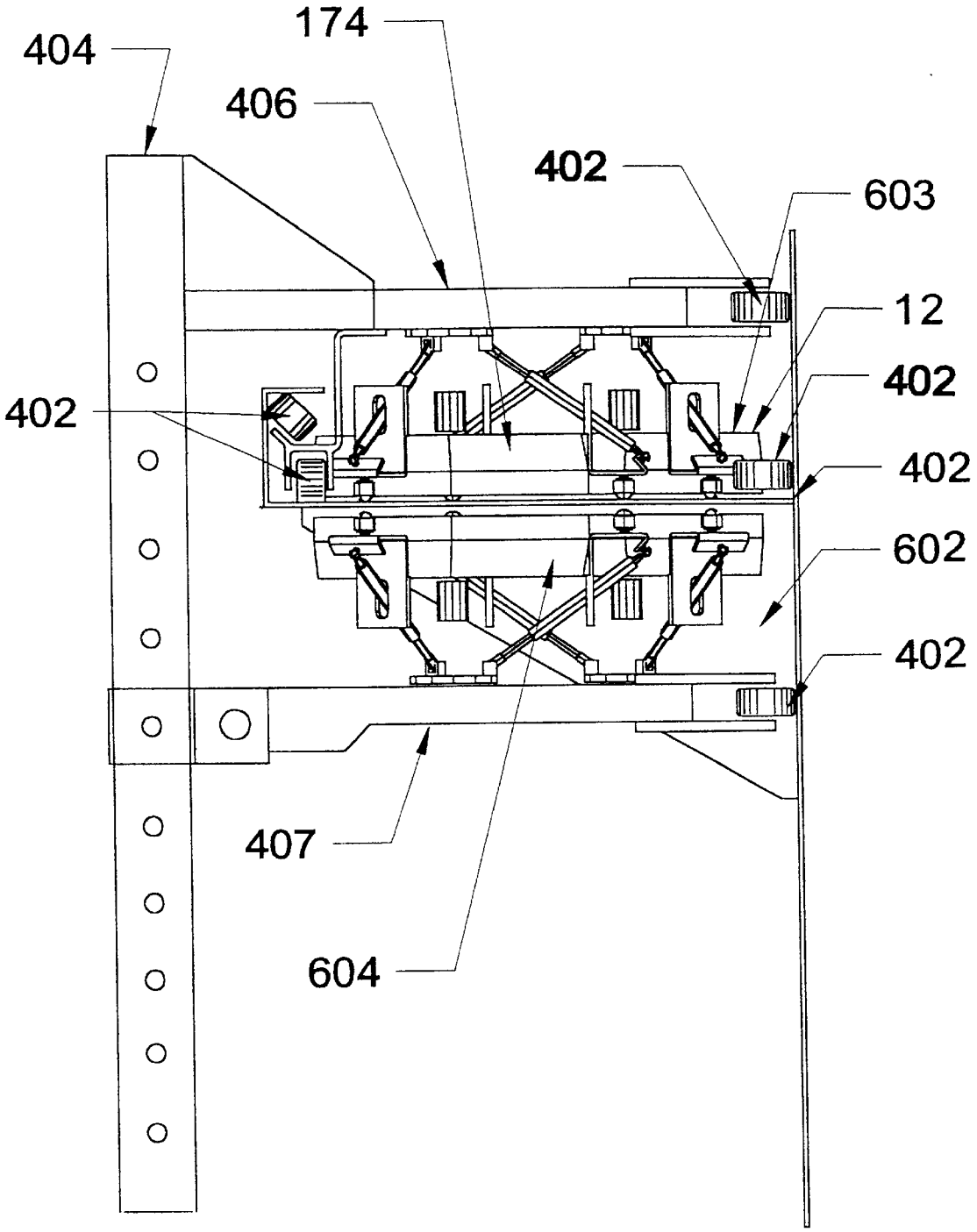
FIG. 74 is a side view of cooperating sets of rotary spray units simultaneously cleaning the upper and lower side of the wing girder of FIG. 73.
Figure 74A:
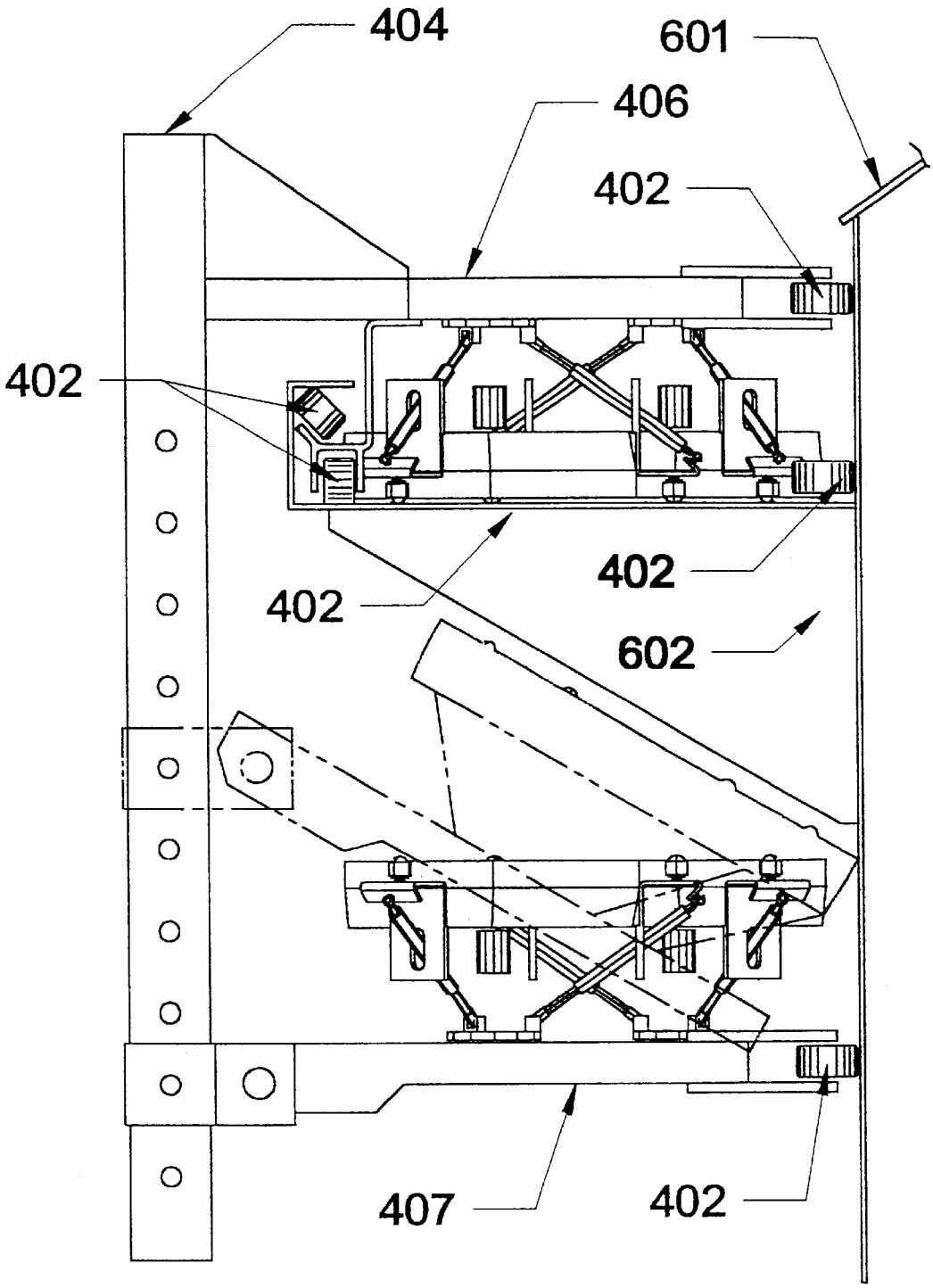
FIG. 74A corresponds to FIG. 74 but with lower rotary spray units lowered for clearance of gusset, the lower spray units shown being optionally pivotable.
Figure 74B:
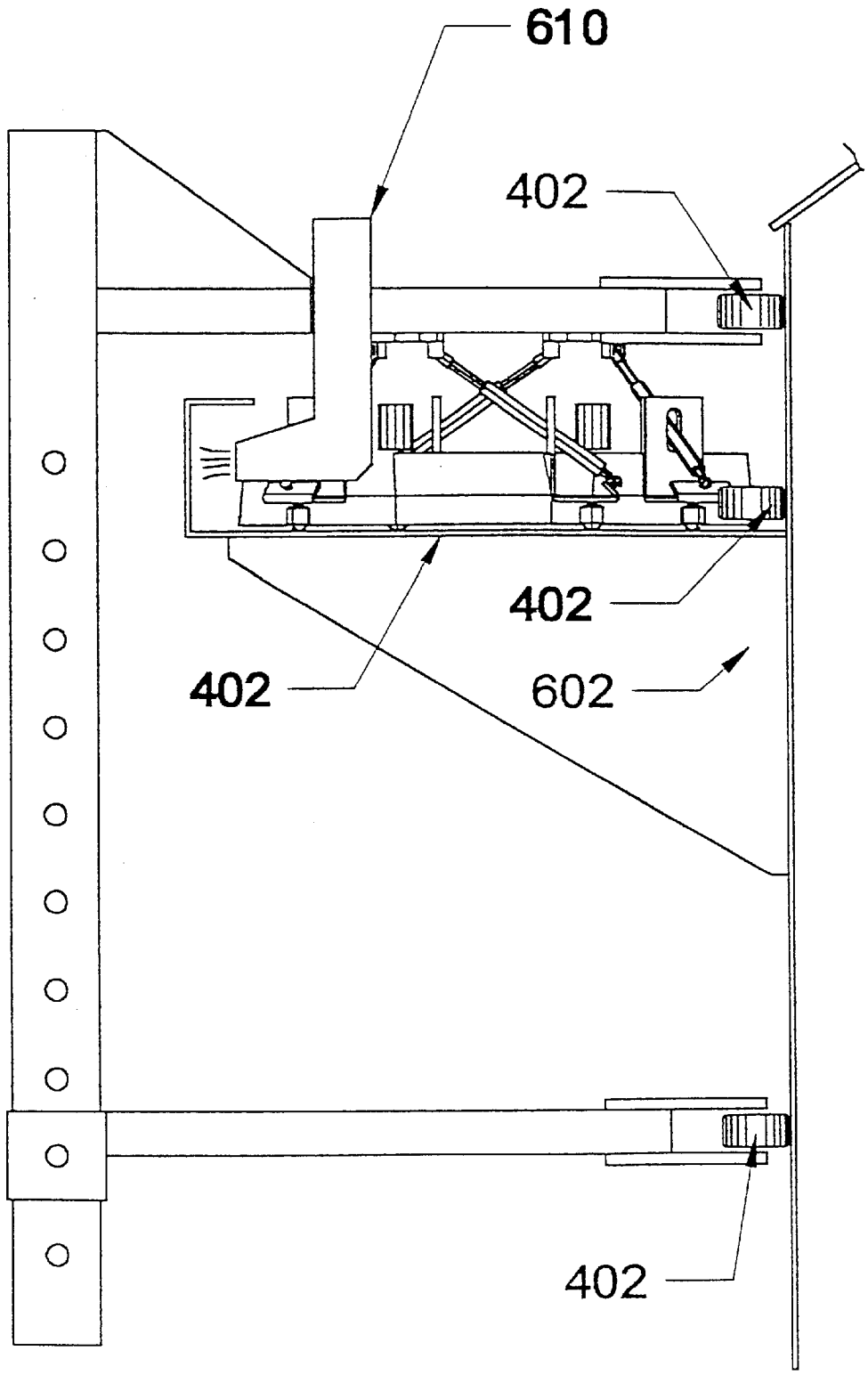
FIG. 74B is similar to FIGS. 74 and 74A, but has an added nozzle for cleaning a rain trap of the wing girder.
Figure 75:
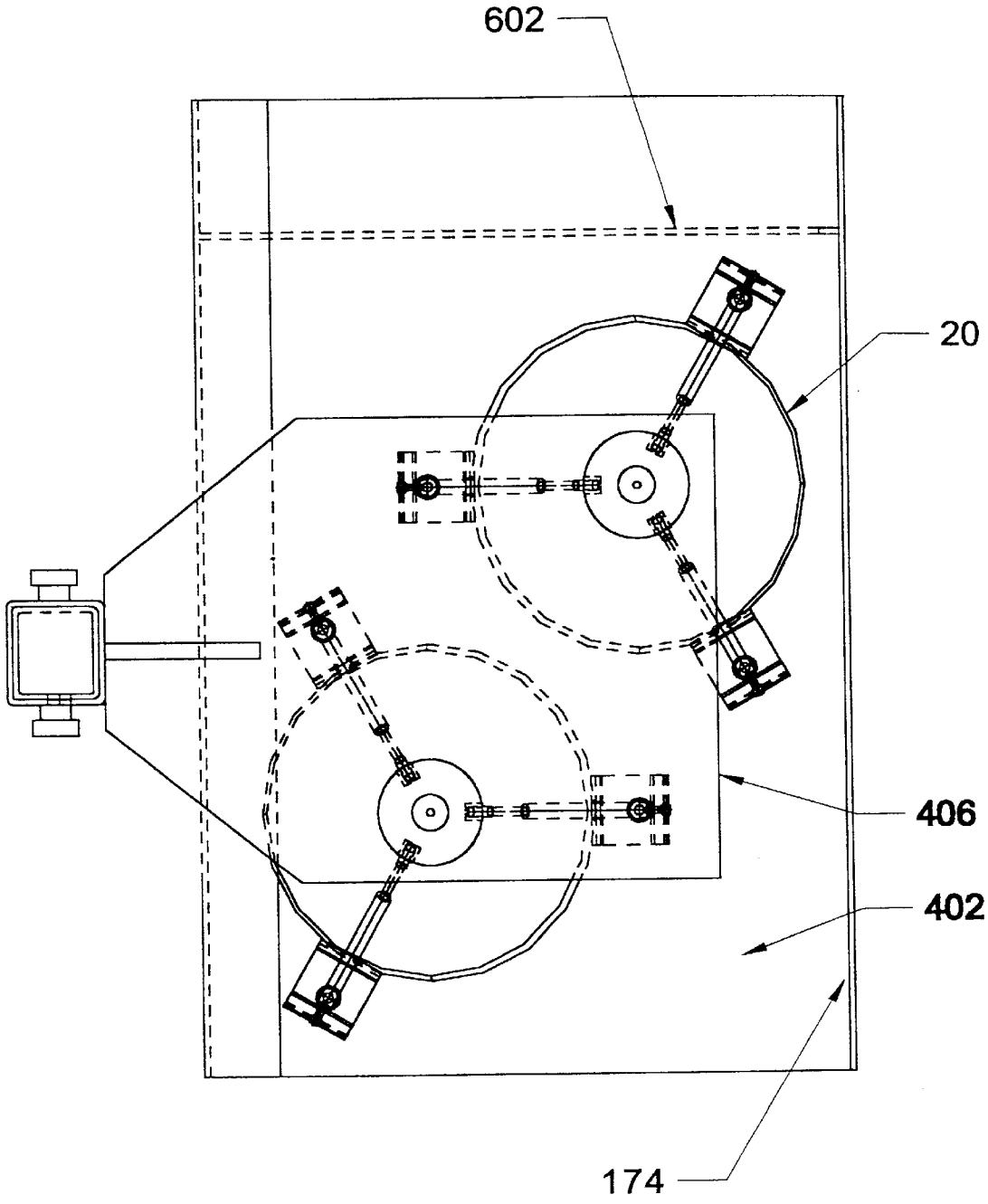
FIG. 75 is a top view of the girder cleaner of FIG. 74.
Figure 75A:
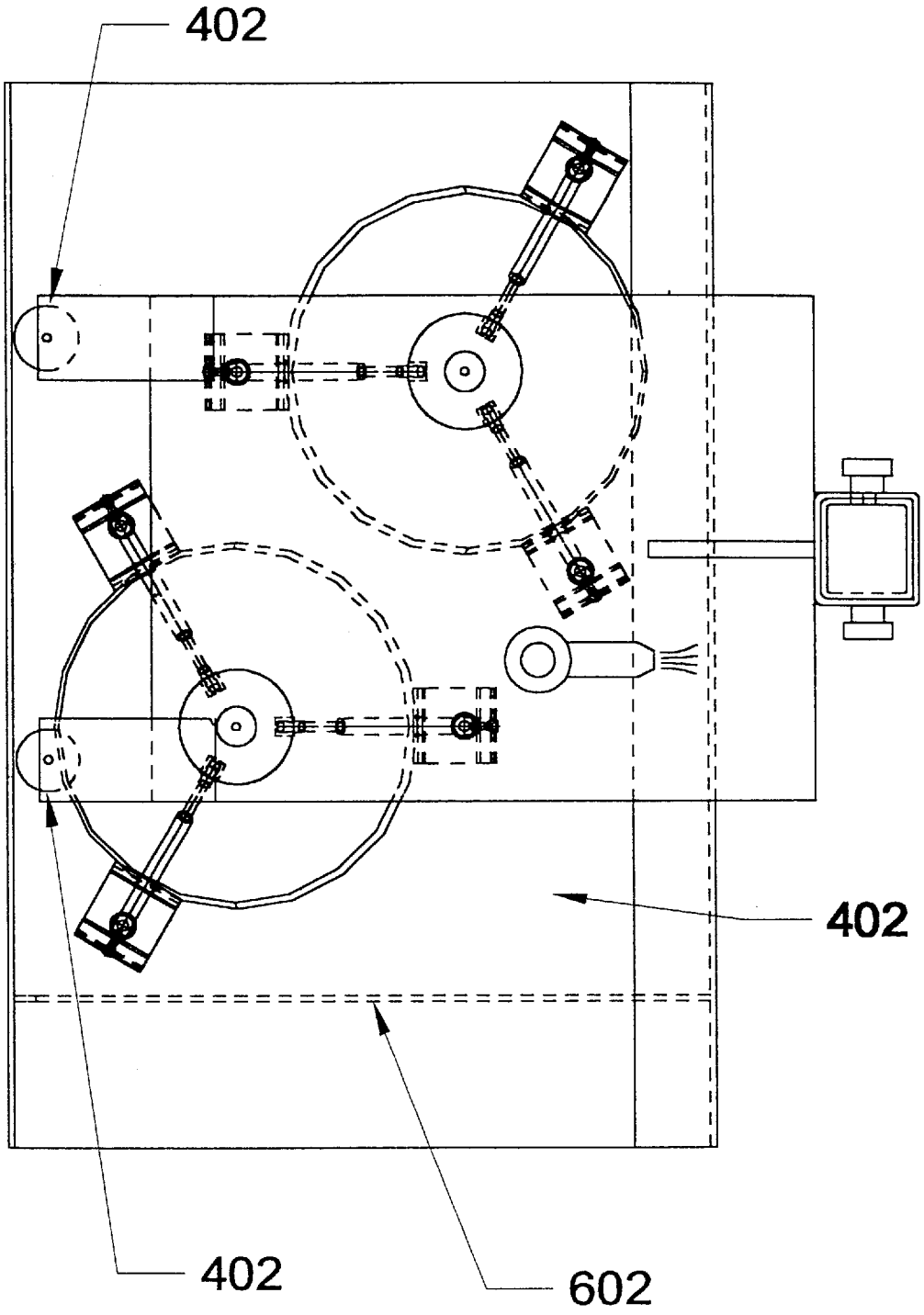
FIG. 75A is an alternative embodiment of the girder cleaner of FIG. 74.

Storage tanks have several areas along their tops that are difficult to reach, and particularly areas near the drip edge 601 and the wing girder 402. The wing girder is basically an annular ring which surrounds the metal tank near the top and imparts stability. The wing girder is welded to the tank, and is supported from below by gussets 602. These structures can be cleaned in accordance with the present invention by positioning rotary spray units and optionally individual spray nozzles as shown in FIGS. 72–75A. In FIGS. 74 and 75 two rotary spray units are used to treat the surface of the wing girder. One of the spray units 603 is positioned on the upper portion of the wing girder, while the other 604 positioned flush against the lower surface of the wing girder. The wing girder cleaner frame is held against the wing girder by an upper frame or support 406 and a lower frame or support 407, each of which are connected to a main frame 404. Further, the upper and the lower support can be adjusted along the length of the main frame to allow the rotary spray units be adjusted in accordance with the position of the wing girder to be treated. Wheels 402 or biasing may be provided to securely guide and maintain the rotary cleaning units in place. As shown in FIG. 74A, at least lower frame or support 407 is preferably mounted to be pivotable to clear and clean the gusset.

Light-weight Rotary Spray Units

Figure 29:
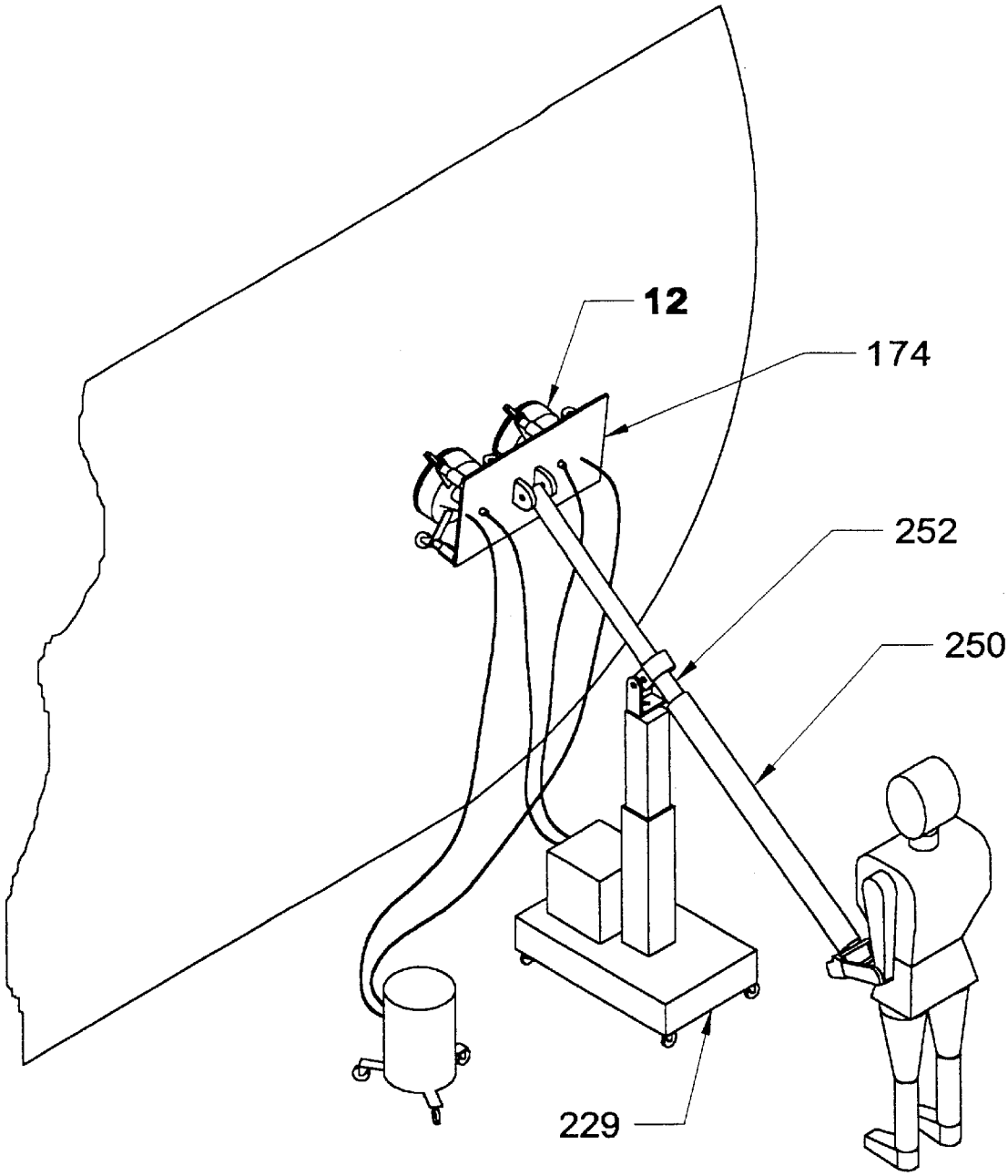
FIG. 29 is a perspective view of a smaller-scale version of the rotary spray unit that is hand operated by the user standing on the dock.
Figure 30:
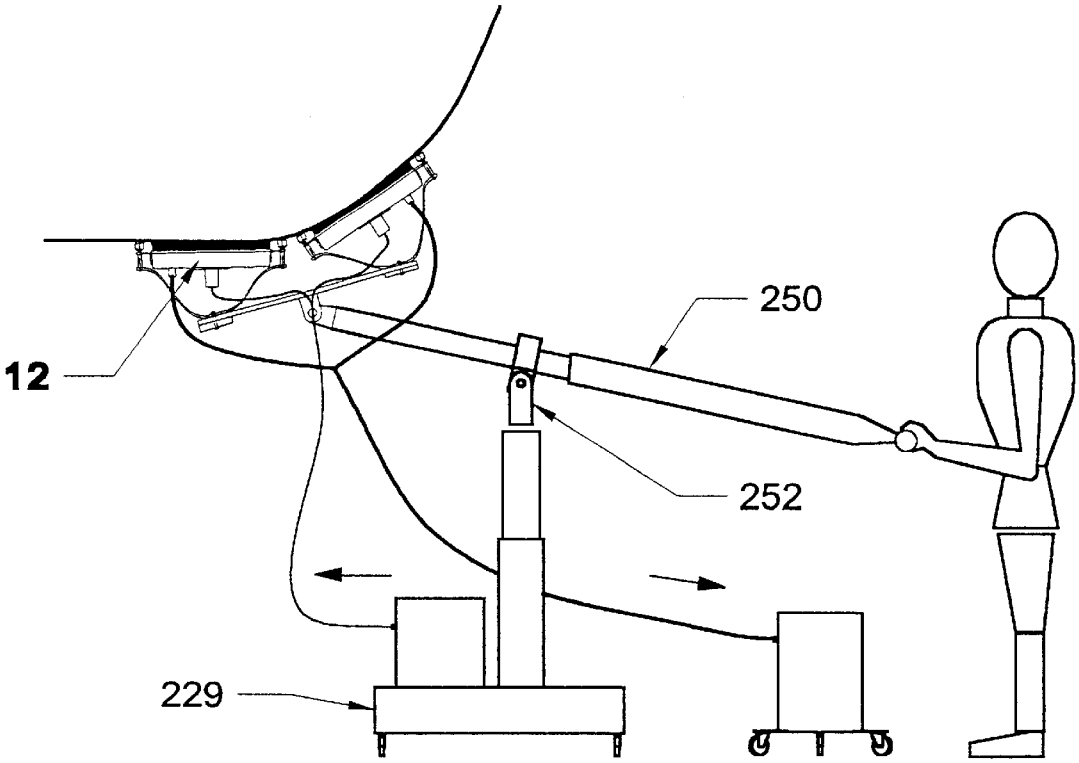
FIG. 30 shows the embodiment of FIG. 29 cleaning the bottom and side of a hull.
Figure 33:
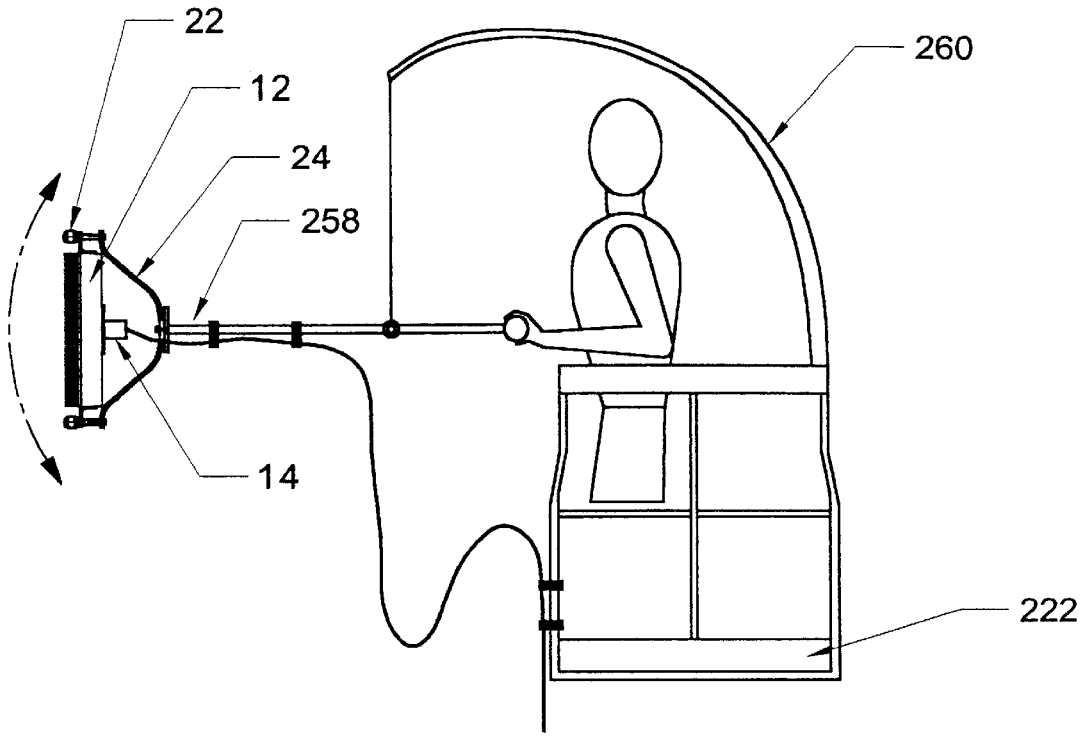
FIG. 33 is a side view of the apparatus for pressure treating a surface with a single rotary spray unit suspended from an overhead support frame.
Figure 34:
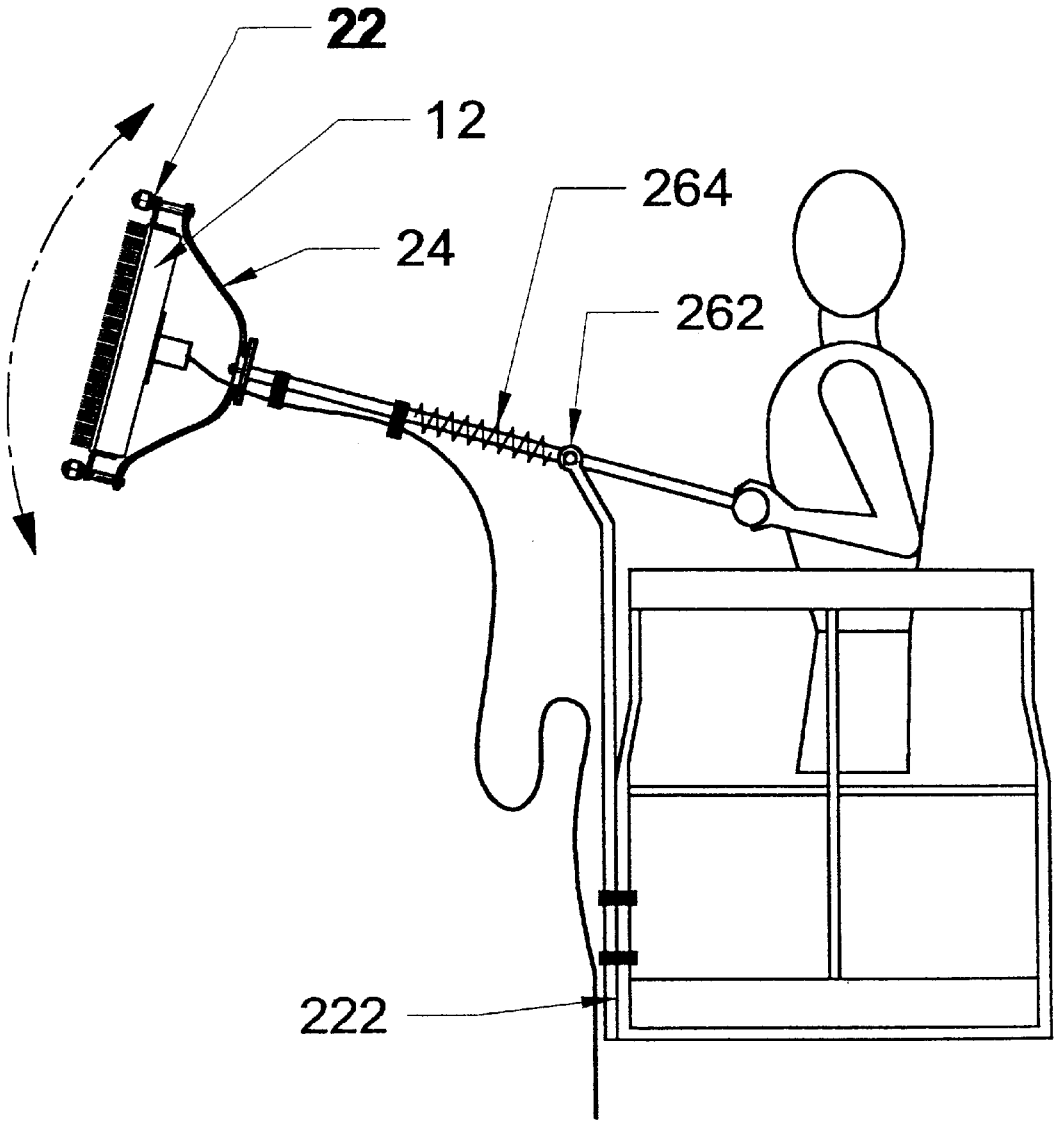
FIG. 34 is a side view of the apparatus of FIG. 32 with a support arm mounted to the work platform and a compression spring or other practical means arm biasing the rotary spray unit towards the surface being treated.

The surface treating apparatus of the present invention may be used by an operator using a single rotary spray unit, a dual rotary spray unit, or a multi-rotary spray unit without requiring secondary framework positioning means. Such an apparatus is preferably constructed to be sufficiently light weight to be easily controlled by an operator. FIGS. 29 and 30 show the present invention as hand operated and having dual rotary spray units in communication with a panel frame member. FIGS. 33 and 34 shows the present invention as hand operated and having a single rotary spray unit. In the illustrations the operator of the dual unit is standing on the ground. This is merely an illustration and not a limitation. The dual unit may be coupled in a fashion similar to FIG. 1 and operated by an operator positioned on a platform supported by a boom.

In FIGS. 33 and 34 the single unit is operated from a work platform. This Figure is merely illustrative and not a limitation. The single unit may be operated from the ground as shown in FIGS. 29 and 30 or multiple units.

In FIGS. 29 and 30 the apparatus is operated from a cart 229 with a telescoping arm. The telescoping arm 250 is rotated about a pivot system 252 for horizontal and vertical movement. The rotary spray units of this embodiment are mounted to the framework 174 in the manner taught in FIGS. 1–4 and 70C. The secondary positioning means and the secondary resilient means maintain the rotary spray units against the surface to be cleaned.

In FIGS. 33 and 34 the apparatus is operated from the work platform and can be elevated with the boom. Further in FIG. 33, the single unit is controlled with a support arm 258 support by an overhead support frame 260. In FIG. 34 the support arm is positioned on a pivot mount 262 clamped onto the work platform. The support arm has a spring compression 264 which functions in a fashion like the air logic system of the larger apparatus.

Figure 70C:
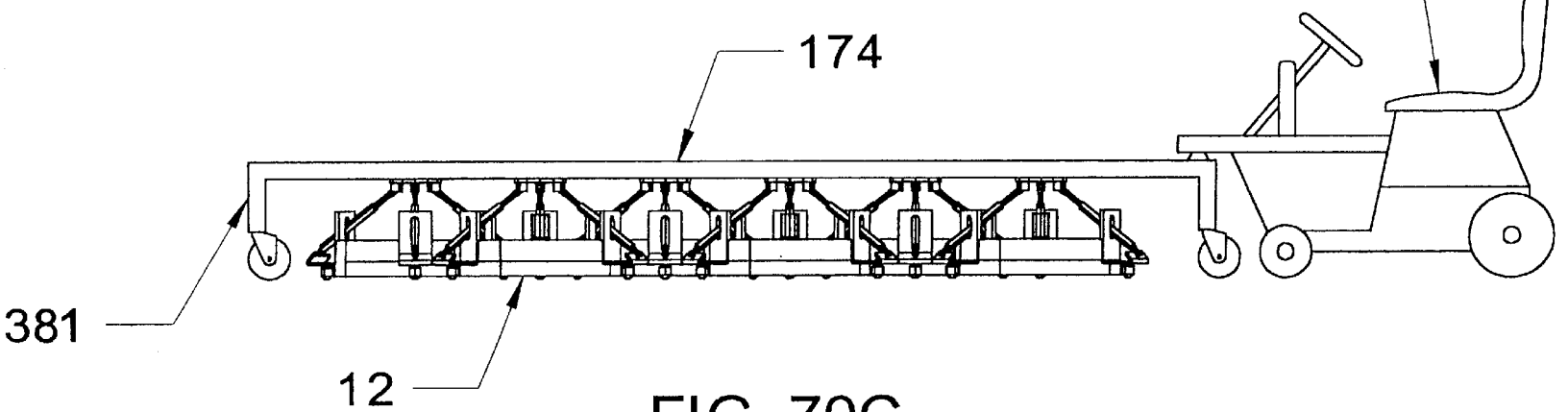
FIG. 70C is a side view of the plurality of rotary spray units propelled by another embodiment of a drive means should be side mounted.

In FIGS. 70C and 70D the rotary spray units are not mounted to the primary positioning means. The rotary spray units are propelled by a drive means 388. In FIG. 70B a handle 387 is attached to the framework outrigger combination. The drive means is a motorized rigger end. In FIG. 70C the framework of the rotary spray units is coupled with a motorized cart similar to a golf cart and may be attached in any desired position.

Dual Action Embodiment

Figure 35:
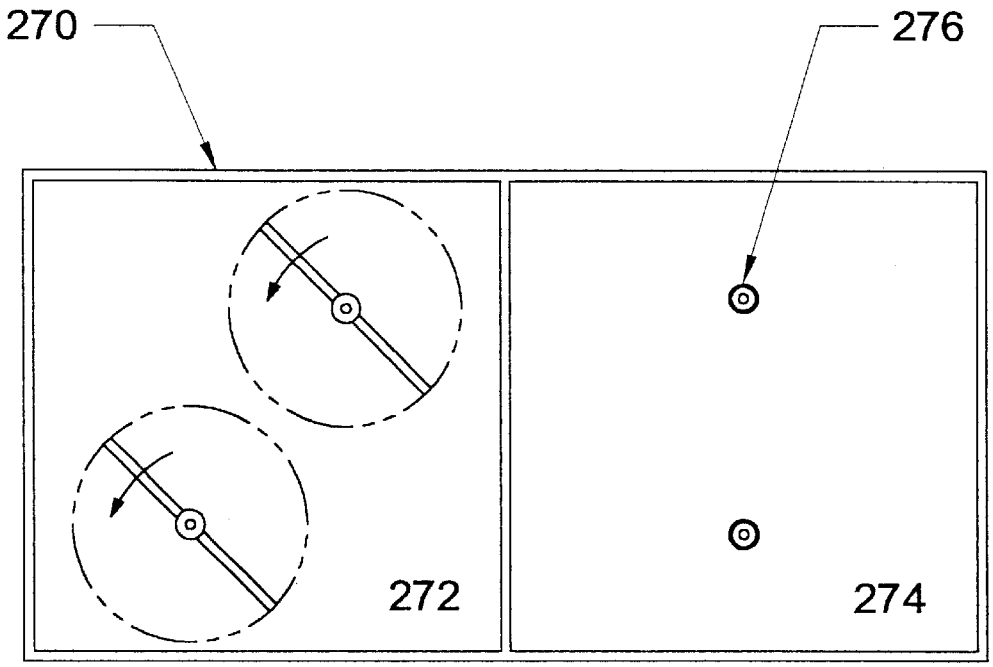
FIG. 35 is a bottom view of the apparatus having a oscillating sand blasting nozzles sweep in cooperation with dual rotary spray units.
Figure 36:
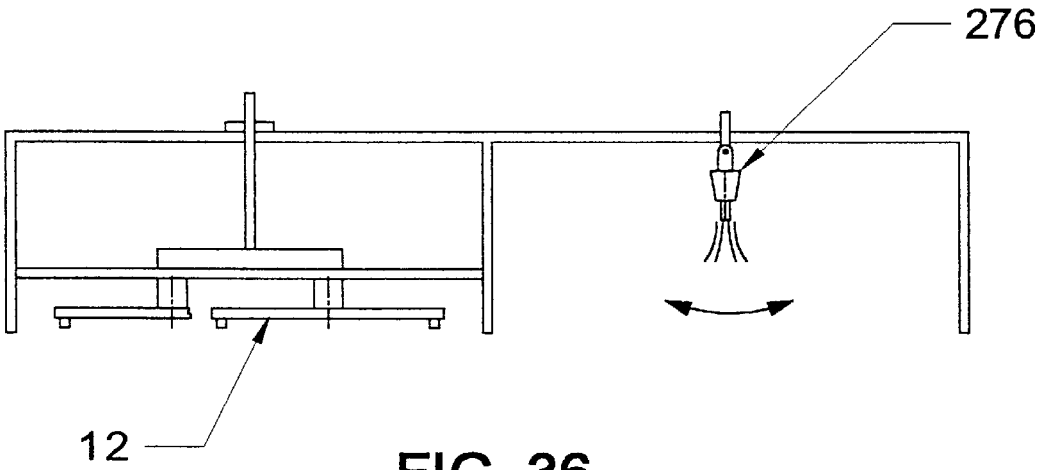
FIG. 36 is a side view of the apparatus of FIG. 35 showing an oscillating nozzle on the right side.

FIGS. 35 and 36 disclose the apparatus having a dual action systems 270 coupled to a single frame for sand sweeping and pressure washing. The dual action system has a first compartment 272 housing a pair of rotary spray units 12. A second compartment 274 is included. The second compartment has a sand delivery system 276. In the case of providing both sanding and washing, it is recommended that sanding precedes washing, in order to prevent wetting of the sand. That is, if the sand contacts a wet surface, the sand becomes wet and difficult to manage over time.

Recovery and Recycle Means

Figure 80:
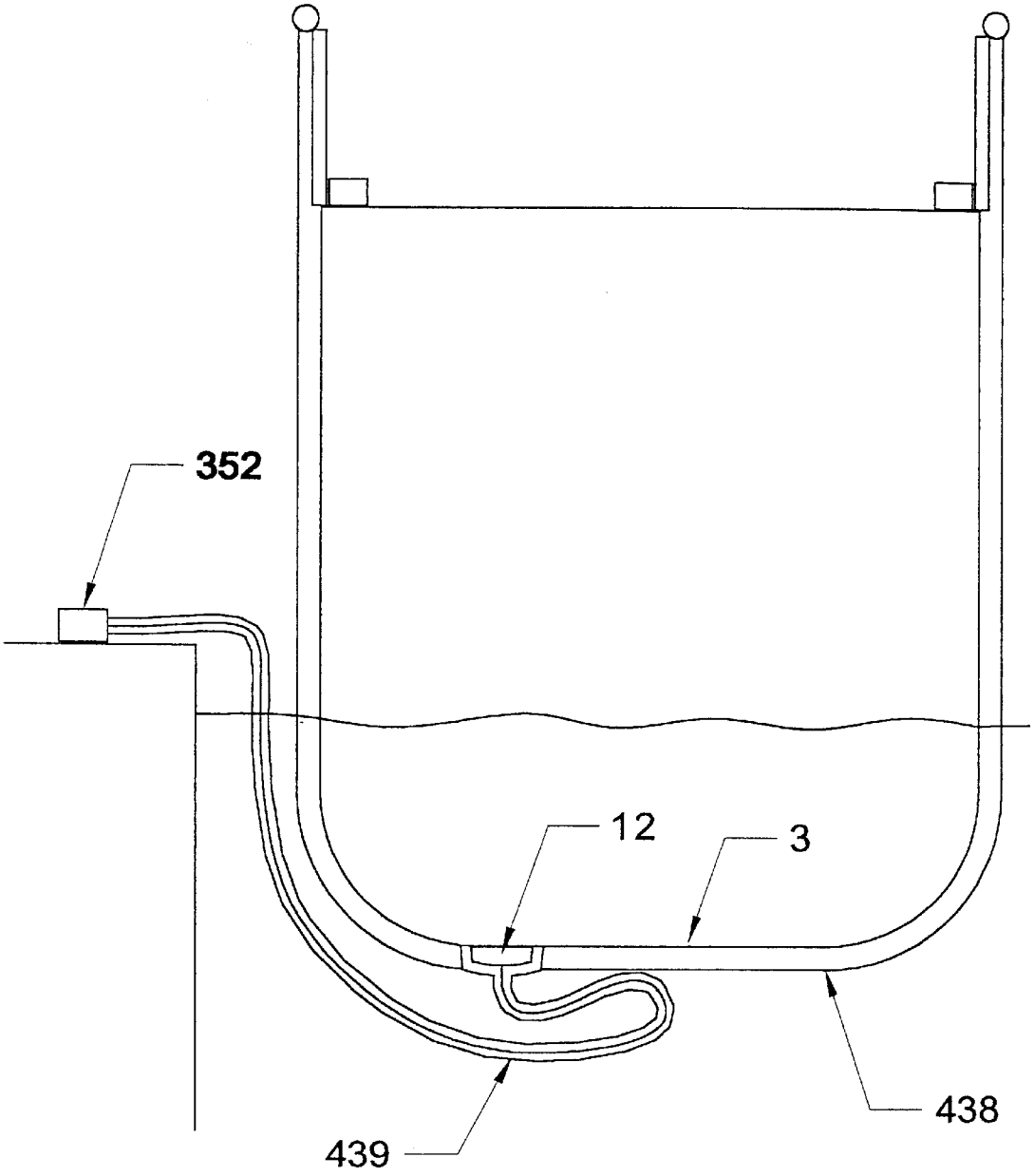
FIG. 80 is a side view of an individual rotary spray unit having a vacuum recycling system operable coupled thereto.
Figure 81:
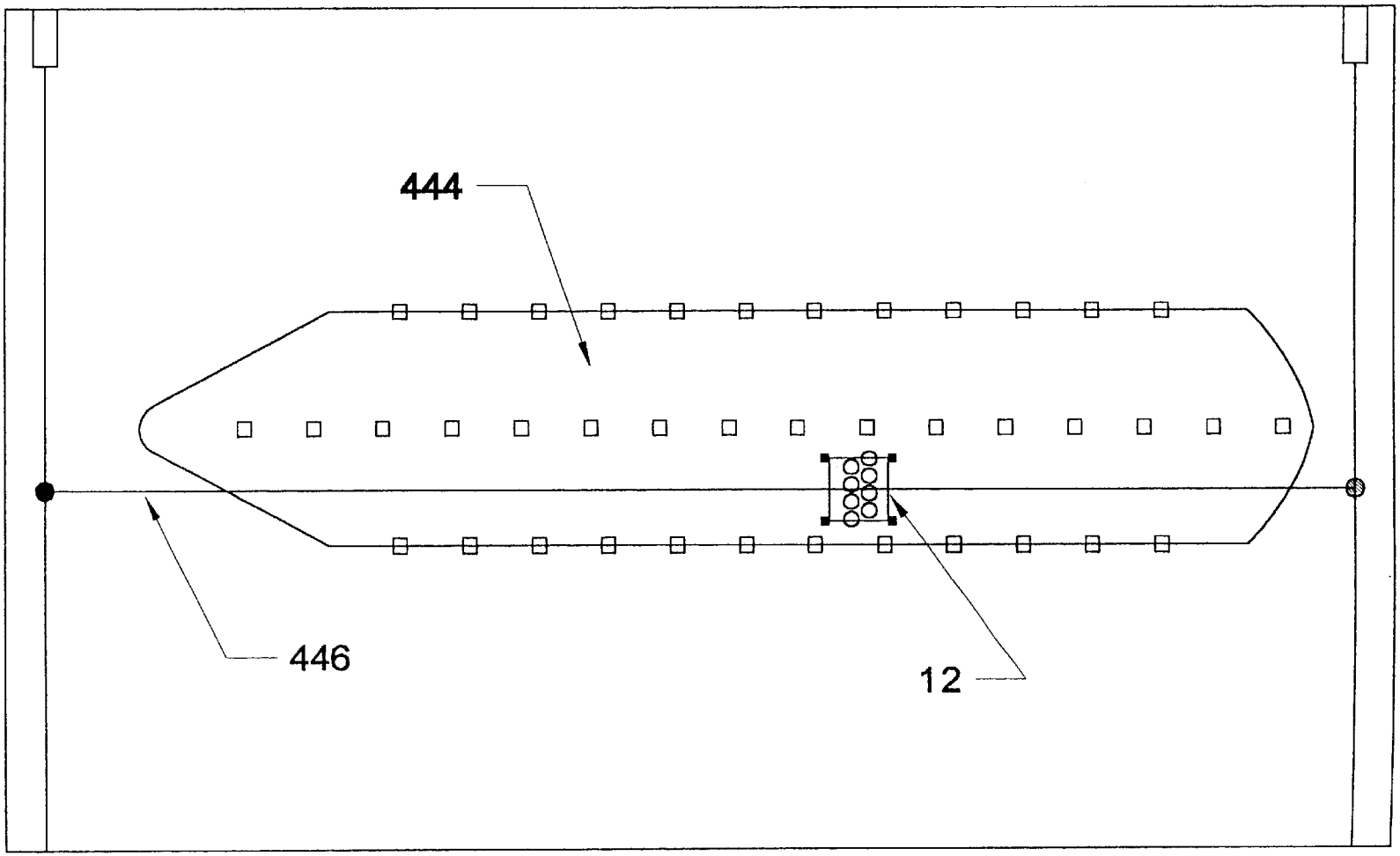
FIG. 81 is a bottom view of a ship hull showing a surface treating apparatus having a plurality of rotary spray units treating the surface and drive means.

The high pressure surface treating unit preferably includes a return conduit, the inlet ends of which are in communication with each rotary spray unit housing or the collective high pressure surface treatment apparatus housing, the discharge end (s) of which is connected to a vacuum source or pump or gravity. FIGS. 7, 9, 11, 12, 15, 16 and 29–32 show the flexible hose 14*a* that serves as the conduit, as does FIG. 80. Further, teaching of the recovery and recycle means is found in FIG. 69 and associated text. As shown, a vacuum collector 352 is attached to the framework. The vacuum collector has a series of suction ports 354 that will couple with the vacuum ports 356 of the housing 20. This vacuum source evacuates the space between each rotary spray unit and the surface being treated at a rate greater than the rate at which the high pressure surface treatment fluid, such as high pressure water or high pressure air and grit, is introduced into the space.

The return conduit or the vacuum source are preferably also associated with means for separating material removed from the surface being treated, such as anti-fouling paint or rust, from the pressure treating fluid. This permits the high pressure treatment fluid to be recycled and reused. Means for recovering and recycling surface treatment materials are well known to those working in this art, and need not be described herein in great detail.

Finally, the vacuum collector or the present invention is highly useful under water when treating the surface of a ship hull. Specifically, in FIG. 80, a single rotary spray unit is positioned against the ship hull under water. In this instance the rotary spray unit is guided in a "keel-haul" manner by a cable 438. Also, shown extending from the rotary spray unit is a hose 438 leading into the vacuum collector 352 on the dock. This system allows the hull to be treated while the ship is still in the water, and the waste byproduct to be suctioned into a container on the dock.

Operation

The manner in which to operate the surface treating apparatus of the present invention will be intuitively simple to one of ordinary skill in the art once provided with the inventive apparatus. The multi-rotary spray unit apparatuses of FIGS. 1–5, 13–20, 68–69, 70, 71 and 72 provide the following performance. Calculations are based on using a gang of six rotary spray units, each rotary spray unit using one rotor arm with two nozzles on opposite sides of the rotary union. The apparatus measures 3 feet×8 feet thus having a 24 sq. ft footprint. Each rotary spray unit operates at 4,000 to 5,000 psi, and a flow rate of 4 GPM per rotary union. The rotor arms rotate at 1,500 to 2,000 rpm. Such an apparatus treats 25,000 to 40,000 square feet per hour using 1,700 gallons of fluid. The present invention, with the maximum number of rotary spray units can treat up to 40,000 square feet of surface area per hour. The dimensions GPM and PSI of the apparatus and the length of rotor arm can be changed to suit various treatment needs.

It is understood that by changing the size of the unit or length of the arm, or by increasing or decreasing the number of rotary spray units, the operating performance will change proportionally. Likewise changing operating parameters will have a proportioned impact on the operating performance. Also panels of rotary spray units can be linked together to proportionally increase the operating performance.

The present invention can be lifted and positioned next to the surface using conventional means so as to treat the top, bottom and sides of structures like ships and tanks. For example, a cable can be attached to the bracket system of FIG. 1 such that a crane or scaffolding can hoist the invention up against the hull of a ship or other structure. Any structure used to hoist the invention should be properly coated so as not to score the treated surface.

Furthermore, the present invention can be moved along the bottom 444 of the hull of the ship. The movement of the plurality of rotary spay units with the framework in controlled by pulling the cart support along a cable 446. The cable is attached to the inside walls of the dry dock by means of a turnbuckle 448 or other tightening means cable of supporting the cart with the plurality of rotary spray units.

Various control systems can be used to automatically maneuver the apparatus along the surface. With an automatic maneuvering system, it is not necessary that a human ride along with the apparatus as it maneuvers along a surface. For example, an electronic marking system, in conjunction with an electronic sensor of the positioning means, can be used to maneuver the apparatus so that there are no streaks of untreated surface. The electronic marking system can position the apparatus precisely so that the area covered by the spray path in a first swipe abuts the area covered by the spray path in a second swipe. Other systems, including laser-marking systems, can be used. The apparatus can also be maneuvered by manual control, wherein any automatic control system for maneuvering has an override mechanism to convert to manual control.

Also not shown in FIG. 1 is conventional recycling equipment that works with the vacuum collector 352. Such recycling equipment should include the separation of impacted material removed from the surface from any abrasive so that the abrasive can be reused. Recycling of abrasive steel grit or steel shot can provide significant cost savings. In addition, the treatment fluid, such as water, can be recycled as well, thus reducing the amount of hazardous waste created during the treatment process. Such a recycling means is well known in the prior art. For example, such recycling means is contained in U.S. Pat. 5,309,683 and U.S. Pat. 5,628,271 herein incorporated by reference.

Additionally, the present invention can be equipped with a means to selectively turn rotary spray units on and off as necessary so that problem areas can be treated without over-treating areas that would be covered by the apparatus at the same time.

Alternative Surface Treating Means

Although the invention has been described above using rotating wands as the primary example of surface treating means, it is of course possible to have alternative treating means, such as spray nozzles attached to the end of a mechanical arm which pivots back and forth in the manner of a windshield wiper. Alternatively, the nozzle tips can be caused to be rhythmically aimed from side to side as the surface treating device is moved along over an area. The main consideration is that the entire surface over which the treatment unit passes must be subject to treatment, and this coverage is the sum of the travel of the surface treatment unit as a whole along the treatment path plus the radial coverage of the individual nozzles or treatment units widthwise along the treatment path.

Figure 42:
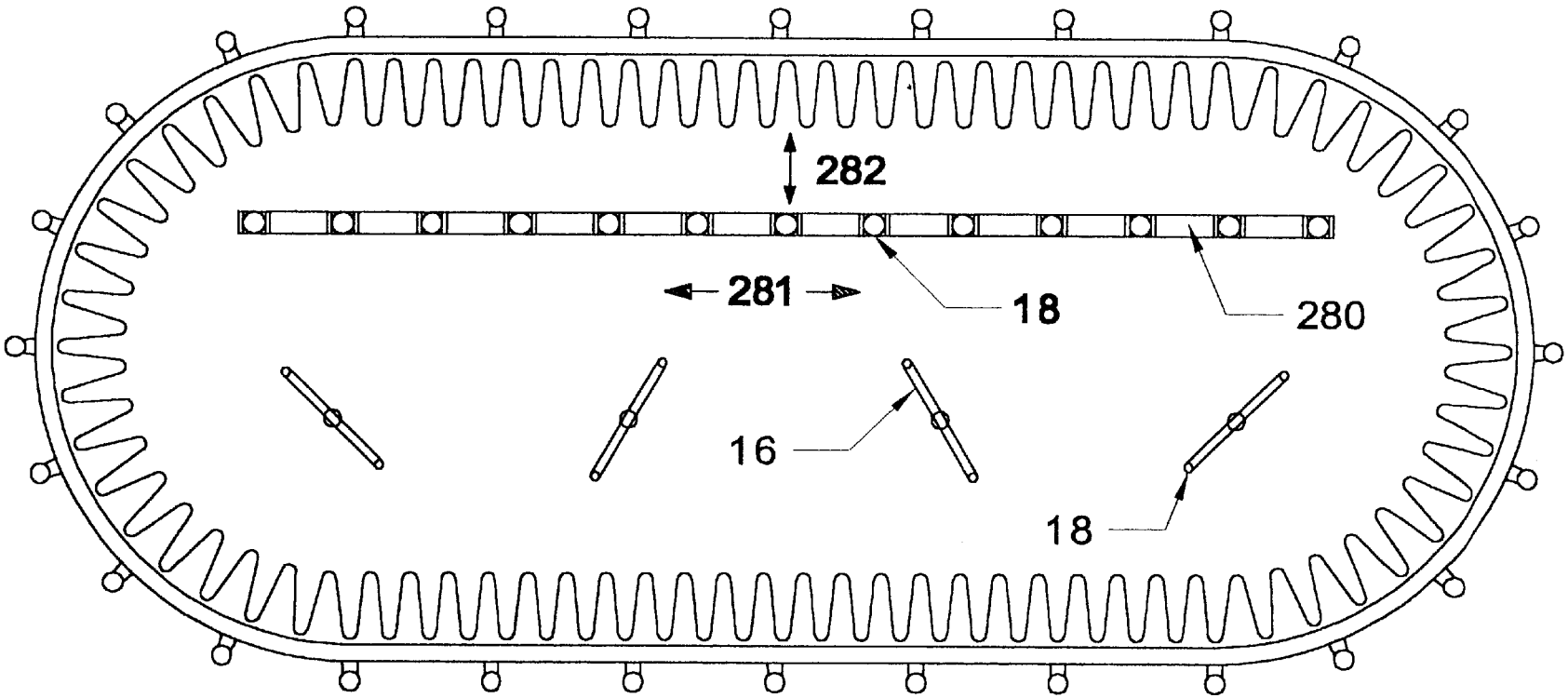
FIG. 42 is a bottom view of gang housing with rotary arms and with fixed nozzles positioned along a straight line.

Further yet, rather than being provided on the ends of rotating arms, nozzles may be positioned along a straight line along a common manifold, as shown in FIG. 42. Nozzles 18 are provided on a common manifold 280, which may be formed of an elastic material such as rubber and thus able to conform to the contour of the surface being treated, or may be made of a rigid material such as stainless steel and provided with links or flexible couplings to provide articulation. The nozzles must provide a spray pattern, which, in combination with the movement of the surface treatment device over the surface being treated, essentially treats the entire surface targeted for treatment. This can be done by providing sufficient nozzles, or by providing a sufficiently wide spray pattern in the nozzles, such that the combination of all static nozzles cover the entire width of the swath to be treated. Alternatively, the multiple nozzles may be caused to oscillate by moving the entire manifold, with fixed nozzles, in a direction 281 perpendicularly to the path or direction of travel 282 of the surface treatment device, covering a distance equal to the interval between the equally spaced nozzles. Further yet, the manifold may remain stationary, and the nozzles can be caused to oscillate or pivot from side to side, as described for example in U.S. Pat. No. 5,685,767 (Burds) which teaches a blasting machine with an oscillating blast nozzle, such that the side-to-side pivoting of the nozzles in combination with the forward movement of the treatment device over the surface being treated covers the entire area intended for treatment. One such linear manifold with multiple nozzles may be used alone, or such a linear manifold with multiple nozzles may be used in combination with rotary sprayers as described above.

Figure 43:
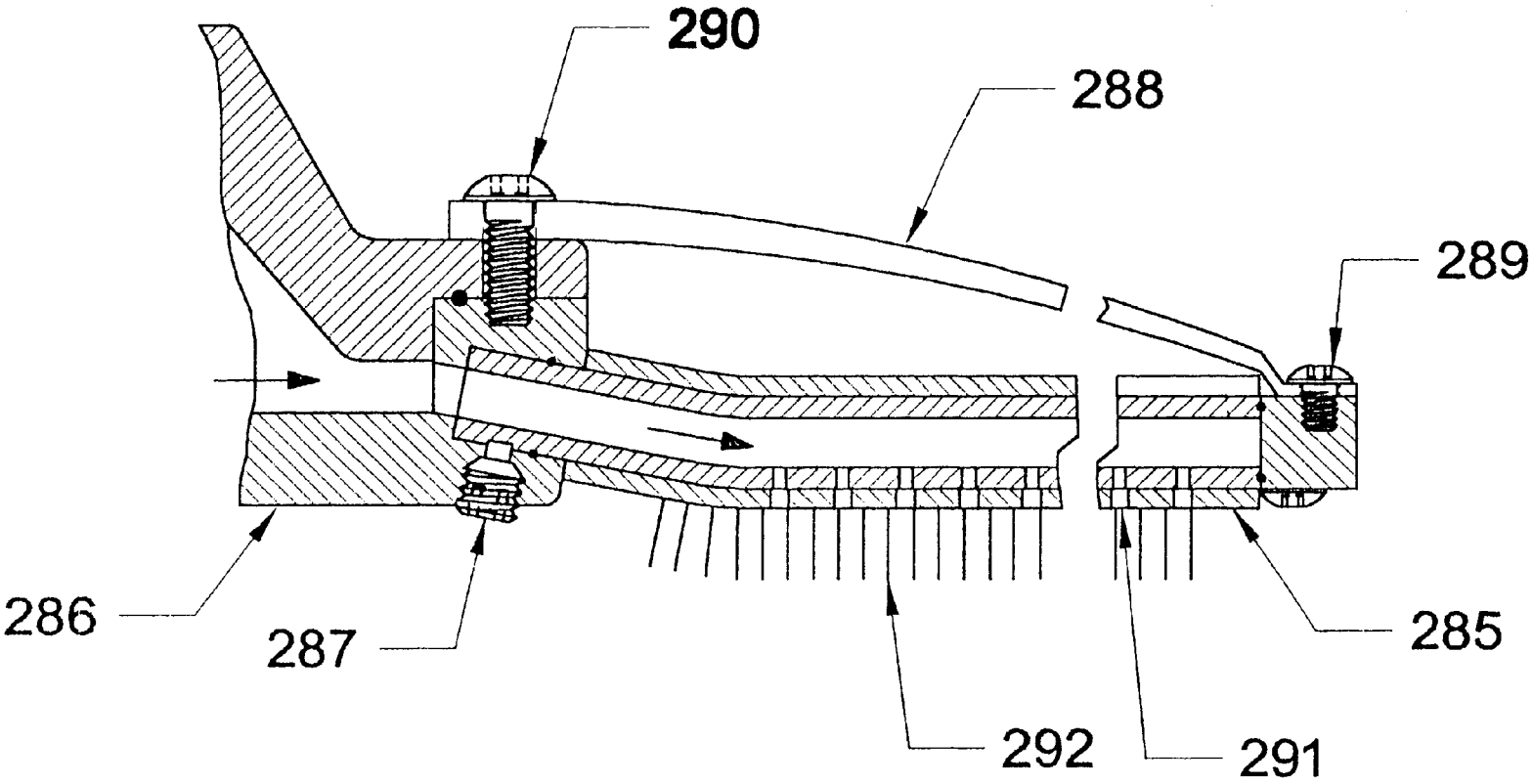
FIG. 43 is a cross-sectional side view wherein the rotary arm of FIG. 42 is replaced with rotary arms having bristles.
Figures 44, 45, 46, 47:
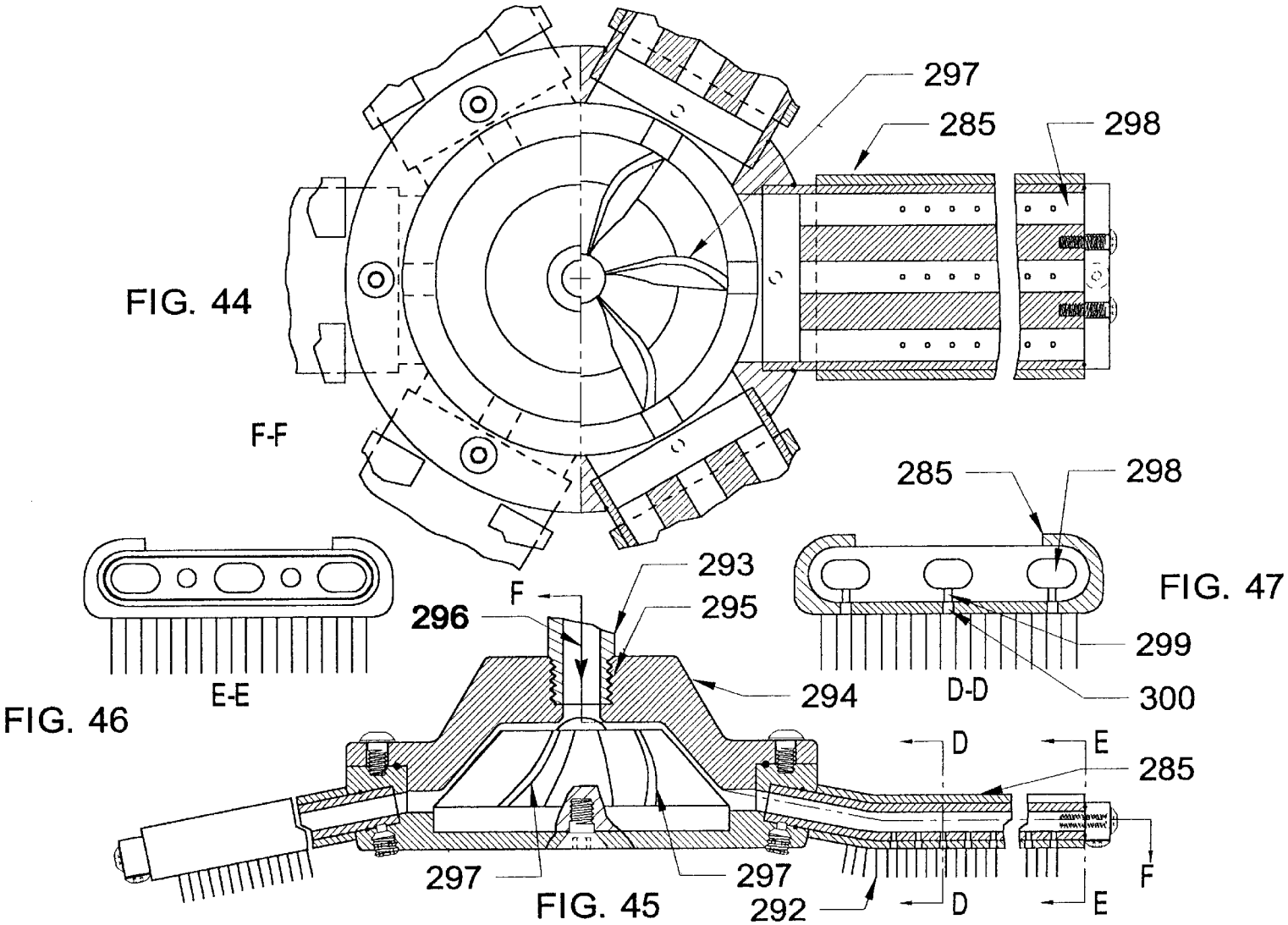
FIG. 44 is a cut-away bottom view of a rotary union showing the impeller blades.
FIG. 45 is a cross-sectional side view of the rotary union of FIG. 44.
FIG. 46 is a cross-sectional end view of the rotary arm taken along lines E—E of FIG. 45.
FIG. 47 is a cross-sectional medial view of the rotary arm taken along lines D—D of FIG. 45.

As an alternative to sand blasting, high pressure fluid treatment, or shot peening, it is possible to accomplish surface treatment using rotating brushes. One such device can be made by simply removing the arms of the above-described rotating spray units and inserting in their place arms provided with plastic or metallic bristles. One such brush arm is shown in FIG. 43. For simplicity, the ball bearings, seals, etc. of the rotary union, which are shown in previous drawings, have been omitted. Brush arm 285 is introduced into a recess in rotary union 286, and is held in place by releasable fastening means 287. Arm 285 may be constructed of a rigid material such as metal or a composite material, or may be made of a material, which provides an amount of flexibility, such as PVC tubing. In the case that the arm is flexible, a degree of rigidity may be imparted by providing a spring such as a leaf spring 288, which may be made of carbon fiber or the like, and which may be attached at one end to the rotary union 286 and at the other end to the distal end of the arm 285 via releasable fastening means such as screws 289, 290. The brush arm is provided with a number of apertures 291, which serve to provide rinsing water to the bristles 292. Cleaning of the surface is accomplished by mechanical action of the bristles of the rotating brush over the surface being treated. Rotation may be accomplished by electric, pneumatic, or hydraulic pump. In the case that the rotational motivation is provided by the same hydraulic fluid as used for rinsing, the pump which converts pressure to rotation may be located inside the rotary union, as shown in FIGS. 44–47. Water supply conduit 293 is connected to rotary union 294 and via threading 295 and supplies water under pressure to rotary union 294. As the water changes direction from supply direction 296 to the radially outward direction the water impinges upon impeller blades 297 which are fixed to the rotary arms 285. The force of the water on the impeller blades causes the rotary arms to rotate. As the arms 285 rotate, bristles 292 scour the surface and loosen materials. Water leaving the impellers travels down radial conduits 298 to outlet ports 299 and openings 300 from which water is emitted to the bristles and towards the surface being treated. The water volume is sufficient to rinse away surface material and prevent buildup of removed materials.

Figure 49:
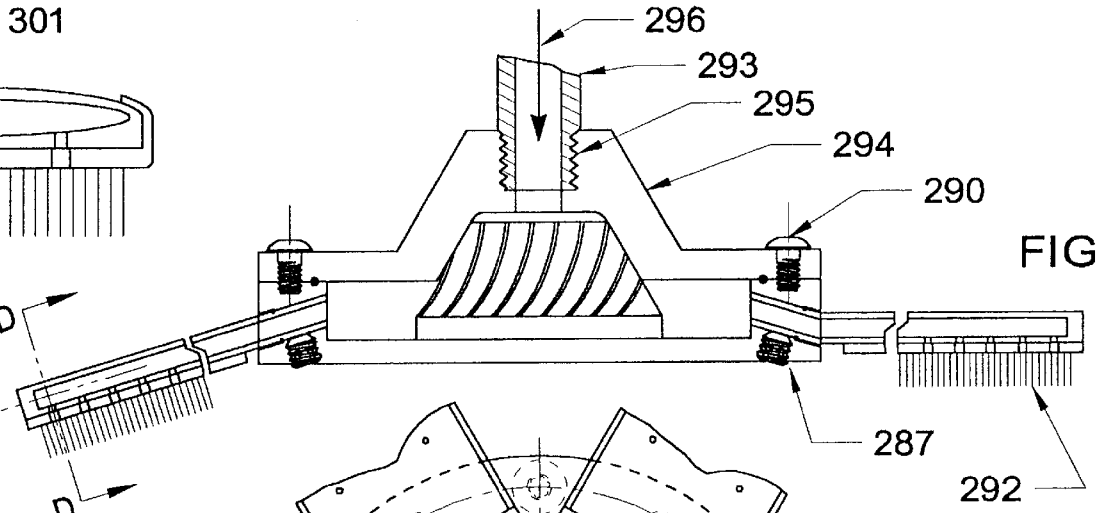
FIG. 49 is a side view of a brush arm showing the fluid passages within the brush arm.
Figure 48:
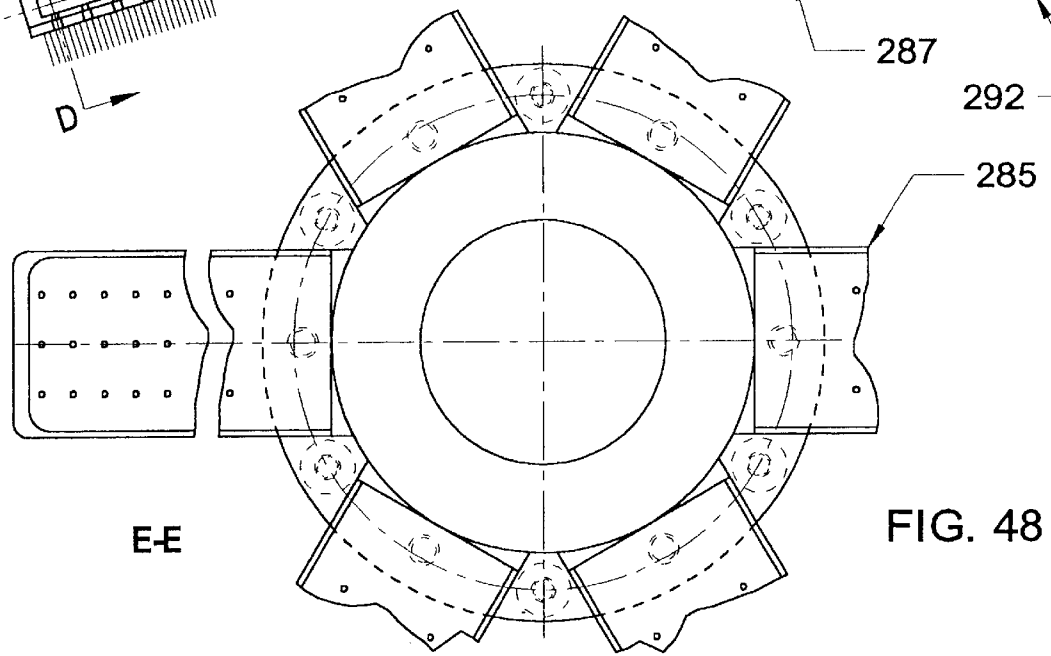
FIG. 48 is a top cut-away view showing six brush arms in symmetrical alignment.
Figure 50:
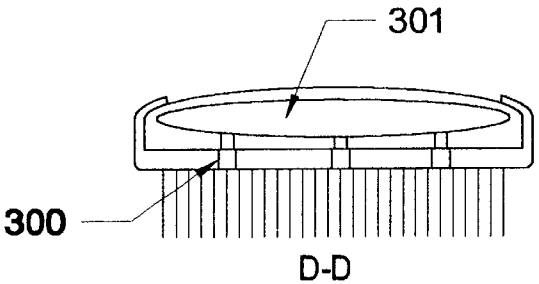
FIG. 50 is an enlarged cross-sectional view of the brush arm.

FIGS. 48–50 show that six brush arms 285 may be arranged in a symmetrical pattern radiating outward from a common rotary union, and that the brush arms may be provided with one central conduit 301 which provides water to multiple openings 300.

Figure 51:
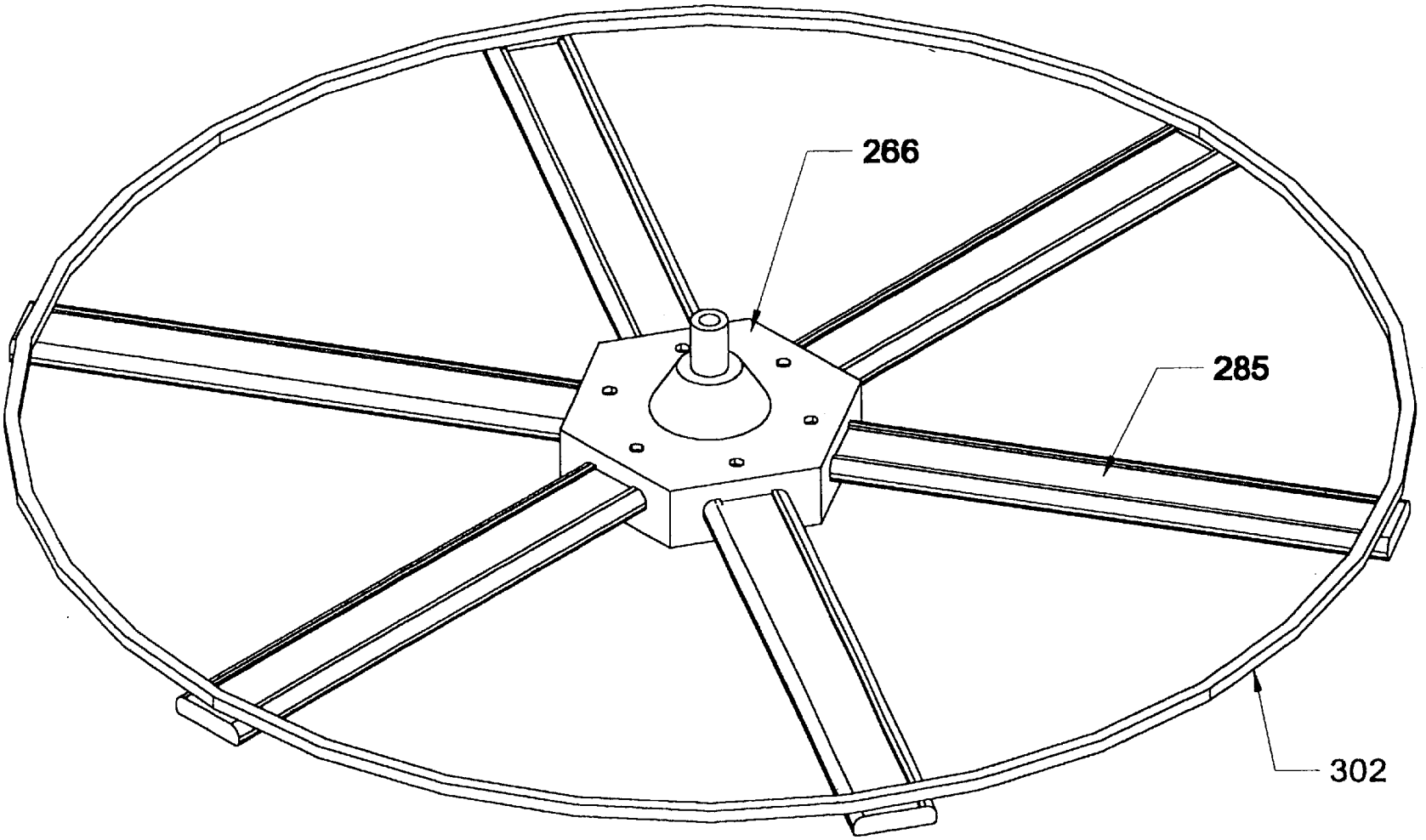
FIG. 51 is an perspective view of a brush arm support system.

FIG. 51 shows that increased dimensional stability can be provided to a rotary brush by connecting individual arms 285 to each other via a common annular reinforcing. or strengthening member 302. This member 302 prevents excess stress on the rotary arms in the area of the junction between the arms and the rotary union.

Figure 53:
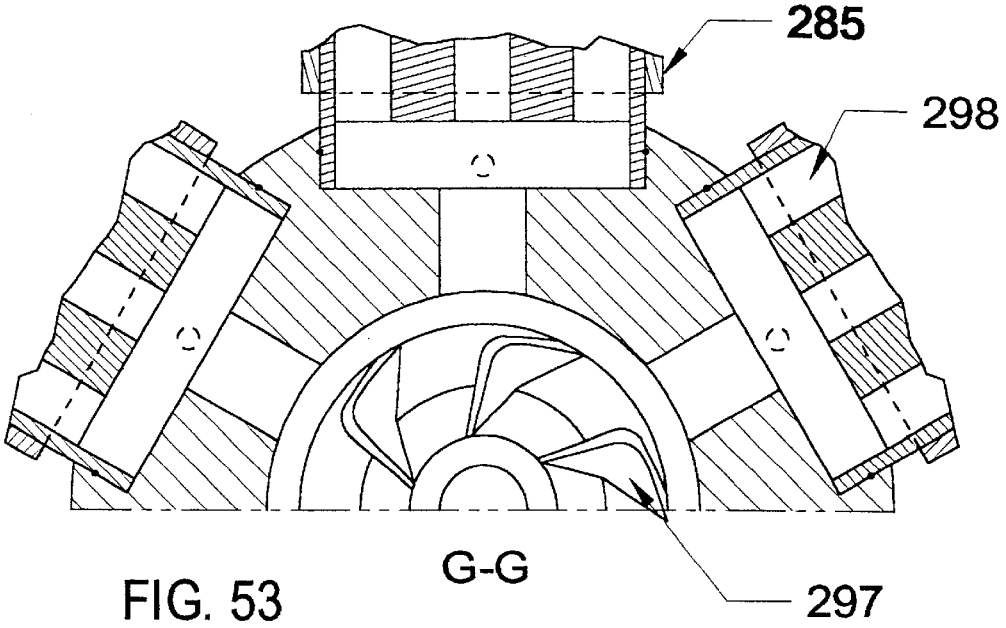
FIG. 53 is a bottom view showing the impeller of FIG. 52.

It may be desired to change the relationship between pressure, amount of water expended, and rotational speed of the rotary brush. This can be accomplished in a simple manner by changing the amount of clearance between the impeller blades 297 and the rotary union upper housing 309. As the gap 303 increases, the amount of bleed-by increases, and the conversion of water pressure to rotational force on the impeller is reduced. As the gap 303 decreases, the amount of bleed-by decreases, and the conversion of water pressure to rotational force on the impeller is increased. Changing the gap size can be accomplished by loosening retaining nut 306 and using a screwdriver in slot 305 to rotate retaining bolt 307. Rotating bolt 307 clockwise will cause it to move upwards against rotary union lower housing 308 and thereby move impeller shaft 307 upwards, decreasing clearance between impeller blades and rotary union upper housing 309. Rotating bolt 307 counterclockwise will cause it to move downwards against rotary union lower housing 308 and thereby move impeller shaft 307 downwards, increasing clearance between impeller blades and rotary union upper housing 309. FIG. 53 is a top view along line G—G of FIG. 52.

Figure 52:
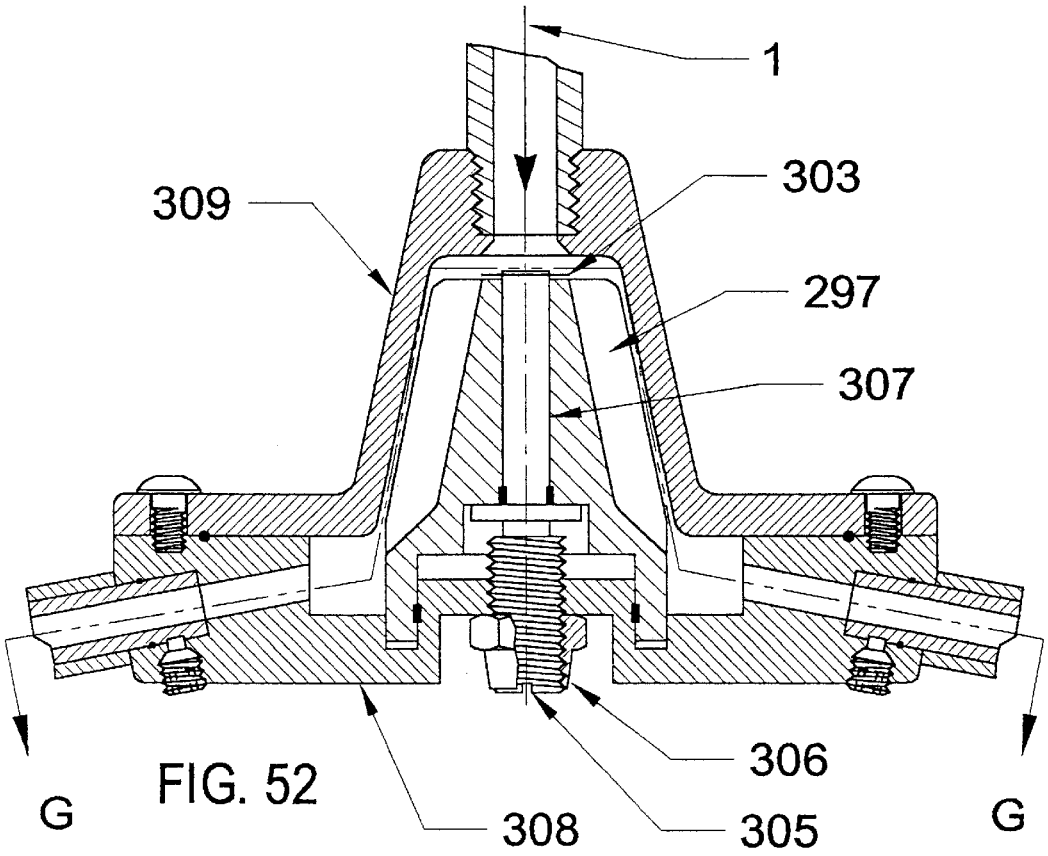
FIG. 52 is a cross-sectional view of another embodiment of a rotary union.
Figure 55:
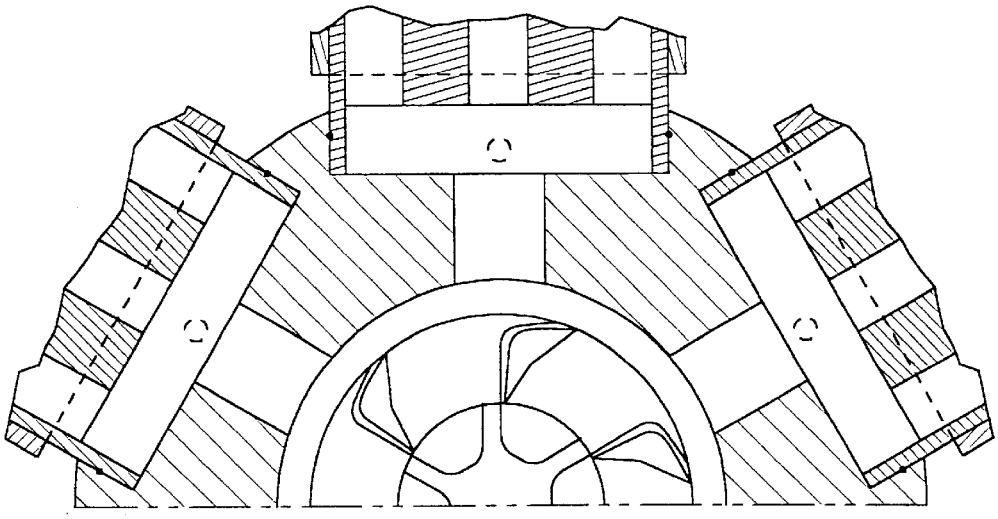
FIG. 55 is a bottom view showing the impeller of FIG. 54.
Figure 54:
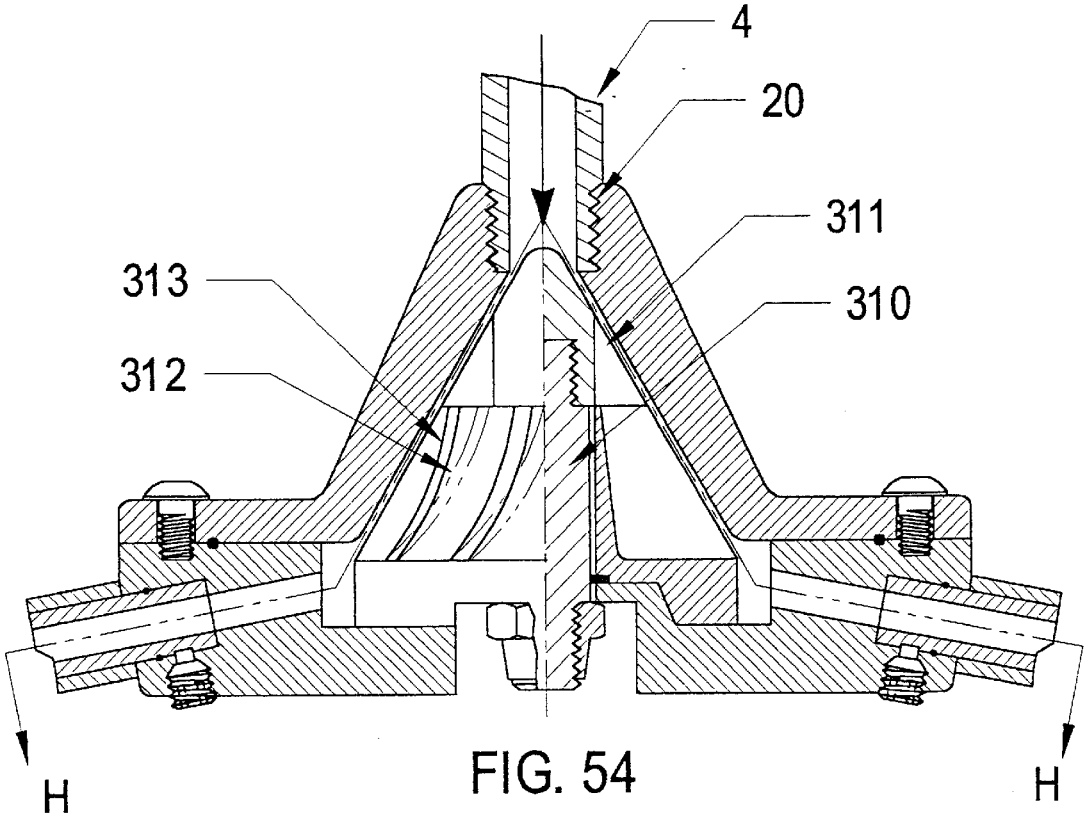
FIG. 54 is a cross-sectional view of yet another embodiment of a rotary union.

FIGS. 54 and 55 correspond substantially with FIGS. 52 and 53, except that the bolt 310 used to hold impeller 312 in place is provided on top with a first set of fins 311 which are fixed relative to rotating blades 313.

Figure 57:
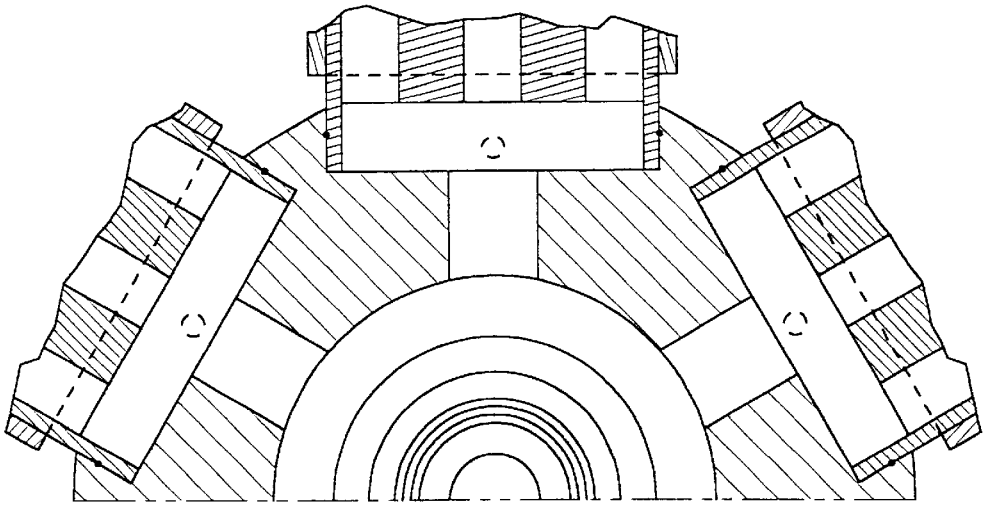
FIG. 57 is a bottom view showing the rotor of the rotary union of FIG. 56.
Figure 56:
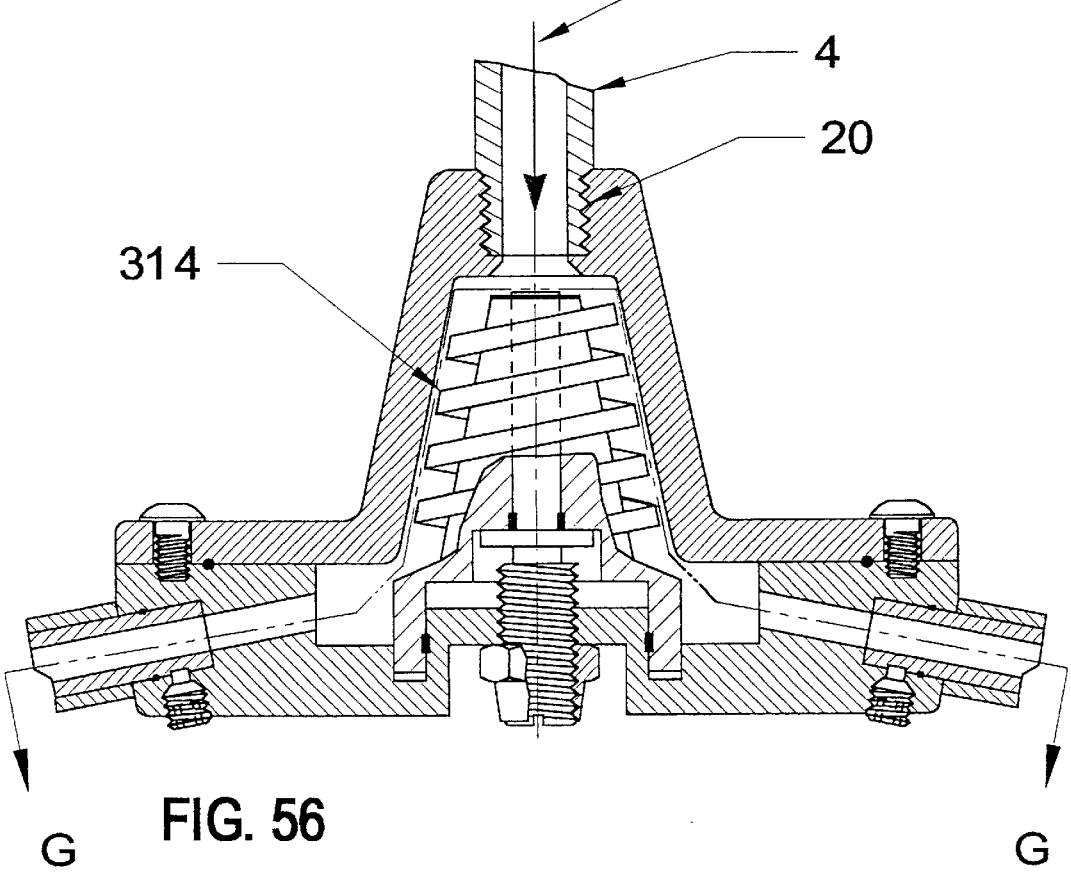
FIG. 56 is a cross-sectional view of still another embodiment of a rotary union.
Figure 59:
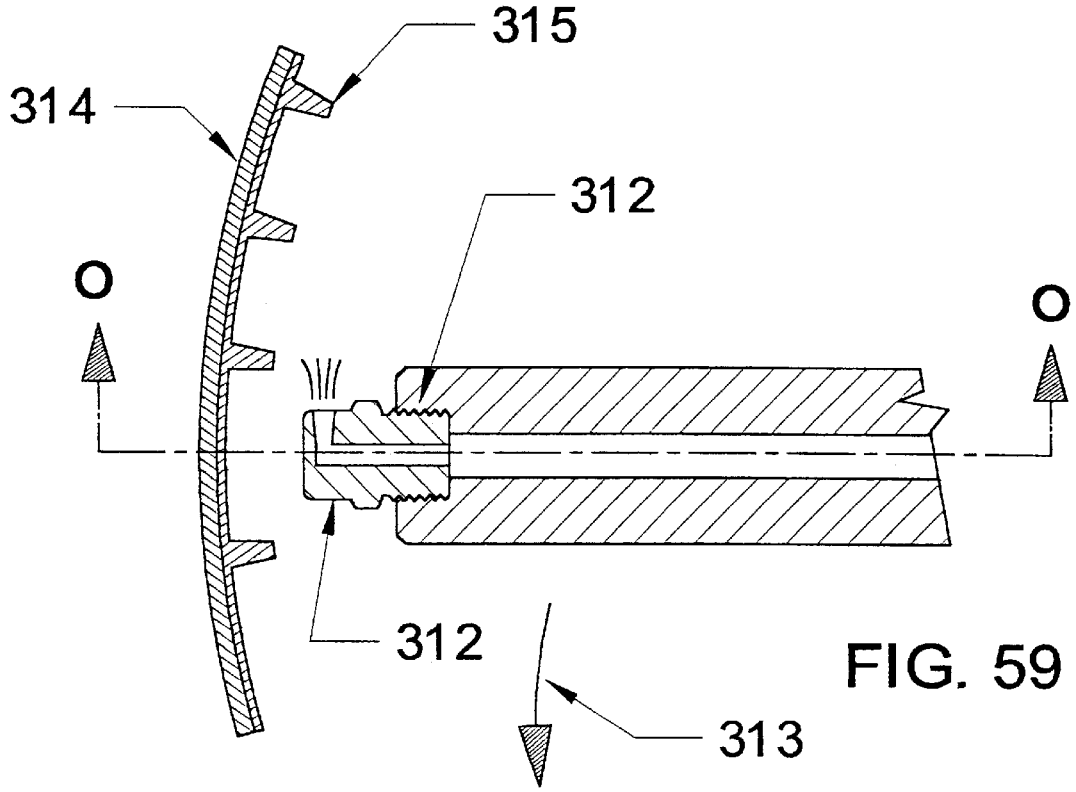
FIG. 59 is a cross-sectional view of a rotor arm of FIG. 58 with upwardly vertical propulsion nozzle.
Figure 58:
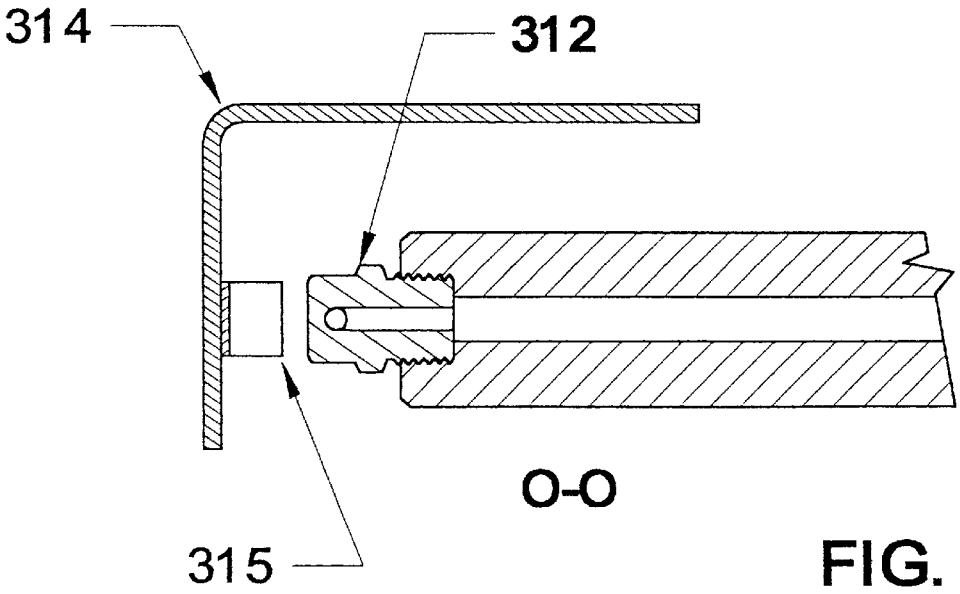
FIG. 58 is a cross-sectional view of a rotor arm with a horizontal propulsion nozzle.

FIGS. 56 and 57 correspond substantially with FIGS. 52 and 53, except that impeller blades 313 are replaced with serpentine or helical blade 314.

As discussed previously, rotational motivation may be imparted by directing the working nozzle at a slight angle to the surface being treated, or by providing an impeller inside the rotary union. An alternative, and possibly more efficient method of using water pressure to rotate arms is to provide at the outermost end of the rotary arm a propulsion nozzle 312 aimed in the direction opposite to the direction of desired travel 313. Preferably the inside of the housing 314 is provided with fins 315 which project inwardly towards the axis of rotation of the rotary junction, such that nozzle 312 can emit a jet which impinges on the fins 315 thus causing the nozzle by reaction to travel in the desired direction 313.

Figure 62:
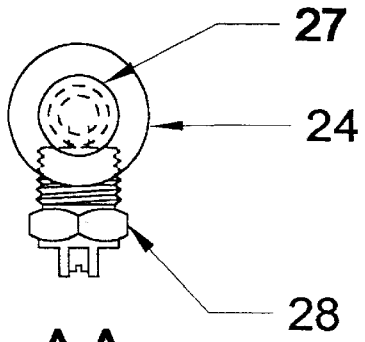
FIG. 62 is a frontal view of the end of the rotor arm taken along line A—A of FIG. 60.
Figure 61:
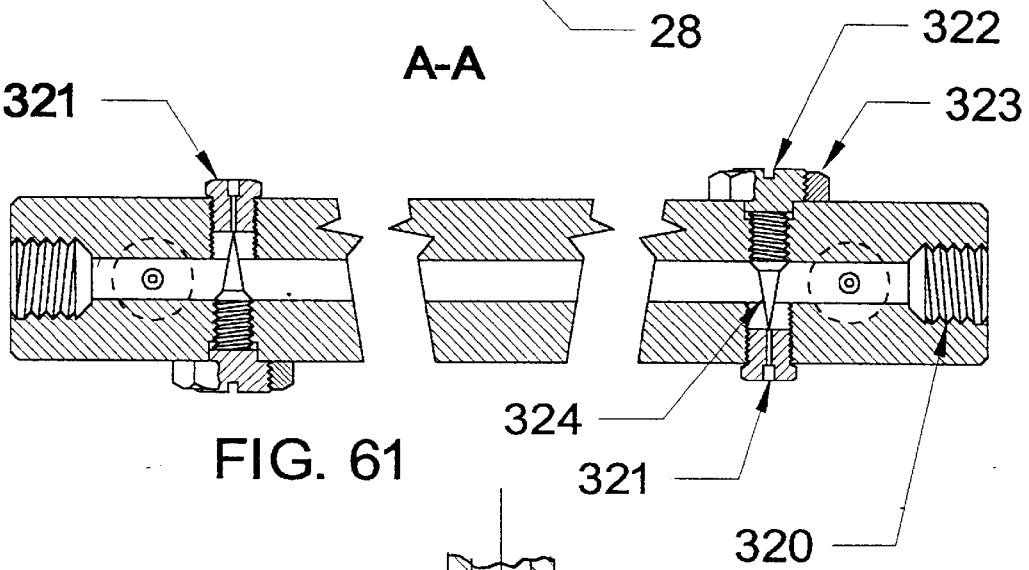
FIG. 61 is a cross-sectional view of the rotor arm with a second meter means.
Figure 60:
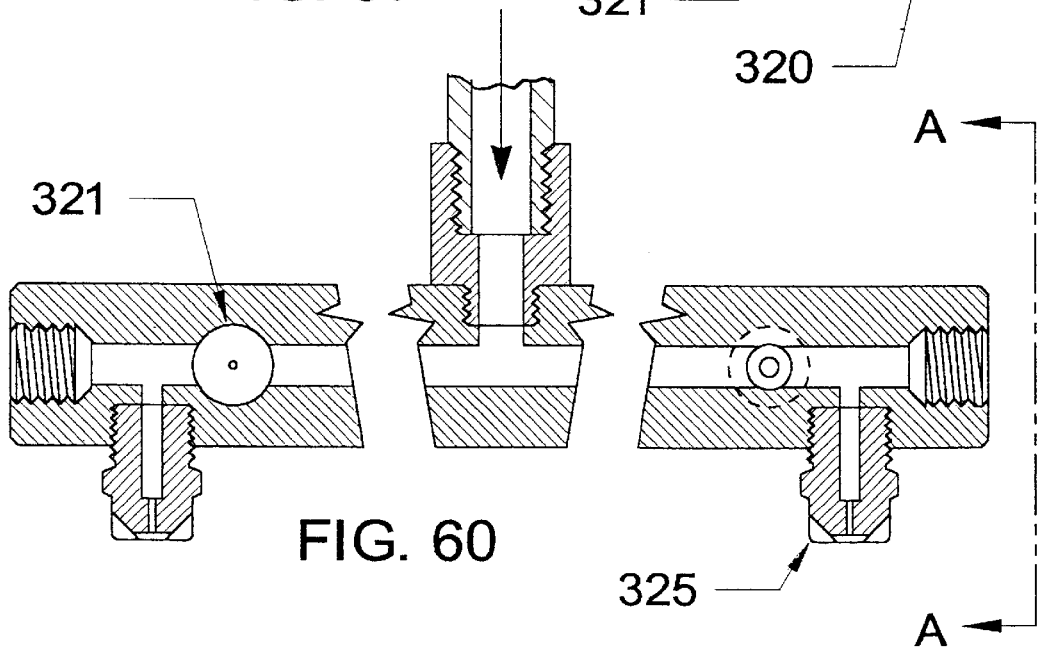
FIG. 60 is a cross-sectional view of the rotor arm with a first meter means for variable speed control.

FIGS. 60–62 show metering means for regulating the outflow of water or air from the driving nozzles. Rotary arms 320 are caused to rotate in reaction to the force of water or air expelled from nozzle 321. The flow of fluid out of nozzle 321 is metered by jet screw 322. Jet screw 322 can be rotated to increase or decrease the gap between needle 324 and nozzle 321. Cleaning is accomplished by scrubber nozzle 325.

Figures 63, 64:
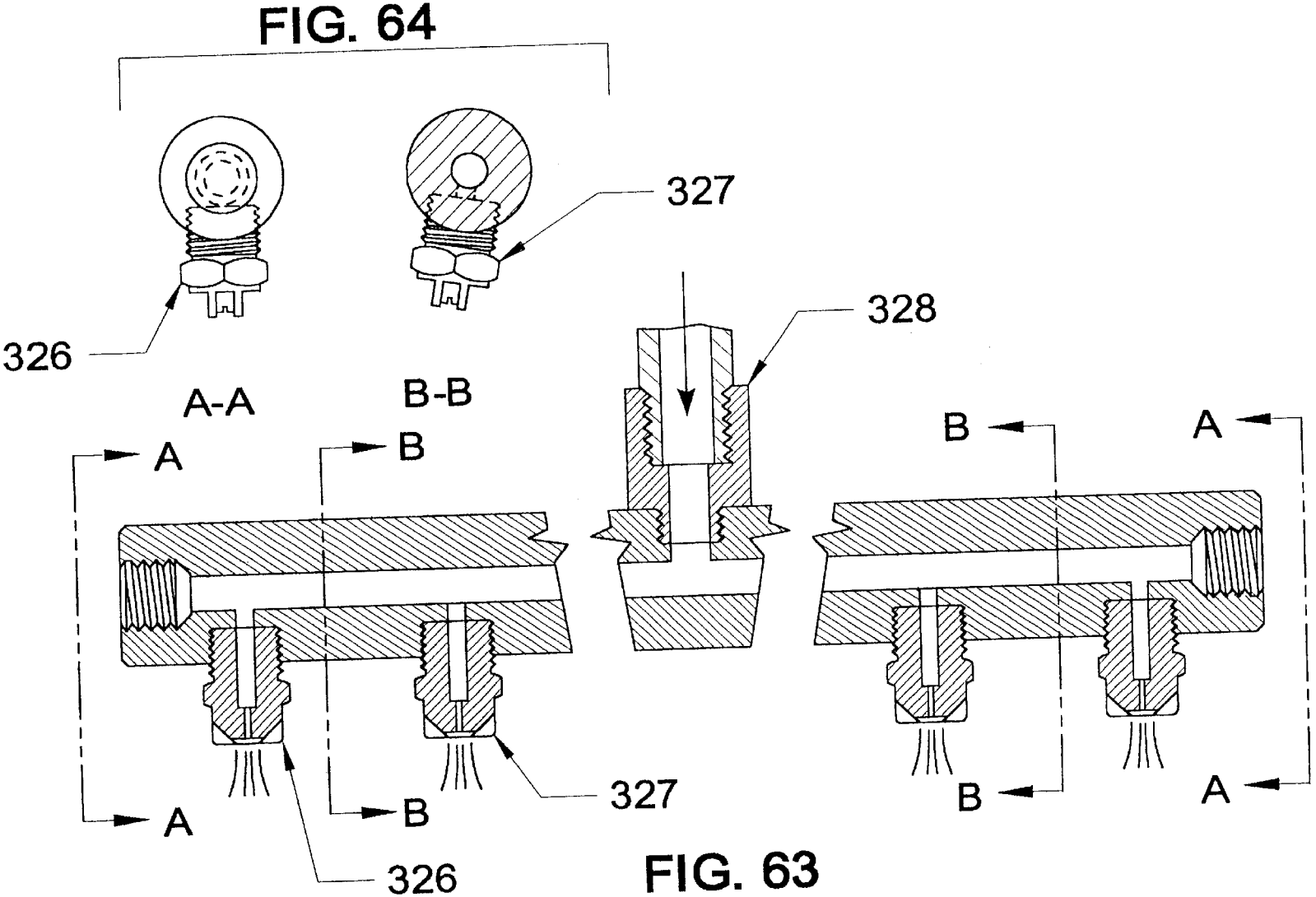
FIG. 63 is a cross-sectional view of the rotor arm with multiple nozzle attachments.
FIG. 64 is a cross-sectional frontal view of the rotor arm showing the multiple nozzles as having varied spray angles.

FIGS. 63 and 64 show a simplified high pressure fluid surface treating rotary arm with rotary union 328 and two sets of nozzles. Outer nozzles 326 are oriented perpendicularly to the work surface. Inner nozzles 327 are slightly tilted to thereby, by reaction, causing rotary arms to rotate.

Figure 65:
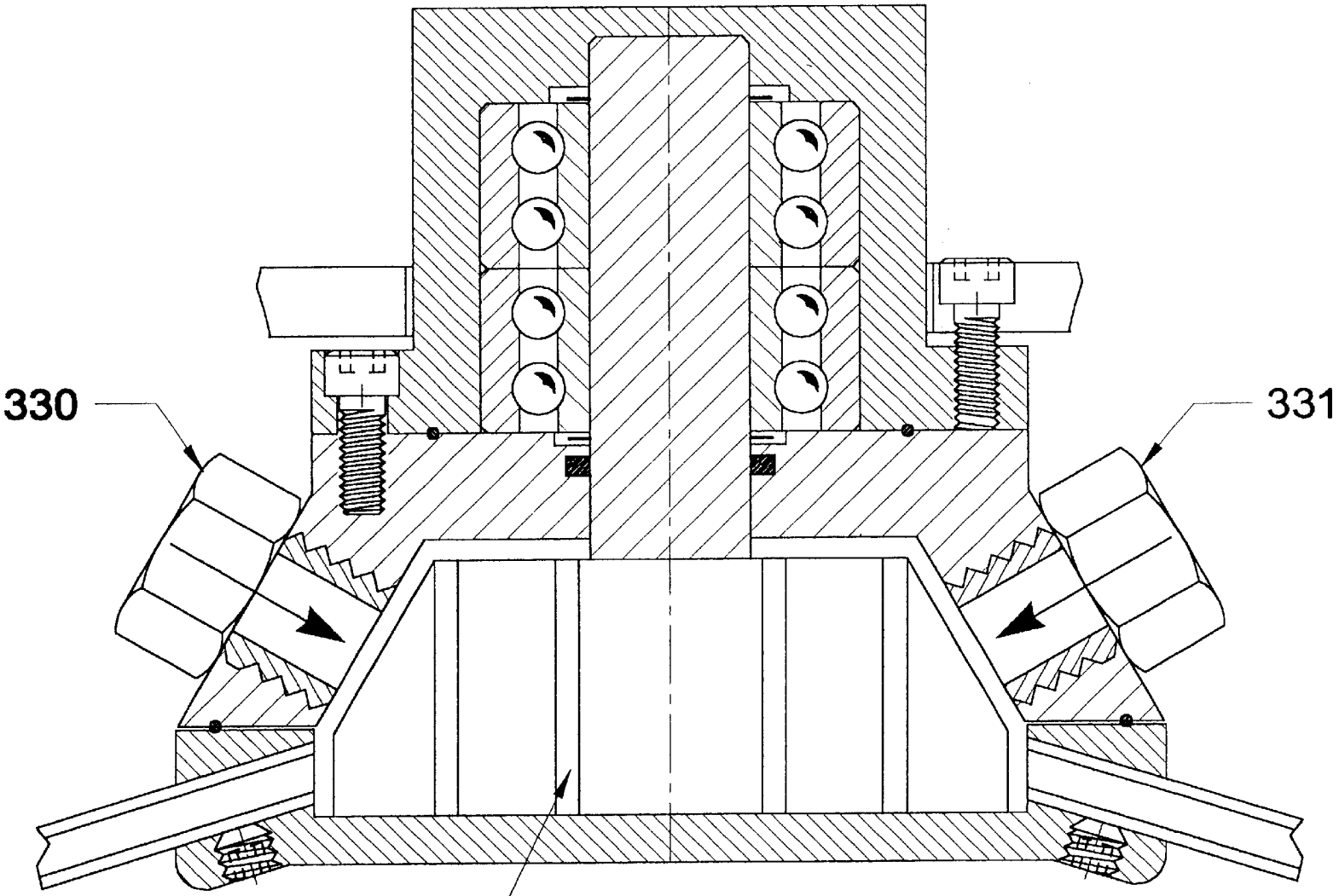
FIG. 65 is a cross-sectional side view of a rotary union with an impeller and two fluid inlets for change of direction means.
Figures 66, 67:
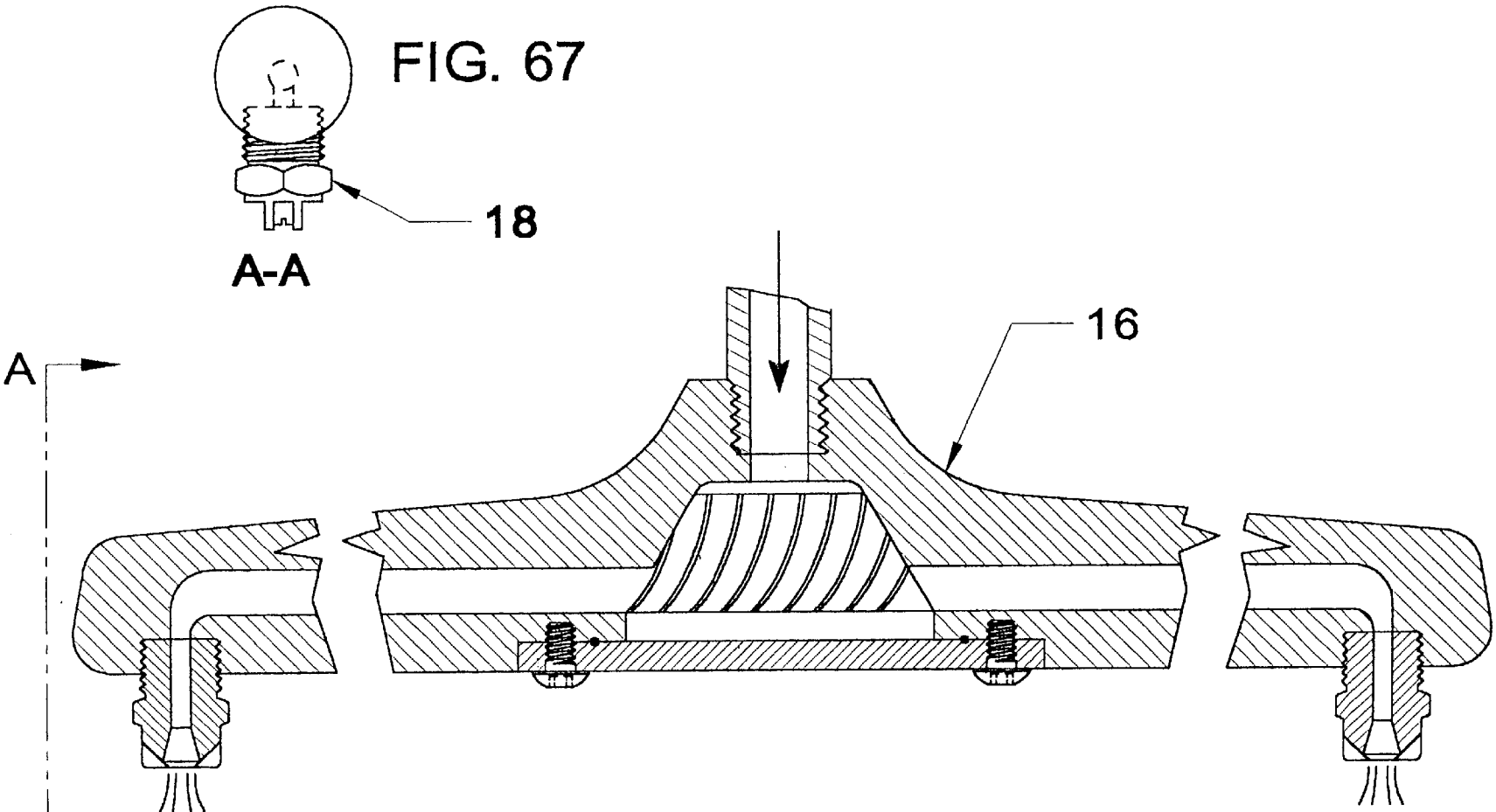
FIG. 66 is across-sectional view of the rotor arm with at least two nozzle attachments.
FIG. 67 is a cross-sectional view of the rotor arm of FIG. 66.

Finally, FIG. 65 is a side cross sectional view through an impeller containing rotary union with two different inlets, 330 and 331. Introduction of high pressure fluid into opening 330 impinges upon impeller 332 in one direction, causing rotary arms to rotate in one direction. As the bristles of a brush tend to wear out on the leading edge first, the life of the brush can be extended by changing the direction of rotation. This can be accomplished by removing the supply source of high pressure fluid from inlet 330, closing off inlet 330, and connecting the source of high pressure to inlet 331. As the fluid impinges upon impeller 332 in the opposite direction, the opposite reaction is caused, and the rotary brush is caused to rotate in the opposite direction.

Figure 68:
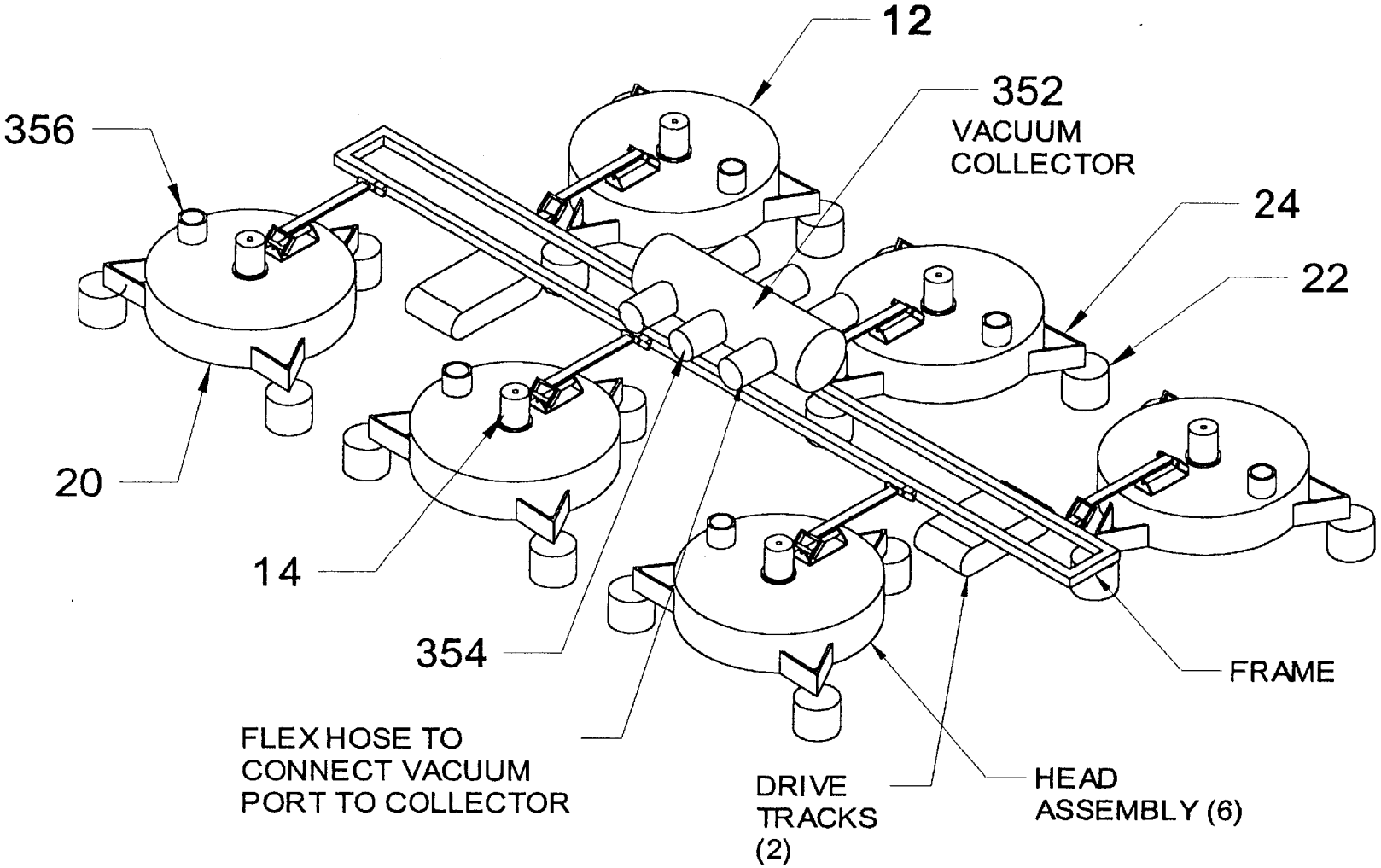
FIG. 68 is an isometric perspective view of a plurality of rotary spray units having a frame member with a vacuum and/or magnet connections.
Figure 68A:
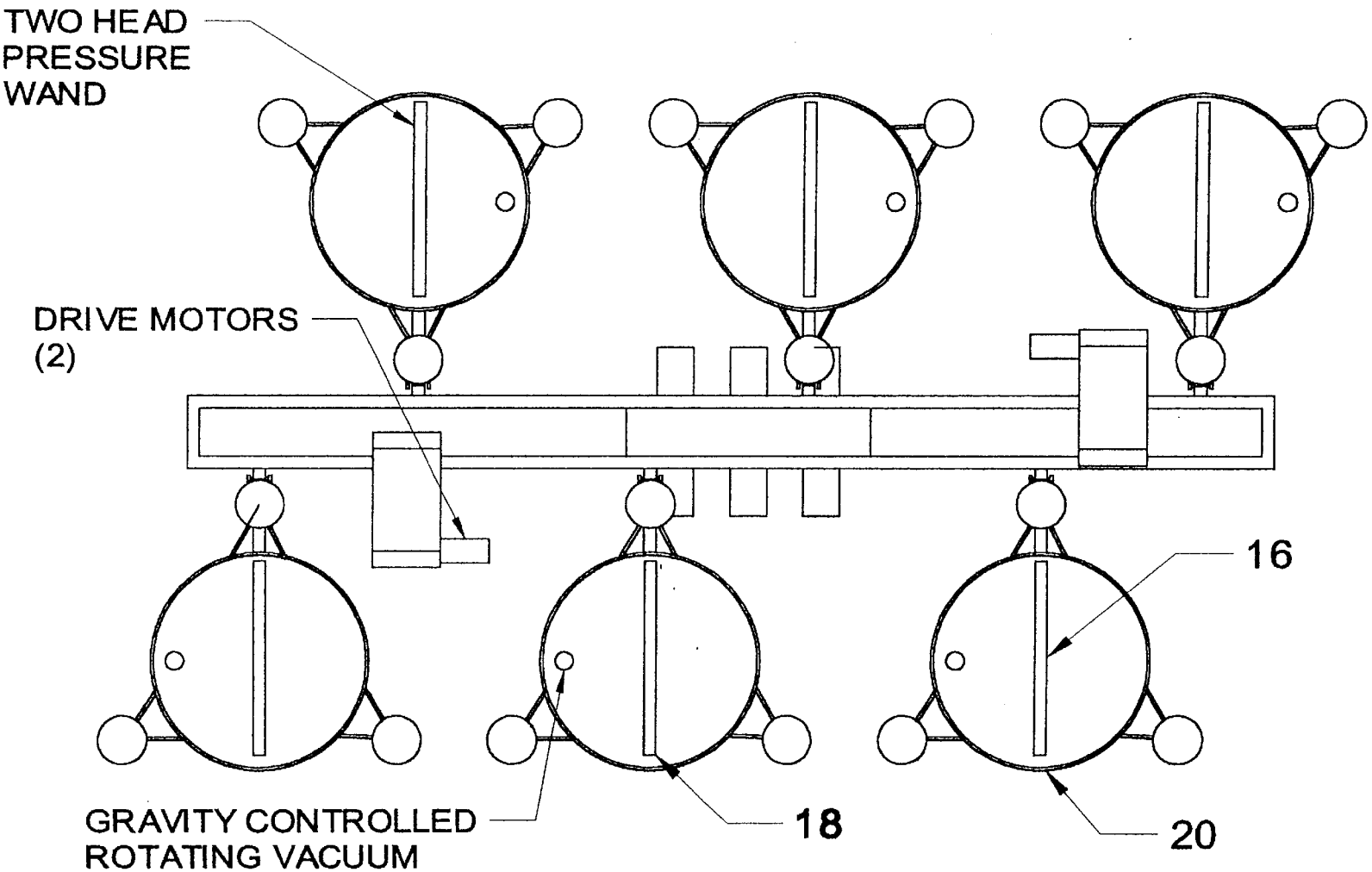
FIG. 68A is a top plan view of FIG. 68.
Figure 68B:
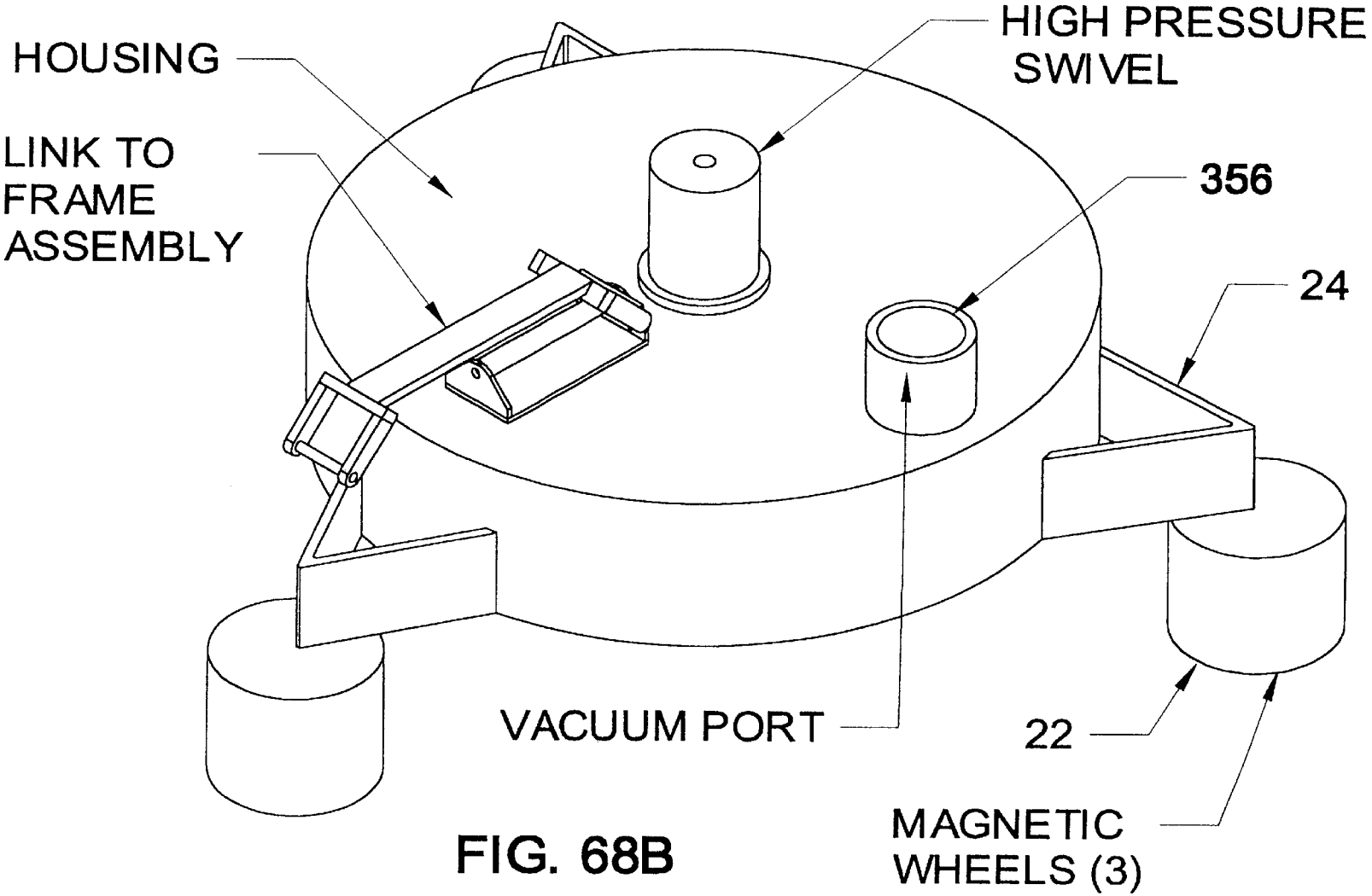
FIG. 68B is an enlarged view of the rotary spray unit of FIG. 68 showing magnetic attachment means with internal casters (not shown).
Figure 69:
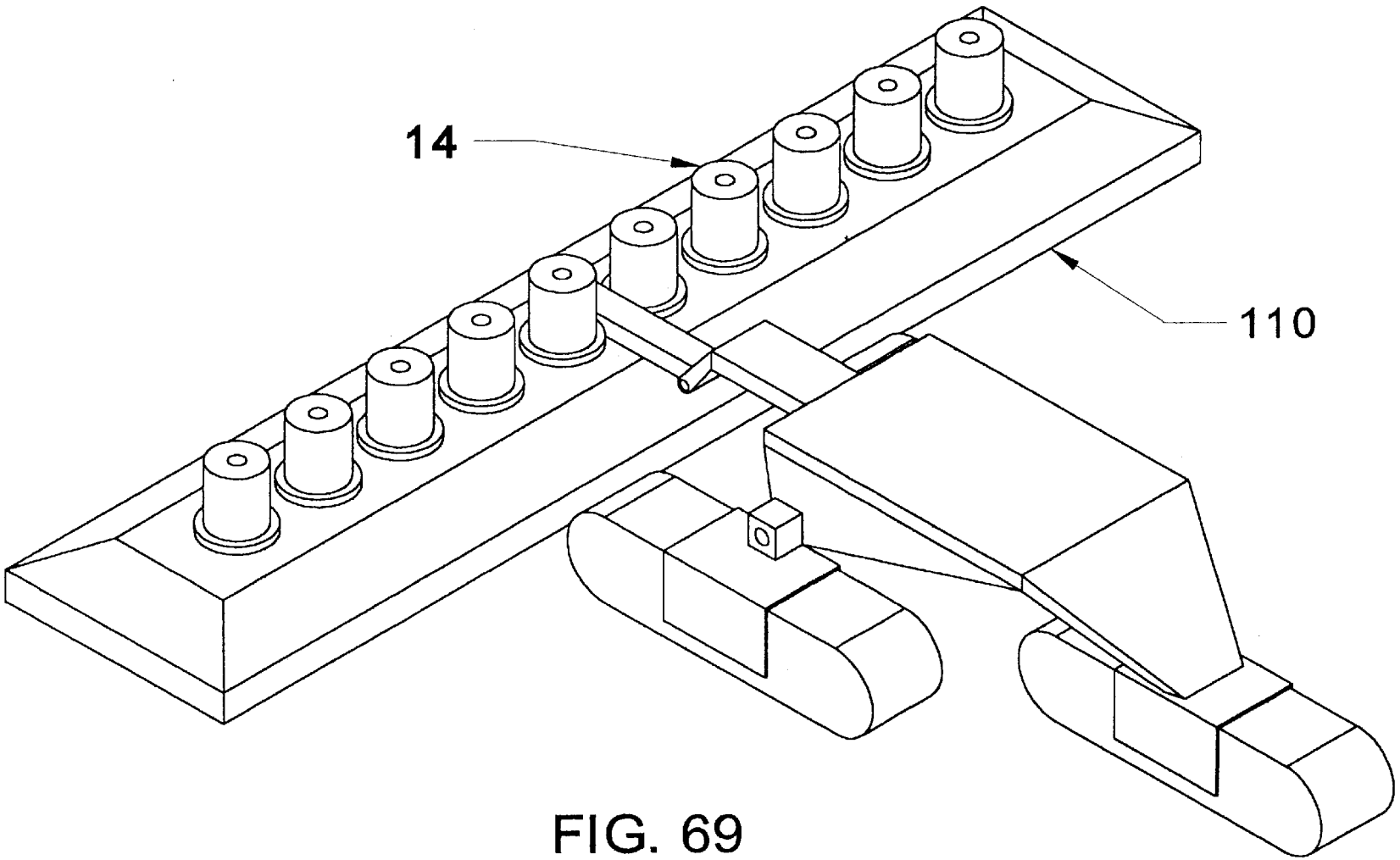
FIG. 69 is an isometric of yet another embodiment of the present invention having the plurality of rotary spray units linearly arranged and transported by a hydraulic driven magnetic track system.

Although the invention is described above by reference to a primary support means for lifting or suspending the treatment device, it is also possible to use a vacuum system, as shown in FIGS. 68–68B or a steered magnetic track vehicle, as shown in FIG. 69 as either a primary or a secondary means for holding the surface treatment apparatus. Such a system may be for example a magnet based system such as the system using permanent magnetic tracks to secure to any steel surface such as a ship hull similar to any one of "Hydro-Crawler" available from Jet Edge®, a Division of TC/American Monorail, Inc. Alternatively, it may be a vacuum attached system such as used in "U-Robot System Polishing Robot—Type: UM" and "Abrasives Blasting Robot—Type: UA" available from Urakami Research & Development Co., Ltd. or "Aquablast®-Plus" available from Hammelmann Corp. or "The Robotic Climber™" available from Bartlett Services, Inc. of Plymouth, Mass.

The system for suspending the surface treating apparatus may also be suspended from cables such as the "The Blast-Droyd" available from Burds L. L. C., which is covered by U.S. Pat. No. 5,685,767 (Burds) and teaches a trolley located on the flat upper surface of the object to be sandblasted and a blasting machine with an oscillating blast nozzle that is carried by the trolley. The blast machine is suspended from hoist cables, whose ends are carried by the trolley. Each of these devices and patents is incorporated herein by reference.

Figure 71:
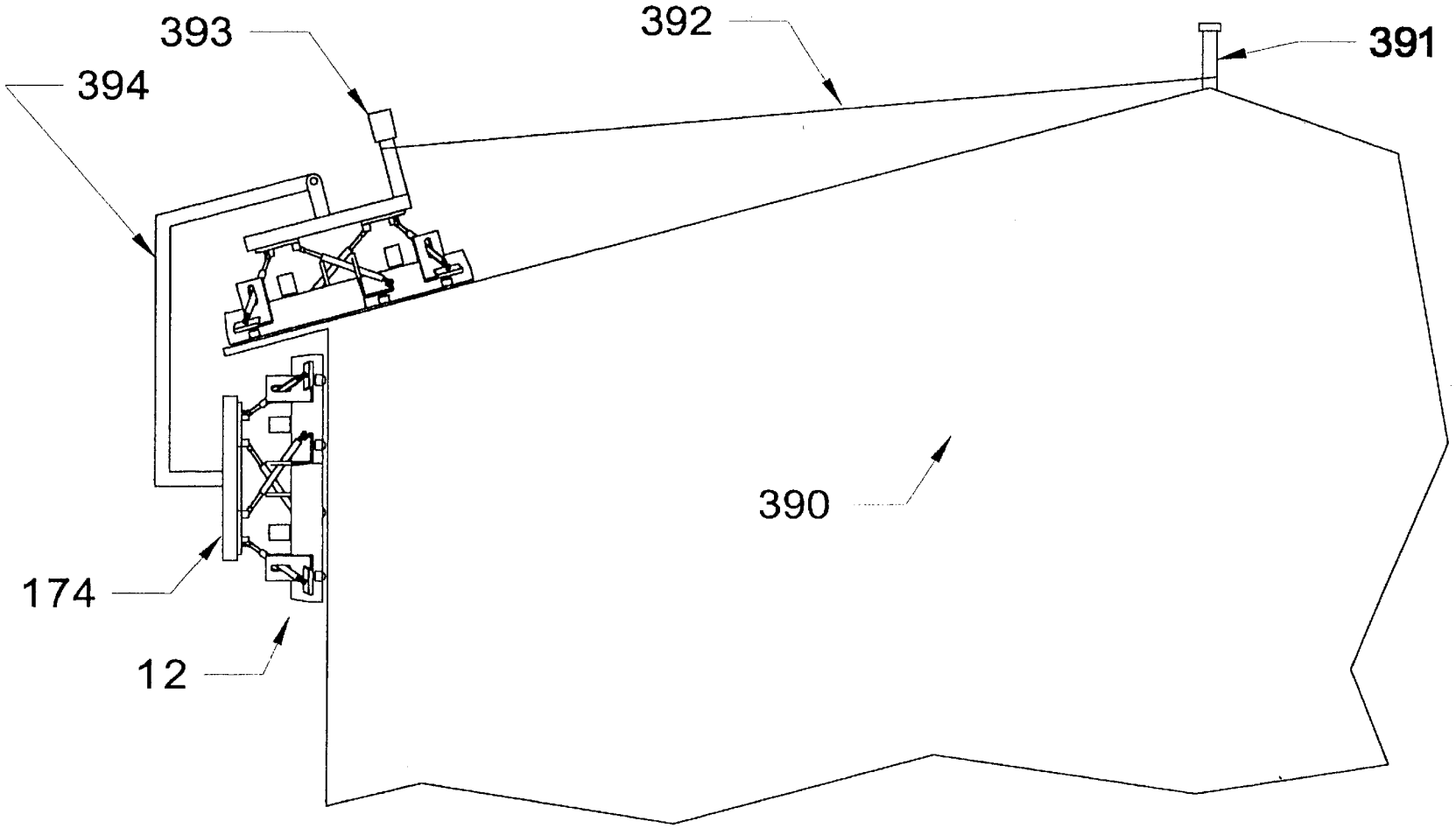
FIG. 71 is a side view of a two units of the preferred embodiment working simultaneously to clean the roof and outside side wall of a storage tank, the second unit being coupled by a flexible arm to the first unit, the first unit supported by an anchor cable connected to a support pole of a storage tank.
Figure 72:
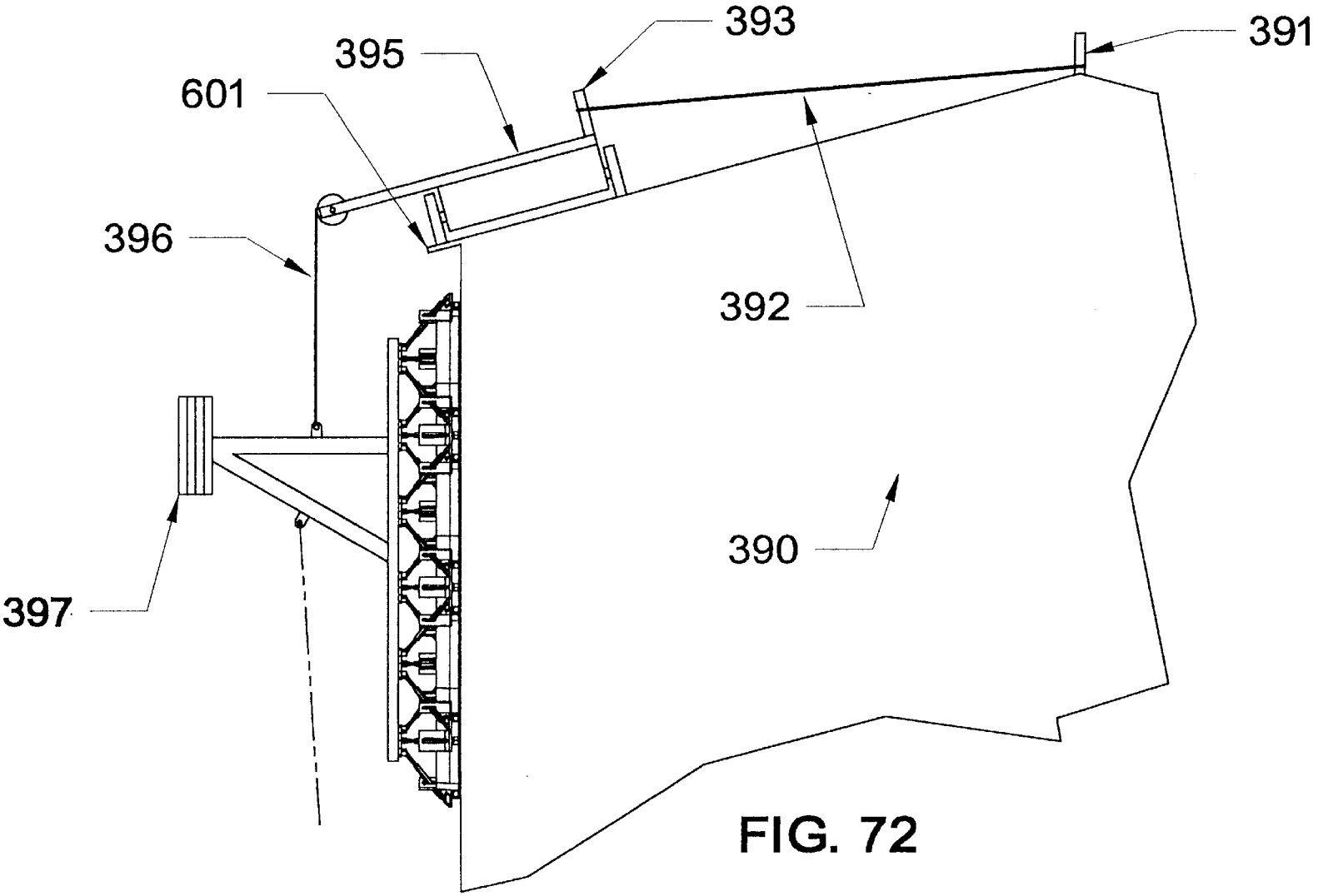
FIG. 72 is a side view of the preferred embodiment of the present invention suspended along the vertical wall of a structure while supported with an anchor cable coupled to a support pole or trolley.
Figure 73:
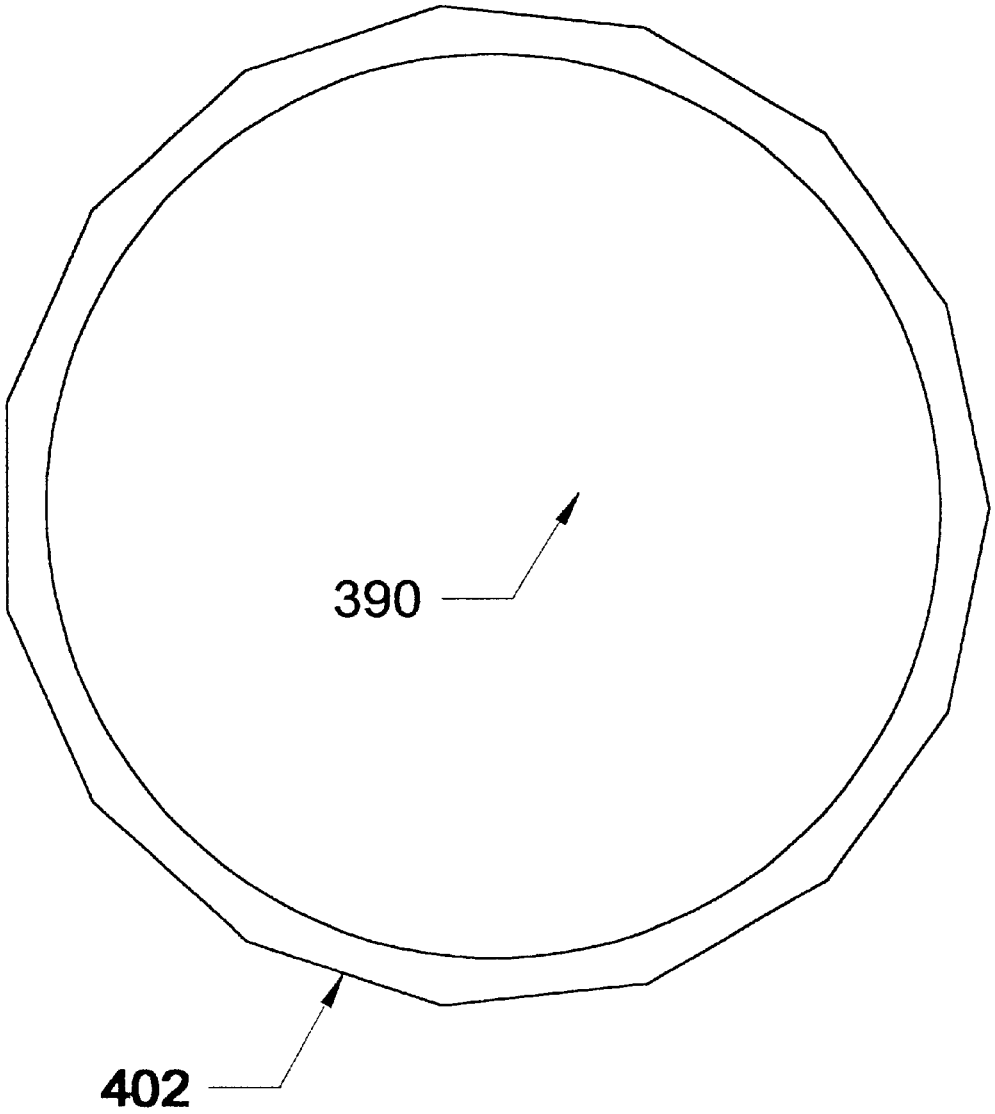
FIG. 73 is a top view of a storage tank showing the wing girder.

In FIGS. 71 and 72 the apparatus is shown suspended from the top of a tank 390. In both instances the tank has a mast 391 with an anchor cable 392 coupling with a rotary spray unit support 393. In FIG. 71, there are two rotary spray units coupled with a flexible arm 394. Further, in FIG. 71 the unit can be described as a tank unit is used to treat the surface of the tank along the tank's drip edge and upper vertical wall simultaneously. In FIG. 72 the unit can be described as a trolley unit. This unit has a trolley 395 coupled with an adjustable cable 396 to support a counterweight 397. The rotary spray units of the apparatus are held against the storage tank by the counterweight.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation depicted and described, and accordingly, all suitable modifications and equivalents may be resorted to, falling within the scope of the invention.

Now that the invention has been described,

What is claimed is:

1. A high-pressure surface treating apparatus comprising:

a framework comprised of one or more frame members;

at least one rotary spray unit flexibly associated with each frame member, each rotary spray unit comprising at least one rotary spray arm having at least one nozzle directed away from said framework, a high pressure surface treatment medium supply conduit, a rotary union having an axis of rotation and connecting said high pressure medium supply conduit with said rotary spray arm;

enclosure means for enclosing one or more of said rotary spray units against the surface being treated;

rotary spray unit positioning means for individually positioning each of said respective rotary spray units relative to the surface being treated;

primary framework positioning means for orienting said framework along said surface to be treated relative to secondary positioning means and adapted for providing constant bias of said framework against said surface being treated; and secondary framework positioning means for supporting and moving said primary framework positioning means relative to the surface to be treated.

2. A high-pressure surface treating apparatus as in claim 1, wherein said medium is selected from the group consisting of a gas, a gas and solid mixture, a liquid, and a liquid and solid mixture.

3. A high pressure surface treating apparatus as in claim 1, wherein said framework is comprised of two or more frame members hingedly connected to each other to form a flexible framework.

4. A high pressure surface treating apparatus as in claim 1, wherein said high pressure surface treating apparatus further includes a source of high pressure medium connected to said high pressure surface treatment fluid supply conduit, a recycle return conduit, one end of which is in communication with at least one housing, the other end of which is connected to a vacuum or pump or gravity source adapted to evacuate said at least one housing at a rate greater than the rate at which the high pressure surface treatment medium is introduced into the housing.

5. A high pressure surface treating apparatus as in claim 1, further comprising treatment means for purification of said high pressure surface treatment medium and returning said medium to said source of high pressure medium.

6. A high pressure surface treating apparatus as in claim 1, wherein an individual containment housing is provided around each individual rotary spray unit adapted for sealing a work space containing said rotary spray unit against a surface to be treated.

7. A high pressure surface treating apparatus as in claim 1, wherein a common containment housing is provided surrounding all rotary spray units, said common containment housing adapted for sealing a work space containing said rotary spray units against a surface to be treated.

8. A high pressure surface treating apparatus as in claim 1, wherein said framework is comprised of a single rigid frame member, and wherein two or more rotary spray units are provided on said frame member.

9. A high pressure surface treating apparatus as in claim 1, wherein said framework extends along a plane, and wherein said framework is rotatably connected to said primary framework positioning means for rotation in said plane between first and second positions.

10. A high pressure surface treating apparatus as in claim 9, wherein said first and second positions are separated by at least 90°.

11. A high pressure surface treating apparatus as in claim 9, wherein said first and second positions are separated by at least 180°.

12. A high pressure surface treating apparatus as in claim 1, wherein said rotary spray unit positioning means for individually positioning each of said respective rotary spray units relative to the surface being treated comprises:

a mechanical contact element for contacting a surface to be treated; and a flexible, resilient mechanical coupling between said mechanical contact and said rotary union, such that movement of the mechanical contact element causes a corresponding movement of said rotary union and thereby of the rotary spray unit.

13. A high-pressure surface treating apparatus as in claim 1, wherein said rotary spray unit positioning means for individually positioning each of said respective rotary spray units relative to the surface being treated comprises:

a mechanical contact element for contacting a surface to be treated; and a rigid mechanical coupling between said mechanical contact and said rotary union, wherein said rotary union is resiliently flexibly connected to said frame member, such that movement of the mechanical contact element causes a corresponding movement of said rotary union and thereby of the rotary spray unit.

14. A high-pressure surface treating apparatus comprising:

a framework comprised of one or more frame members;

at least one rotary spray unit flexibly associated with each frame member, each rotary spray unit comprising at least one rotary spray arm having at least one nozzle directed away from said framework, a high pressure surface treatment medium supply conduit, a rotary union having an axis of rotation and connecting said high pressure medium supply conduit with said rotary spray arm;

enclosure means for enclosing one or more of said rotary spray units against the surface being treated;

rotary spray unit positioning means for individually positioning each of said respective rotary spray units relative to the surface being treated;

primary framework positioning means comprising a cylinder framework, two or more work cylinders fixedly or pivotably connected to said cylinder framework, pistons provided in said cylinder moveable against a pressure medium, connecting rods connected at one end to said pistons and pivotably connected at the other end to a generally planar connecting rod framework, pressure medium supplied to said work cylinder;

control means responsive to changes in pressure in each of said work cylinders to adjust the pressure in each of said work cylinders to maintain a constant pressure;

wherein said framework extends along a plane, and wherein said framework is rotatably connected to said connecting rod framework for rotation in said framework in said plane about at least 90°.

15. A high pressure surface treating apparatus as in claim 14, wherein said primary framework positioning means comprises at least four cylinders.

16. A high pressure surface treating apparatus as in claim 14, wherein said pressure medium is selected from the group consisting of hydraulic fluid, nitrogen, and air.

17. A high pressure surface treating apparatus as in claim 14, wherein said pressures medium is air, and wherein said control means is an air logic system.

18. A high pressure surface treating apparatus as in claim 14, comprising secondary framework positioning means for supporting and moving said primary framework positioning means relative to the surface to be treated.

19. A high pressure surface treating apparatus as in claim 18, wherein said secondary framework positioning means is selected from the group consisting of a boom, a suspension cable, a vertically, displaceable mounts provided on a wheeled vehicle, or scaffold and a magnetic track vehicle.

20. A high-pressure surface treating apparatus comprising:

a framework comprised of one or more frame members;

at least one rotary spray unit flexibly associated with each frame member, each rotary spray unit comprising at least one rotary spray arm having at least one nozzle directed away from said framework, a high pressure surface treatment fluid supply conduit, a rotary union having an axis of rotation and connecting said high pressure fluid supply conduit with said rotary spray arm;

enclosure means for individually and/or collectively enclosing one or more of said rotary spray units against the surface being treated;

resilient mechanical rotary spray unit positioning means for individually maintaining the position of each rotary spray unit relative to the surface being treated.

21. A high pressure surface treating apparatus as in claim 20, wherein said apparatus comprises a single rotary spray unit.

22. A high-pressure surface treating apparatus comprising:

a framework comprised of one or more frame members;

at least one rotary spray unit flexibly associated with each frame member, each rotary spray unit comprising at least one rotary spray arm having at least one nozzle directed away from said framework, a high pressure surface treatment fluid supply conduit, a rotary union having an axis of rotation and connecting said high pressure fluid supply conduit with said rotary spray arm;

enclosure means for individually and/or collectively enclosing one or more of said rotary spray units against the surface being treated;

resilient mechanical rotary spray unit positioning means for individually maintaining the position of each rotary spray unit relative to the surface being treated; and wherein said apparatus comprises at least two rotary spray units, and wherein said at least two rotary spray units are pivotable independently of each other.

23. A vertical surface high-pressure treating apparatus comprising a high-pressure surface treating apparatus mounted on a boom supported on a mobile vehicle, a boom-positioning means having thereon, said high pressure treating apparatuses comprising:

a framework comprised of one or more frame members;

at least one rotary spray unit flexibly associated with each frame member, each rotary spray unit comprising at least one rotary spray arm having at least one nozzle directed away from said framework, a high pressure surface treatment fluid supply conduit, a rotary union having an axis of rotation and connecting said high pressure fluid supply conduit with said rotary spray arm;

resilient mechanical rotary spray unit positioning means for individually maintaining the position of each rotary spray unit relative to the surface being treated.

24. A high pressure surface treating apparatus comprising:

a framework comprised of one or more frame members;

at least one rotary spray unit flexibly associated with each frame member, each rotary spray unit comprising at least one rotary spray arm having at least one nozzle directed away from said framework, a high pressure surface treatment fluid supply conduit, a rotary union having an axis of rotation and connecting said high pressure fluid supply conduit with said rotary spray arm;

resilient mechanical rotary spray unit positioning means for individually maintaining the position of each rotary spray unit relative to the surface being treated;

said rotary spray unit positioning means for individually positioning each of said respective rotary spray units relative to the surface being treated includes a mechanical contact element for contacting a surface to be treated, and a rigid mechanical coupling between said mechanical contact and said rotary union, and wherein said rotary union is resiliently flexibly connected to said frame member, such that movement of the mechanical contact element causes a corresponding movement of said rotary union and thereby of the rotary spray unit.

25. A multi-level high-pressure surface treating apparatus comprising a multi-level scaffold having a high-pressure surface treating apparatus mounted on at least two levels, each of said high pressure treating apparatuses comprising:

a framework comprised of one or more frame members;

at least one rotary spray unit flexibly associated with each frame member, each rotary spray unit comprising at least one rotary spray arm having at least one nozzle directed away from said framework, a high pressure surface treatment fluid supply conduit, a rotary union having an axis of rotation and connecting said high pressure fluid supply conduit with said rotary spray arm;

resilient mechanical rotary spray unit positioning means for individually maintaining the position of each rotary spray unit relative to the surface being treated.

* * * * *